US007393092B2

(12) United States Patent
Saruta et al.

(10) Patent No.: US 7,393,092 B2
(45) Date of Patent: Jul. 1, 2008

(54) INK CARTRIDGE AND PRINTER USING THE SAME

(75) Inventors: Toshihisa Saruta, Nagano-ken (JP); Satoshi Shinada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/025,558

(22) Filed: Dec. 29, 2004

(65) Prior Publication Data

US 2005/0174372 A1 Aug. 11, 2005

Related U.S. Application Data

(62) Division of application No. 09/432,272, filed on Nov. 2, 1999, now Pat. No. 7,195,346.

(30) Foreign Application Priority Data

| | | |
|---|---|---|
| Nov. 2, 1998 | (JP) | 10-311671 |
| Nov. 26, 1998 | (JP) | 10-336330 |
| Nov. 26, 1998 | (JP) | 10-336331 |
| Nov. 27, 1998 | (JP) | 10-338011 |
| Oct. 18, 1999 | (JP) | 11-296012 |
| Oct. 18, 1999 | (JP) | 11-296013 |

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/19, 85–87; 358/1.15, 1.16
See application file for complete search history.

(56) References Cited

U.S. PATENT DOCUMENTS 3,991,409 A 11/1976 Dautremont et al.

(Continued)

FOREIGN PATENT DOCUMENTS

EP 443245 8/1991

(Continued)

OTHER PUBLICATIONS

Written opinion for Application No. SG 0003594-9 from Australian patent office.

(Continued)

*Primary Examiner*—An H Do
(74) *Attorney, Agent, or Firm*—Stroock & Stroock & Lavan LLP

(57) ABSTRACT

Cost of an ink jet printer is reduced using an EEPROM enabling sequential accesses for storage elements in black and color ink cartridges. The data array of a memory cell of the storage elements is determined so that a second storage area, where rewritable data like data on remaining inks are stored, is accessed before a first storage area where read only data are stored. This way rewritable data can be securely written into the second storage area even after power-off. The second storage area has two memory divisions for each ink. Current data on the remaining ink is alternately written into these memory divisions. Alternatively, the current data on the ink is written into these memory divisions in duplicate. Each memory division has a write complete flag to determine if writing has been completed normally. This enables the remaining quantities of the inks to be monitored accurately and continuously.

30 Claims, 31 Drawing Sheets

U.S. PATENT DOCUMENTS

| | | | | |
|---|---|---|---|---|
| 4,739,352 | A | 4/1988 | Gorelick et al. | |
| 4,961,088 | A | 10/1990 | Gilliland et al. | |
| 5,049,898 | A | 9/1991 | Arthur et al. | |
| 5,066,978 | A | 11/1991 | Watari et al. | |
| 5,068,806 | A | 11/1991 | Gatten | |
| 5,138,344 | A | 8/1992 | Ujita | |
| 5,365,312 | A | 11/1994 | Hillmann et al. | |
| 5,410,641 | A | 4/1995 | Wakabayashi et al. | |
| 5,414,452 | A | 5/1995 | Accatino et al. | |
| 5,506,611 | A | 4/1996 | Ujita et al. | |
| 5,519,418 | A | 5/1996 | Nishikawa et al. | |
| 5,610,635 | A | 3/1997 | Murray et al. | |
| 5,646,660 | A | 7/1997 | Murray | |
| 5,699,091 | A | 12/1997 | Bullock et al. | |
| 5,786,828 | A | 7/1998 | Yamamoto | |
| 5,788,388 | A | 8/1998 | Cowger et al. | |
| 5,812,156 | A | 9/1998 | Bullock et al. | |
| 5,835,817 | A | 11/1998 | Bullock et al. | |
| 5,860,363 | A * | 1/1999 | Childers et al. | 101/483 |
| 5,861,897 | A | 1/1999 | Ide et al. | |
| 5,930,553 | A | 7/1999 | Hirst et al. | |
| RE36,279 | E | 8/1999 | Ujita | |
| 5,975,677 | A | 11/1999 | Marler et al. | |
| 6,019,449 | A | 2/2000 | Bullock et al. | |
| 6,019,461 | A | 2/2000 | Yoshimura et al. | |
| 6,065,824 | A | 5/2000 | Bullock et al. | |
| 6,086,193 | A | 7/2000 | Shimada et al. | |
| 6,109,723 | A | 8/2000 | Castle et al. | |
| 6,126,265 | A | 10/2000 | Childers et al. | |
| 6,196,670 | B1 | 3/2001 | Saruta | |
| 6,271,928 | B1 * | 8/2001 | Bullock et al. | 358/1.16 |
| 6,312,073 | B1 | 11/2001 | Inora et al. | |
| 6,371,586 | B1 | 4/2002 | Saruta | |
| 6,447,090 | B1 | 9/2002 | Saruta | |
| 6,494,559 | B1 | 12/2002 | Tsuji | |
| 6,565,198 | B2 | 5/2003 | Saruta | |
| 6,631,967 | B1 | 10/2003 | Saruta | |
| 2002/0085051 | A1 | 7/2002 | Saruta | |
| 2002/0180851 | A1 | 12/2002 | Saruta | |
| 2002/0191038 | A1 | 12/2002 | Tsuji | |
| 2002/0196302 | A1 | 12/2002 | Saruta | |
| 2003/0007027 | A1 | 1/2003 | Saruta | |
| 2003/0058297 | A1 | 3/2003 | Saruta | |
| 2003/0197751 | A1 | 10/2003 | Saruta | |

FOREIGN PATENT DOCUMENTS

| | | | |
|---|---|---|---|
| EP | 0 593 282 | A2 | 4/1994 |
| EP | 0854043 | | 7/1998 |
| EP | 0854044 | | 7/1998 |
| EP | 873873 | | 10/1998 |
| EP | 891865 | | 1/1999 |
| EP | 0940259 | A2 | 9/1999 |
| EP | 1 004 449 | A2 | 5/2000 |
| EP | 1 004 451 | A2 | 5/2000 |
| EP | 1 066 967 | A2 | 1/2001 |
| EP | 1 080 911 | A2 | 3/2001 |
| EP | 1 080 912 | A2 | 3/2001 |
| EP | 1 114 726 | A1 | 7/2001 |
| EP | 1 136 268 | A1 | 9/2001 |
| EP | 1247651 | A2 | 10/2002 |
| EP | 1 066 967 | A2 | 1/2004 |
| GB | 2 350 220 | A | 11/2000 |
| JP | 62-184856 | | 8/1987 |
| JP | 2-279344 | A | 11/1990 |
| JP | 04-500482 | T2 | 1/1992 |
| JP | 05-20275 | | 3/1993 |
| JP | 05-193127 | | 8/1993 |
| JP | 06-126981 | | 5/1994 |
| JP | 07-234948 | | 9/1995 |
| JP | 08-177608 | A | 7/1996 |
| JP | 08-187854 | A | 7/1996 |
| JP | 08-197748 | A | 8/1996 |
| JP | 08-224885 | A | 9/1996 |
| JP | 08-224886 | A | 9/1996 |
| JP | 08-224891 | A | 9/1996 |
| JP | 08-235851 | | 9/1996 |
| JP | 08-310007 | | 11/1996 |
| JP | 2594912 | | 12/1996 |
| JP | 09-001823 | A | 1/1997 |
| JP | 9-48120 | A | 2/1997 |
| JP | 9-269876 | | 10/1997 |
| JP | 09-309213 | | 12/1997 |
| JP | 09-314861 | A | 12/1997 |
| JP | 10-044567 | A | 2/1998 |
| JP | 10-105454 | | 4/1998 |
| JP | 10-217509 | A | 8/1998 |
| JP | 2000-301738 | | 10/2000 |
| WO | 90/00974 | | 2/1990 |
| WO | 96/05061 | | 2/1996 |
| WO | 98/52762 | | 11/1998 |
| WO | 99/65695 | | 12/1999 |
| WO | 00/26034 | | 5/2000 |

OTHER PUBLICATIONS

"Random vs. Sequential Access Memory", Lycos, pp. 1-3, 2002.
Notice of Rejection from Japan Patent Office for JP 10-338011, mailed Jul. 20, 2004.
Office Action from Japanese Pat. Appln. No. 1998-338011 (Mar. 30, 2004).
U.S. Appl. No. 10/465,650, filed Jun. 20, 2003, Saruta.
Office Action from German Patent Appln. No. 19964385.7-27, dated Mar. 15, 2005 (with English translation).
"Serial EEPROM", Transistor Gijutsu Special No. 25, pp. 15-18 (with partial English translation).

* cited by examiner 80, 107K

| | Contents of Information |
|---|---|
| 701 | 1st Data on remaining quantity of black ink |
| 702 | 2nd Data on remaining quantity of black ink |
| 711 | Data on unsealed time (year) |
| 712 | Data on unsealed time (month) |
| 713 | Version data of ink cartridge |
| 714 | Data on type of ink |
| 715 | Data on year of manufacture |
| 716 | Data on month of manufacture |
| 717 | Data on date of manufacture |
| 718 | Data on production line |
| 719 | Serial number data |
| 720 | Data on recycle |

760

750

Fig. 7

80, 107F

| | Contents of Information |
|---|---|
| 601 | 1st Data on remaining quantity of cyan ink |
| 602 | 2nd Data on remaining quantity of cyan ink |
| 603 | 1st Data on remaining quantity of magenta ink |
| 604 | 2nd Data on remaining quantity of magenta ink |
| 605 | 1st Data on remaining quantity of yellow ink |
| 606 | 2nd Data on remaining quantity of yellow ink |
| 607 | 1st Data on remaining quantity of light cyan ink |
| 608 | 2nd Data on remaining quantity of light cyan ink |
| 609 | 1st Data on remaining quantity of light magenta ink |
| 610 | 2nd Data on remaining quantity of light magenta ink |
| 611 | Data on unsealed time (year) |
| 612 | Data on unsealed time (month) |
| 613 | Version data of ink cartridge |
| 614 | Data on type of ink |
| 615 | Data on year of manufacture |
| 616 | Data on month of manufacture |
| 617 | Data on date of manufacture |
| 618 | Data on production line |
| 619 | Serial number data |
| 620 | Data on recycle |

660

650

Fig. 8

90, 100

| | Contents of Information |
|---|---|
| 901 | Data on remaining quantity of black ink |
| 902 | Data on unsealed time (year) |
| 903 | Data on unsealed time (month) |
| 904 | Version data of ink cartridge |
| 905 | Data on type of ink |
| 906 | Data on year of manufacture |
| 907 | Data on month of manufacture |
| 908 | Data on date of manufacture |
| 909 | Data on production line |
| 910 | Serial number data |
| 911 | Data on recycle |
| 921 | Data on remaining quantity of cyan ink |
| 922 | Data on remaining quantity of magenta ink |
| 923 | Data on remaining quantity of yellow ink |
| 924 | Data on remaining quantity of light cyan ink |
| 925 | Data on remaining quantity of light magenta ink |
| 926 | Data on unsealed time (year) |
| 927 | Data on unsealed time (month) |
| 928 | Version data of ink cartridge |
| 929 | Data on type of ink |
| 930 | Data on year of manufacture |
| 931 | Data on month of manufacture |
| 932 | Data on date of manufacture |
| 933 | Data on production line |
| 934 | Serial number data |
| 935 | Data on recycle |

Fig. 9

| | Contents of Information |
|---|---|
| 801 | 1st Data on remaining quantity of cyan ink |
| 802 | 1st Data on remaining quantity of magenta ink |
| 803 | 1st Data on remaining quantity of yellow ink |
| 804 | 1st Data on remaining quantity of light cyan ink |
| 805 | 1st Data on remaining quantity of light magenta ink |
| 870 | Write complete flag A |
| 806 | 2nd Data on remaining quantity of cyan ink |
| 807 | 2nd Data on remaining quantity of magenta ink |
| 808 | 2nd Data on remaining quantity of yellow ink |
| 809 | 2nd Data on remaining quantity of light cyan ink |
| 810 | 2nd Data on remaining quantity of light magenta ink |
| 871 | Write complete flag B |
| 811 | Data on unsealed time (year) |
| 812 | Data on unsealed time (month) |
| 813 | Version data of ink cartridge |
| 814 | Data on type of ink |
| 815 | Data on year of manufacture |
| 816 | Data on month of manufacture |
| 817 | Data on date of manufacture |
| 818 | Data on production line |
| 819 | Serial number data |
| 920 | Data on recycle |

800 (810)

860

850

Fig. 19

| Address of Control IC 200 | Data Length (byte) | Items of Information | Address of Storage Element 1080 | Capacity (bit) in Storage Element |
|---|---|---|---|---|
| 00 | 1 | Remaining quantity of black ink | 00 | 8 |
| 01 | 1 | Frequency of cleaning | 08 | 8 |
| 02 | 1 | Frequency of attachment | 10 | 8 |
| 03 | 2 | Total time period of attachment | 18 | 16 |
| 05 | 1 | Year of manufacture | 28 | 7 |
| 06 | 1 | Month of manufacture | 2F | 4 |
| 07 | 1 | Date of manufacture | 33 | 5 |
| 08 | 1 | Hour of manufacture | 38 | 5 |
| 09 | 1 | Minute of manufacture | 3D | 6 |
| 0A | 1 | Production serial No. | 43 | 8 |
| 0B | 1 | Frequency of recycle | 4B | 3 |
| 0C | 2 | Ink cartridge name | 4E | 10 |
| 0E | 1 | Ink type | 58 | 8 |
| 0F | 1 | Term of validity | 60 | 6 |
| 10 | 1 | Term of validity after unsealed | 66 | 5 |

Fig.22

| Address of Control IC 200 | Data Length (byte) | Items of Information | Address of Storage Element 1082 | Capacity (bit) in Storage Element |
|---|---|---|---|---|
| 20 | 1 | Remaining quantity of cyan ink | 00 | 8 |
| 21 | 1 | Remaining quantity of magenta ink | 08 | 8 |
| 22 | 1 | Remaining quantity of yellow ink | 10 | 8 |
| 23 | 1 | Remaining quantity of light cyan ink | 18 | 8 |
| 24 | 1 | Remaining quantity of light magenta | 20 | 8 |
| 25 | 1 | Frequency of cleaning | 28 | 8 |
| 26 | 1 | Frequency of attachment | 30 | 8 |
| 27 | 2 | Total time period of attachment | 38 | 16 |
| 29 | 1 | Year of manufacture | 48 | 7 |
| 2A | 1 | Month of manufacture | 4F | 4 |
| 2B | 1 | Date of manufacture | 53 | 5 |
| 2C | 1 | Hour of manufacture | 58 | 5 |
| 2D | 1 | Minute of manufacture | 5D | 6 |
| 2E | 1 | Production serial No. | 63 | 8 |
| 2F | 1 | Frequency of recycle | 6B | 3 |
| 30 | 2 | Ink cartridge name | 6E | 10 |
| 32 | 1 | Ink type | 78 | 8 |
| 33 | 1 | Term of validity | 80 | 6 |
| 34 | 1 | Term of validity after unsealed | 86 | 5 |

Fig. 23

INK CARTRIDGE AND PRINTER USING THE SAME

CROSS-REFERENCE TO RELATED APPLICATION

This application is a divisional of application Ser. No. 09/432,272, filed on Nov. 2, 1999 now U.S. Pat. No. 7,195,346.

BACKGROUND OF THE INVENTION

1. Field of the Invention

The present invention relates to an ink jet-type printing apparatus, such as an ink jet printer and an ink jet plotter, and also to an ink cartridge detachably attached to a printer main body of the ink jet-type printing apparatus. More specifically the invention pertains to a technique of processing and storing information relating to the quantity of ink kept in the ink cartridge.

2. Description of the Related Art

The ink jet-type printing apparatus like the ink jet printer and the ink jet plotter mainly includes an ink cartridge, in which one or plural inks are kept, and a printer main body with a print head to carry out actual printing operations on a printing medium. The print head ejects ink fed from the ink cartridge onto the printing medium, such as printing paper, so as to implement printing on the printing medium. The ink cartridge is designed to be detachably attached to the printer main body. A new ink cartridge has a predetermined quantity of ink kept therein. When the ink kept in an ink cartridge runs out, the ink cartridge is replaced with a new one. The ink jet-type printing apparatus is arranged to cause the printer main body to calculate the remaining quantity of ink in the ink cartridge based on the amount of ink ejected from the print head and to inform the user of a state of running out of the ink, in order to prevent the printing procedure from being interrupted by the out-of-ink.

Another proposed ink cartridge has a storage element, in which various pieces of information relating to ink kept in the ink cartridge, for example, the type of ink and the quantity of ink, are stored. The ink cartridge has these pieces of information regarding ink, and the printer, to which the ink cartridge is attached, reads the stored information regarding ink and carries out the printing procedure suitable for the ink.

In the case where the ink cartridge stores only the read only information, the printer can not carry out the adequate printing operation by taking into account the service conditions of the ink cartridge, that is, the rewritable information regarding ink. In another application that allows the rewritable information regarding ink to be written into the ink cartridge, the conventional technique does not take any measures against possible interruption of the writing operation, which often results in incomplete writing. It is highly required to complete the writing operation of the required pieces of information within a short time period, in order to prevent the writing operation from being made incomplete by some interruption.

SUMMARY OF THE INVENTION

The object of the present invention is thus to provide an ink cartridge that attains cost reduction and enables required pieces of information relating to the ink cartridge, for example, the remaining quantity of ink, to be stored quickly and securely.

The object of the invention is also to provide a printer using such an ink cartridge, a storage element mounted on such an ink cartridge, and a method of writing the required pieces of information relating to the ink cartridge into the ink cartridge.

At least part of the above and the other related objects is actualized by a first ink cartridge detachably attached to a printer. The first ink cartridge includes: an ink reservoir in which an ink used for printing is kept; and a storage unit storing specific information in a readable, writable, and non-volatile manner, the storing unit having an ink quantity information storage area. The specific information includes information relating to a quantity of ink kept in the ink reservoir. The ink quantity information storage area is included in a specific area written first by the printer and stores the ink quantity-relating information.

The first ink cartridge of the present invention has the ink quantity information storage area, which is in the specific area written first by the printer and in which the ink quantity-relating information is stored. This arrangement enables the information relating to the ink cartridge, such as the remaining quantity of ink, to be stored quickly and securely, while reducing the manufacturing cost of the ink cartridge. The specific area written first by the printer is, for example, a head area of the storage unit or any arbitrary area of the storage unit, which is accessed and written first by the printer.

In accordance with one preferable application of the first ink cartridge, the ink reservoir includes a specific number of ink chambers corresponding to a number of different inks used for printing, and the ink quantity information storage area has a storage capacity according to the number of different inks. The ink quantity information storage area may, for example, have a storage capacity of at least three bytes. In this application, the ink quantity information storage area has a sufficient capacity to store the specific information including the ink quantity-relating information.

It is preferable that the ink quantity-relating information is written into the ink quantity information storage area at a time of replacement of the ink cartridge and/or at a power-off time of the printer. In this arrangement, the writing operation into the ink quantity information storage area is carried out at the time of replacement of the ink cartridge or at the time of highly probable replacement of the ink cartridge. This enables the ink quantity-relating information to be securely stored into the ink cartridge.

In accordance with another preferable application of the present invention, the ink reservoir has at least three ink chambers, in which at least three different color inks are kept respectively. In this arrangement, the ink quantity information storage area has a plurality of memory divisions. The plurality of memory divisions store pieces of information relating to quantities of the at least three different color inks kept in the respective ink chambers are stored independently. A storage capacity of at least one byte is allocated to each of the plurality of memory divisions.

In accordance with still another preferable application of the present invention, the ink quantity information storage area has a storage capacity of at least five bytes, and the ink reservoir has at least five ink chambers, in which at least five different color inks are kept respectively. In this arrangement, the ink quantity information storage area has a plurality of memory divisions. The plurality of memory divisions store pieces of information relating to quantities of the at least five different color inks kept in the respective ink chambers are stored independently. A storage capacity of at least one byte is allocated to each of the plurality of memory divisions.

These arrangements enable the ink quantity-relating information to be stored in an optimal manner according to the number of inks.

In the above application, it is preferable that the at least five different color inks include three deep color inks and two light color inks, which correspond to two deep colors among the three deep color inks. In the ink quantity information storage area, the memory divisions for storing the pieces of information regarding the three deep color inks are located at a first place written first by the printer, and the memory divisions for storing the pieces of information regarding the two light color inks are located at a second place written next by the printer. By way of example, the three deep color inks are cyan, magenta, and yellow, and the two light color inks are light cyan and light magenta.

This arrangement enables an identical storage unit to be used in common for the ink cartridge including only three deep color inks and the ink cartridge including three deep color inks and two light color inks.

In the above preferable applications, the pieces of information relating to the remaining quantities of the respective inks are written into the memory divisions at a time of replacement of the ink cartridge and/or at a power-off time of the printer. In this arrangement, the writing operations into the respective memory divisions are carried out at the time of replacement of the ink cartridge and/or at the time of highly probable replacement of the ink cartridge. This enables the ink quantity-relating information to be securely stored into the ink cartridge.

The storage unit may be sequentially accessed in synchronism with a clock signal. In this structure, the storage unit has a plurality of storage areas, and the ink quantity information storage area is a first storage area located at a head of the plurality of storage areas included in the storage unit. Alternatively, the storage unit has a plurality of storage areas, and the ink quantity information storage area is a last storage area located at an end of the plurality of storage areas included in the storage unit. The storage unit of such structure is sequentially accessed from the head position or from the terminal position thereof. This arrangement enables the information relating to the ink cartridge, such as the remaining quantity of ink, to be stored quickly and securely, while reducing the manufacturing cost of the ink cartridge.

In the first ink cartridge of the present invention, the ink quantity-relating information may regard a remaining quantity of ink in the ink reservoir or a cumulative amount of ink consumption with regard to the ink reservoir.

The present invention is also directed to a second ink cartridge detachably attached to a printer. The second ink cartridge includes an ink reservoir in which an ink used for printing is kept, and a storage unit storing specific information in a readable, writable, and non-volatile manner. The storage unit is further sequentially accessed in synchronism with a clock signal, and has a first storage area, in which read only information is stored, and a second storage area, which is arranged prior to the first storage area and in which rewritable information is stored. The specific information includes information relating to a quantity of ink kept in the ink reservoir.

In the second ink cartridge of the present invention, an inexpensive storage unit that enables only sequential accesses is applied for the storage element mounted on the ink cartridge. This effectively reduces the manufacturing cost of the expendable ink cartridge. In the arrangement of the second ink cartridge, the second storage area, in which rewritable data are stored, is accessed prior to the first storage area, in which read only data are stored, in the storage unit. This configuration enables the writing operation of the rewritable data into the second storage area to be completed within a short time period. Even in the case of writing the rewritable data into the second storage area after the off-operation of the power switch, this configuration enables the writing operation of the rewritable data to be completed before the power plug is pulled out of the socket. The configuration of the second ink cartridge, which applies the inexpensive storage unit enabling only the sequential access to decrease the cost of the ink cartridge, thus advantageously reduces the possible failure in the process of rewriting the data.

In accordance with one preferable application of the second ink cartridge, the rewritable information stored in the second storage area may include a piece of information on a remaining quantity of ink in the ink reservoir. The piece of information on a remaining quantity of ink is calculated by the printer from an amount of ink consumption used for printing.

In accordance with another preferable application of the second ink cartridge, the ink reservoir has a plurality of ink chambers, in which a plurality of different color inks are kept respectively. In this structure, the rewritable information stored in the second storage area may include plural pieces of information on remaining quantities of the different color inks kept in the respective ink chambers. The plural pieces of information on remaining quantities of the different color inks are calculated by the printer. This arrangement enables the remaining quantity of each color ink to be monitored separately, and thus informs the user without delay that the specific color ink is running out.

In this structure, the second storage area may have at least two memory divisions, into which a latest piece of information on the remaining quantity of ink is written sequentially.

In this configuration, the latest data on the remaining quantity of ink is written alternately into the two or more memory divisions. Some trouble may interfere with the normal writing operation of the latest data into one memory division, for example, by accidentally pulling the power plug out of the socket in the course of the wiring operation in the current cycle. The previous data written in the previous cycle immediately before the current cycle, however, remain in another memory division. Even in the case of the abnormal writing operation into one memory division, this arrangement enables the remaining quantity of ink to be monitored continuously based on the previous data written in another memory division.

In accordance with still another preferable application of the second ink cartridge, the rewritable information stored in the second storage area includes a piece of information on an amount of ink consumption with regard to the ink reservoir, which is obtained from an amount of ink consumption used for printing. In this structure, it is preferable that the piece of information on the amount of ink consumption takes an initial value in a range of 0 to 90%. Writing the initial value in the range of 0 to 90% into the information on the amount of ink consumption ensures the accurate monitor of ink consumption. This arrangement also enables the secure determination of whether or not the quantity of ink kept in the ink cartridge is measured on the assumption that adequate correction is carried out during the use of the ink cartridge.

In the second ink cartridge of the present invention, the rewritable information stored in the second storage area may include at least one selected among a piece of information on a time period elapsing after unsealing the ink cartridge and a piece of information on a frequency of attachment and detachment of the ink cartridge to and from the printer, both the elapsing time period and the frequency of attachment and detachment being measured by the printer.

In the second ink cartridge of the present invention, the read only information stored in the first storage area may include at least one selected among a piece of information on a year, month, and date of manufacture of the ink cartridge, a piece of information on a type of ink stored in the ink cartridge, and a piece of information on a capacity of the ink cartridge.

In both the first ink cartridge and the second ink cartridge having any one of the above applications, it is preferable that an EEPROM is applied for the storage unit.

In both the first ink cartridge and the second ink cartridge having any one of the above applications, it is also preferable that the storage unit has format information relating to items of information stored therein. The format information may be registered in a head area of the storage unit.

This arrangement ensures an access to the required information, based on the format information, thereby shortening the access time irrespective of the storage capacity. The format information also enables the optimal configuration of the various pieces of information.

The present invention is further directed to a third ink cartridge detachably attached to a printer. The third ink cartridge includes an ink reservoir in which an ink used for printing is kept, and a storage unit having a plurality of ink quantity information memory divisions and plurality of write complete information storage areas. The storage unit further stores specific information in a readable, writable, and non-volatile manner. The specific information includes information relating to a quantity of ink kept in the ink reservoir. The plurality of ink quantity information memory divisions stores the ink quantity-relating information. The plurality of write complete information storage areas respectively correspond to the plurality of ink quantity information memory divisions and in each of which write complete information is registered when a writing operation into the corresponding ink quantity information memory division is completed.

The arrangement of the third ink cartridge enables the required information relating to the ink cartridge, for example, the remaining quantity of ink, to be stored quickly and securely, while reducing the manufacturing cost of the ink cartridge.

In accordance with one preferable embodiment of the present invention, the third ink cartridge includes: a plurality of ink reservoirs, in which a plurality of inks are kept respectively; and a plurality of ink quantity information memory divisions and a plurality of write complete information storage areas provided for each of the plurality of ink reservoirs.

In accordance with one preferable application of the third ink cartridge, the storage unit has two ink quantity information memory divisions, and each write complete information storage area is located following an end-of-writing position in each of the ink quantity information memory divisions.

In accordance with another preferable application of the third ink cartridge, a predetermined flag is written into each of the write complete information storage areas when the writing operation has been completed in the corresponding ink quantity information memory division. The predetermined flag may have different initial values or an identical initial value with regard to the respective write complete information storage areas.

In the third ink cartridge having any one of the above applications, it is preferable that the ink quantity information memory divisions are included in a specific area of the storage unit that is written first by the printer. In the third ink cartridge having any one of the above applications, it is also preferable that the storage unit is sequentially accessed in synchronism with a clock signal. The ink quantity-relating information may regard a remaining quantity of ink in the ink cartridge or a cumulative amount of ink consumption with regard to the ink cartridge.

The present invention is also directed to a first method of writing plural pieces of specific information into an ink cartridge, the ink cartridge being detachably attached to a printer and having a storage element. The first method includes the steps of: (a) providing the plural pieces of specific information that are to be written into the storage element by the printer, the plural pieces of specific information including information relating to a quantity of ink kept in the ink cartridge; and (b) writing the ink quantity-relating information into the storage element, preferentially over the other pieces of specific information.

The first method of the present invention preferentially writes the ink quantity-relating information into the storage element. This arrangement enables the information relating to the ink cartridge, such as the remaining quantity of ink, to be stored quickly and securely, while reducing the manufacturing cost of the ink cartridge.

In accordance with one preferable application of the first method, the writing operation of the ink quantity-relating information into the storage element in the step (b) is carried out at a time of replacement of the ink cartridge and/or at a power-off time of the printer.

In this configuration, the writing operation into the storage element is carried out at the time of replacement of the ink cartridge or at the time of highly probable replacement of the ink cartridge. This enables the ink quantity-relating information to be securely stored into the storage element of the ink cartridge.

In accordance with another preferable application of the first method, the first method further comprises the step of: (c) arranging the plural pieces of specific information in a certain sequence that allows the ink quantity-relating information to be located in a specific storage capacity from a head, which is determined according to the specific number of different inks. The step (b) writes the plural pieces of specific information into the storage element in the arranged sequence.

In this configuration, the plural pieces of specific information are arranged in such a manner that the ink quantity-relating information is located in the specific storage capacity from the head, which is defined according to the specific number of different inks kept in the ink cartridge. The writing operation into the storage element is carried out in this sequence. This enables the ink quantity-relating information to be stored quickly and securely into the storage element.

In one preferable embodiment of the above arrangement, the first method further comprises the step of: (c-1) arranging the plural pieces of specific information in a certain sequence that allows the pieces of information relating to the quantities of the at least three different color inks to be located in a storage capacity of at least three bytes from a head. The step (b) writes the plural pieces of information into the storage element in the arranged sequence.

In another preferable embodiment of the above arrangement, the first method further comprises the step of: (c-2) arranging the plural pieces of specific information in a certain sequence that allows the pieces of information relating to the quantities of the at least five different color inks to be located in a storage capacity of at least five bytes from a head. The step (b) writes the plural pieces of information into the storage element in the arranged sequence.

In this application, it is preferable that the at least five different color inks include three deep color inks and two light color inks, which correspond to two deep colors among the three deep color inks. The plural pieces of specific information are arranged in the step (c-2) in such a manner that the pieces of information regarding the three deep color inks are located prior to the pieces of information regarding the two light color inks. By way of example, the three deep color inks are cyan, magenta, and yellow, and the two light color inks are light cyan and light magenta.

In the first method of the present invention having any one of the above applications, it is preferable that the plural pieces of specific information are written into the storage element by sequential accesses. The ink quantity-relating information may regard a cumulative amount of ink consumption with regard to the ink cartridge or a remaining quantity of ink in the ink cartridge.

The present invention is also directed to a second method of writing specific information into an ink cartridge, the ink cartridge being detachably attached to a printer and having a storage element. The second method includes the steps of: (a) providing the specific information that is to be written into the storage element by the printer, the specific information including information relating to a quantity of ink kept in the ink cartridge; (b) writing the ink quantity-relating information into a plurality of ink quantity information memory divisions, which are included in the storage element; and (c) writing write complete information into a write complete information storage area, which is provided corresponding to each of the ink quantity information memory divisions in the storage element, when the writing operation of the ink quantity-relating information into each of the ink quantity information memory divisions has been completed.

The arrangement of the second method enables the information relating to the ink cartridge, such as the remaining quantity of ink, to be stored quickly and securely, while reducing the manufacturing cost of the ink cartridge.

In accordance with one preferable application of the present invention, the second method further includes the step of: (d) determining whether or not the writing operation of the ink quantity-relating information into each of the ink quantity information memory divisions in the step (b) has been carried out properly, based on values of the ink quantity-relating information written in the ink quantity information memory divisions and values of the write complete information written in the write complete information storage areas.

The present invention is further directed to a third method of writing specific information into an ink cartridge, the ink cartridge being detachably attached to a printer and having a storage element. The third method includes the steps of: (a) providing the specific information that is to be written into the storage element by the printer, the specific information including information relating to a quantity of ink kept in the ink cartridge; (b) writing first ink quantity-relating information into a first ink quantity information memory division, which is included in the storage element; (c) writing first write complete information into a first write complete information storage area, which is provided corresponding to the first ink quantity information memory division in the storage element, when the writing operation of the first ink quantity-relating information into the first ink quantity information memory division has been completed; (d) writing second ink quantity-relating information into a second ink quantity information memory division, which is included in the storage element, after the writing operation of the first write complete information into the first write complete information storage area has been completed; and (e) writing second write complete information into a second write complete information storage area, which is provided corresponding to the second ink quantity information memory division in the storage element, when the writing operation of the second ink quantity-relating information into the second ink quantity information memory division has been completed.

The arrangement of the third method enables the information relating to the ink cartridge, such as the remaining quantity of ink, to be stored quickly and securely, while reducing the manufacturing cost of the ink cartridge.

In accordance with one preferable application of the present invention, the third method further includes the step of: (f) determining whether or not the writing operations of the first ink quantity-relating information and the second ink quantity-relating information respectively into the first and second ink quantity information memory divisions in the steps (b) and (d) have been carried out properly, based on values of the first ink quantity-relating information and the second ink quantity-relating information written in the first and second ink quantity information memory divisions and values of the first write complete information and second write complete information written in the first and second write complete information storage areas.

In one embodiment of this configuration, the step (f) determines that the writing operations of the first ink quantity-relating information and the second ink quantity-relating information respectively into the first and second ink quantity information memory divisions have been carried out properly, in the case where the first ink quantity-relating information stored in the first ink quantity information memory division coincides with the second ink quantity-relating information stored in the second ink quantity information memory division.

In another embodiment of this configuration, the first write complete information and the second write complete information have a certain combination of preset initial values. The third method further includes the step of: (g) identifying a combination of a current value of the first write complete information with a current value of the second write complete information, in the case where the first ink quantity-relating information stored in the first ink quantity information memory division does not coincide with the second ink quantity-relating information stored in the second ink quantity information memory division. The step (f) determines that the writing operation of the first ink quantity-relating information into the first ink quantity information memory division has been carried out properly, in the case where the combination of the current values of the first write complete information and the second write complete information is different from the certain combination of the preset initial values.

In still another embodiment of this configuration, the first write complete information and the second write complete information have a certain combination of preset initial values. The third method further includes the step of: (g) identifying a combination of a current value of the first write complete information with a current value of the second write complete information, in the case where the first ink quantity-relating information stored in the first ink quantity information memory division does not coincide with the second ink quantity-relating information stored in the second ink quantity information memory division. The step (f) determines that the writing operation of the first ink quantity-relating information into the first ink quantity information memory division has not been carried out properly, in the case where the combination of the current values of the first write complete information and the second write complete information is identical with the certain combination of the preset initial values.

The third method of the present invention may further include the step of: (h) writing the first ink quantity-relating information into the second ink quantity information memory division. In the third method having any one of the above applications, the first write complete information and the second write complete information may be flags.

The present invention is further directed to a first printer, to which either the first ink cartridge or the second ink cartridge having any one of the above applications is detachably attached. The first printer includes: a storage device that stores plural pieces of specific information, the plural pieces of specific information including information relating to a quantity of ink kept in the ink cartridge; and a writing unit that writes the ink quantity-relating information into the ink quantity information storage area of the ink cartridge, preferentially over the other pieces of specific information.

In the first printer of the present invention, the ink quantity-relating information is written into the ink quantity information storage area, which is included in the ink cartridge. This arrangement enables the information relating to the ink cartridge, such as the remaining quantity of ink, to be stored quickly and securely, while reducing the manufacturing cost of the ink cartridge.

The present invention is directed to an ink jet printer including an ink cartridge, which is detachably attached to a printer main body and in which ink is kept, and the printer main body that causes the ink kept in the ink cartridge to be ejected from a print head to a printing medium, so as to implement printing on the printing medium. The ink cartridge includes a storage device of sequential access type. The storage device has a storage unit and an address counter that carries out either one of a count-up operation and a count-down operation in response to a clock signal in the course of data transmission between the storage unit and the printer main body. The storage unit included in the storage device has a first storage area, in which read only data are stored and which is only read by the printer main body, and a second storage area, in which rewritable data are stored and which is accessed prior to the first storage area and transmits data to and from the printer main body. The ink jet printer has a data input-output unit that carries out reading and writing operations in response to a clock signal.

In the ink jet printer of the present invention, an inexpensive storage device that enables only sequential accesses is applied for the storage element mounted on the ink cartridge. This effectively reduces the manufacturing cost of the expendable ink cartridge. In the arrangement of the ink jet printer, the second storage area, in which rewritable data are stored, is accessed prior to the first storage area, in which read only data are stored, in the storage unit. This configuration enables the writing operation of the rewritable data into the second storage area to be completed within a short time period. Even in the case of writing the rewritable data into the second storage area after the off-operation of the power switch, this configuration enables the writing operation of the rewritable data to be completed before the power plug is pulled out of the socket. The configuration of the ink jet printer, which applies the inexpensive storage device enabling only the sequential access to decrease the cost of the ink cartridge, thus advantageously reduces the possible failure in the process of rewriting the data.

In accordance with one preferable application of the ink jet printer, the rewritable data stored in the second storage area includes data relating to a remaining quantity of ink in the ink cartridge, which is calculated by the printer main body from an amount of ink consumption used by the print head.

In one embodiment of this configuration, the ink cartridge includes a plurality of ink chambers, in which a plurality of different color inks are kept respectively. In this structure, the rewritable data stored in the second storage area may include data relating to remaining quantities of the different color inks kept in the respective ink chambers, which are calculated by the printer main body. This arrangement enables the remaining quantity of each color ink to be monitored separately, and thus informs the user without delay that the specific color ink is running out.

It is preferable that the second storage area includes at least two memory divisions, into which latest data relating to the remaining quantity of ink are sequentially written. In this configuration, the latest data on the remaining quantity of ink is written alternately into the two or more memory divisions. Some trouble may interfere with the normal writing operation of the latest data into one memory division, for example, by accidentally pulling the power plug out of the socket in the course of the wiring operation in the current cycle. The previous data written in the previous cycle immediately before the current cycle, however, remain in another memory division. Even in the case of the abnormal writing operation into one memory division, this arrangement enables the remaining quantity of ink to be monitored continuously based on the previous data written in another memory division.

It is also preferable that the data relating to the remaining quantity of ink are written after a power-off operation of the printer main body.

The data relating to the remaining quantity of ink are updated on completion of a series of printing processes. It is accordingly desirable to perform the writing operation at the time of power-off operation. In some cases, the writing operation may be interrupted, for example, by pulling the power plug out of the socket. This destroys the data and makes the further monitor of the remaining quantity of ink impossible. The technique of the ink jet printer, however, optimizes the layout of the storage unit and thereby enables the writing operation of data to be completed before the power plug is pulled out of the socket. This accordingly reduces the possibility of the abnormal writing operation.

The rewritable data stored in the second storage area may include at least one selected among data regarding a time period elapsing after unsealing the ink cartridge and data regarding a frequency of attachment and detachment of the ink cartridge to and from the printer main body, both the elapsing time period and the frequency of attachment and detachment being measured by the printer main body. The read only data stored in the first storage area may include at least one selected among data regarding a year, month, and date of manufacture of the ink cartridge, data regarding a type of ink stored in the ink cartridge, and data regarding a capacity of the ink cartridge.

In the ink jet printer of the present invention, it is preferable that an EEPROM is applied for the storage device.

The present invention is directed to a second printer, to which the third ink cartridge having any one of the above applications is detachably attached. The second printer includes: a storage device that stores specific information that is to be written into the ink cartridge, the specific information including information relating to a quantity of ink kept in the ink cartridge; an ink quantity information writing unit that writes the ink quantity-relating information into a plurality of ink quantity information memory divisions, which are included in the storage device; and a write complete information writing unit that writes write complete information into a write complete information storage area, which is provided corresponding to each of the ink quantity information memory divisions in the storage device, when the writing operation of the ink quantity-relating information into each of the ink quantity information memory divisions has been completed.

The arrangement of the second printer enables the information relating to the ink cartridge, such as the remaining quantity of ink, to be stored quickly and securely, while reducing the manufacturing cost of the ink cartridge.

In accordance with one preferable application of the present invention, the second printer further includes a determination unit that determines whether the writing operation of the ink quantity-relating information into each of the ink quantity information memory divisions has been carried out properly, based on values of the ink quantity-relating information written in the ink quantity information memory divisions and values of the write complete information written in the write complete information storage areas.

The present invention is also directed to a third printer, to which the third ink cartridge having any one of the above applications is detachably attached. The third printer includes: a storage device that stores specific information that is to be written into the ink cartridge, the specific information including information relating to a quantity of ink kept in the ink cartridge; a first ink quantity information writing unit that writes first ink quantity-relating information into a first ink quantity information memory division, which is included in the storage device; a first write complete information writing unit that writes first write complete information into a first write complete information storage area, which is provided corresponding to the first ink quantity information memory division in the storage device, when the writing operation of the first ink quantity-relating information into the first ink quantity information memory division has been completed; a second ink quantity information writing unit that writes second ink quantity-relating information into a second ink quantity information memory division, which is included in the storage device, after the writing operation of the first write complete information into the first write complete information storage area has been completed; and a second write-complete information writing unit that writes second write complete information into a second write complete information storage area, which is provided corresponding to the second ink quantity information memory division in the storage device, when the writing operation of the second ink quantity-relating information into the second ink quantity information memory division has been completed.

The arrangement of the third printer enables the information relating to the ink cartridge, such as the remaining quantity of ink, to be stored quickly and securely, while reducing the manufacturing cost of the ink cartridge.

In accordance with one preferable application of the present invention, the third printer further includes a determination unit that determines whether or not the writing operations of the first ink quantity-relating information and the second ink quantity-relating information respectively into the first and second ink quantity information memory divisions have been carried out properly, based on values of the first ink quantity-relating information and the second ink quantity-relating information written in the first and second ink quantity information memory divisions and values of the first write complete information and second write complete information written in the first and second write complete information storage areas.

In one embodiment of the above application, the determination unit determines that the writing operations of the first ink quantity-relating information and the second ink quantity-relating information respectively into the first and second ink quantity information memory divisions have been carried out properly, in the case where the first ink quantity-relating information stored in the first ink quantity information memory division coincides with the second ink quantity-relating information stored in the second ink quantity information memory division.

In another embodiment of the above application, the first write complete information and the second write complete information have a certain combination of preset initial values. The third printer further includes an identification unit that identifies a combination of a current value of the first write complete information with a current value of the second write complete information, in the case where the first ink quantity-relating information stored in the first ink quantity information memory division does not coincide with the second ink quantity-relating information stored in the second ink quantity information memory division. In this structure, the determination unit determines that the writing operation of the first ink quantity-relating information into the first ink quantity information memory division has been carried out properly, in the case where the combination of the current values of the first write complete information and the second write complete information is different from the certain combination of the preset initial values.

In still another embodiment of the above application, the first write complete information and the second write complete information have a certain combination of preset initial values. The third printer further includes an identification unit that identifies a combination of a current value of the first write complete information with a current value of the second write complete information, in the case where the first ink quantity-relating information stored in the first ink quantity information memory division does not coincide with the second ink quantity-relating information stored in the second ink quantity information memory division. In this structure, the determination unit determines that the writing operation of the first ink quantity-relating information into the first ink quantity information memory division has not been carried out properly, in the case where the combination of the current values of the first write complete information and the second write complete information is identical with the certain combination of the preset initial values.

In the third printer having any one of the above applications, it is preferable that the first ink quantity information writing unit and the second ink quantity information writing unit preferentially carry out the writing operations into the first ink quantity information memory division and the second ink quantity information memory division in the storage device, respectively. The first write complete information and the second write complete information may be flags.

The present invention is also directed to a first storage device mounted on an ink cartridge, which is detachably attached to a printer. The storage device includes: an address counter that outputs a count in response to a clock signal output from the printer; and a storage element that is sequentially accessed based on the count output from the address counter and has a storage area, in which plural pieces of specific information are stored in a readable, writable, and non-volatile manner.

An inexpensive storage device that enables only sequential accesses is applied for the first storage device of the present invention mounted on the ink cartridge. This effectively reduces the manufacturing cost of the expendable ink cartridge. For example, an EEPROM may be applied for the first storage device.

In accordance with one preferable application of the first storage device, the storage area has a first storage area, in which read only information is stored, and a second storage area, which is located prior to the first storage area and in which information relating to a quantity of ink kept in said ink cartridge is stored.

In accordance with another preferable application of the first storage device, the storage area has an ink quantity information storage area, in which information relating to a quantity of ink kept in the ink cartridge is stored and which is included in a specific area written first by the printer.

These arrangements enable the ink quantity-relating information, for example, the remaining quantity of ink, to be stored quickly and securely.

In the first storage device having any one of the above applications, it is preferable that the storage element stores format information relating to items of information stored therein. The format information may be registered in a head area of the storage element. This arrangement ensures an access to the required information, based on the format information, thereby shortening the access time irrespective of the storage capacity. The format information also enables the optimal configuration of the various pieces of information.

The present invention is also directed to a second storage device mounted on an ink cartridge, which is detachably attached to a printer. The second storage device includes a storage element having a plurality of ink quantity information memory divisions and a plurality of write complete information storage areas, and storing specific information in a readable, writable, and non-volatile manner. The specific information includes information relating to a quantity of ink kept in the ink cartridge. The plurality of ink quantity information memory divisions stores the ink quantity-elating information. The plurality of write complete information storage areas respectively correspond to the plurality of ink quantity information memory divisions and in each of which write complete information is registered when a writing operation into the corresponding ink quantity information memory division is completed.

The arrangement of the second storage device enables the information relating to the ink cartridge, such as the remaining quantity of ink, to be stored quickly and securely, while reducing the manufacturing cost of the ink cartridge.

In accordance with one preferable embodiment of the second storage device, the ink cartridge has a plurality of ink reservoirs, in which a plurality of inks are kept respectively, and the storage element has a plurality of ink quantity information memory divisions and a plurality of write complete information storage areas provided for each of the plurality of ink reservoirs.

In accordance with one preferable application of the second storage device, the storage element has two ink quantity information memory divisions, and each write complete information storage area is located after an end-of-writing position in each of the ink quantity information memory divisions.

In the above configuration, it is preferable that a predetermined flag is written into each of the write complete information storage areas when the writing operation has been completed in the corresponding ink quantity information memory division. The predetermined flag may have different initial values or an identical initial value with regard to the respective write complete information storage areas.

In the second storage device having any one of the above applications, the ink quantity information memory divisions are included in a specific area of the storage element that is written first by the printer. It is preferable that the second storage device further includes an address counter that outputs a count in response to a clock signal output from the printer. In this structure, the storage element is sequentially accessed, based on the count output from the address counter. The ink quantity-relating information may regard a remaining quantity of ink in the ink cartridge or a cumulative amount of ink consumption with regard to the ink cartridge.

The present invention is further directed to a computer-readable medium, in which a program is recorded, the program being used to write specific information into an ink cartridge having a storage element, the specific information including information relating to a quantity of ink kept in the ink cartridge. The program includes: a program code that causes a computer to write the ink quantity-relating information into a plurality of ink quantity information memory divisions, which are included in the storage element; and a program code that causes the computer to write write-complete information into a write complete information storage area, which is provided corresponding to each of the ink quantity information memory divisions in the storage element, when the writing operation of the ink quantity-relating information into each of the ink quantity information memory divisions has been completed.

The arrangement of the computer-readable medium enables the information relating to the ink cartridge, such as the remaining quantity of ink, to be stored quickly and securely, while reducing the manufacturing cost of the ink cartridge.

In accordance with one preferable application of the computer-readable medium, the program further includes a program code that causes the computer to determine whether or not the writing operation of the ink quantity-relating information into each of the ink quantity information memory divisions has been carried out properly, based on values of the ink quantity-relating information written in the ink quantity information memory divisions and values of the write complete information written in the write complete information storage areas.

The present invention further provides fourth ink cartridge that has an ink reservoir in which an ink used for printing is kept. The fourth ink cartridge comprises an address counter that outputs a count in response to an input clock signal and a storage element that is sequentially accessed based on the count output from said address counter. The storage element stores plural pieces of specific information in a readable, writable, and non-volatile manner. A certain piece of information, which is updated in relation to the ink kept in said ink reservoir, is stored in a specific area of said storage element that is read first using a default of the count.

The fourth ink cartridge allows high-speed access since the certain piece of information that is updated in relation to the ink in the ink reservoir is stored in the specific area of the storage element that is read first using the default of the count.

The certain piece of updated information may regard either a remaining quantity of ink or an amount of ink consumption. The amount of ink consumption may have an initial value in a range of zero to a predetermined value. The predetermined value may include 90.

If zero is stored as the initial value of the ink consumption, zero means ink full and the max value means ink empty. When the ink cartridge has a half volume ink reservoir that has a half volume of a regular volume ink reservoir, approximately a half value of the max value is stored as the initial value. Therefore, a design for the volume of the ink cartridge has flexibility. The value zero or the max value may be represented 00-FF in binary format or 0-100 in decimal format with one byte of the storage element. Further, to increase accuracy the value may be represented with at least two bytes. Moreover, as long as a format corresponds to zero through the max value any formats may be used. The predetermined value may include more than zero percent through about 90 percent in corresponding to zero through the max value. Since a cleaning operation uses certain amount of ink, an ink cartridge change directions may be issued if the initial value has a value corresponding to 90 percent. Therefore, the max value that corresponds to about 90 percent is employed. When no such limitation is applied, the max value may have the value corresponding to more than 90 percent.

These and other objects, features, aspects, and advantages of the present invention will become more apparent from the following detailed description of the preferred embodiments with the accompanying drawings.

BRIEF DESCRIPTION OF THE DRAWINGS

FIG. 7 shows a data array in the storage element incorporated in the black ink cartridge attached to the ink jet printer shown in FIG. 1;

FIG. 8 shows a data array in the storage element incorporated in the color ink cartridge attached to the ink jet printer shown in FIG. 1;

FIG. 9 shows a data array in an EEPROM incorporated in the printer main body of the ink jet printer shown in FIG. 1;

FIG. 19 shows a data array of a storage element incorporated in a color ink cartridge in a third embodiment according to the present invention;

FIG. 22 shows addresses of a control IC in a printer main body and an internal data structure (memory map) of a memory cell with regard to items of information on a black ink cartridge in a fourth embodiment according to the present invention;

FIG. 23 shows addresses of the control IC in the printer main body and an internal data structure (memory map) of a memory cell with regard to items of information on a color ink cartridge in the fourth embodiment;

DESCRIPTION OF THE PREFERRED EMBODIMENTS

First Embodiment (General Structure of Ink Jet-type Printing Apparatus)

Figure 1:
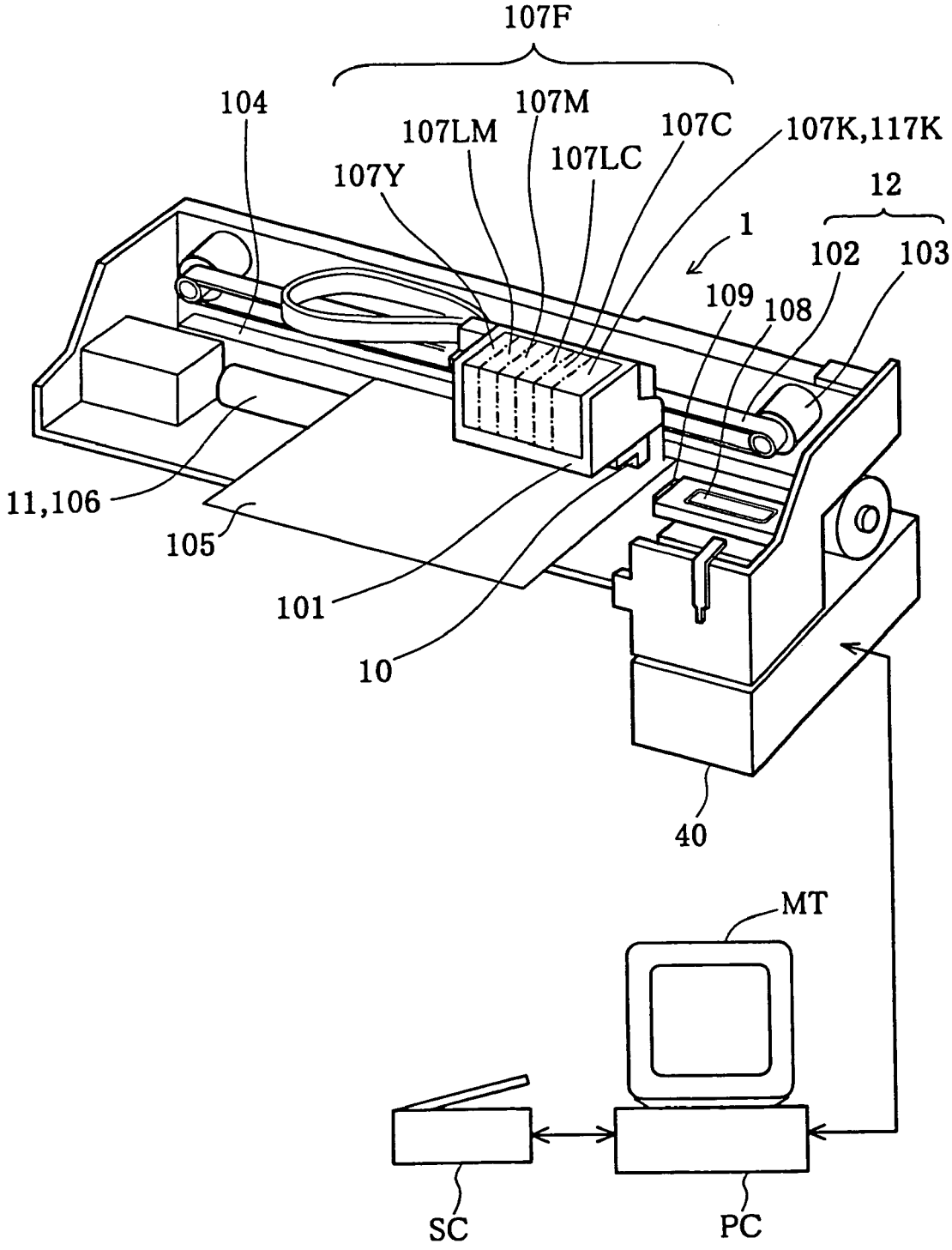
FIG. 1 is a perspective view illustrating the structure of a main part of an ink jet printer in one embodiment according to the present invention.

FIG. 1 is a perspective view illustrating the structure of a main part of an ink jet printer 1 in one embodiment according to the present invention. The ink jet printer 1 of the embodiment is used in connection with a computer PC, to which a scanner SC is also connected. The computer PC reads and executes an operating system and predetermined programs to function, in combination with the ink jet printer 1, as an ink jet-type printing apparatus. The computer PC executes an application program on a specific operating system, carries out processing of an input image, for example, read from the scanner SC, and displays a processed image on a CRT display MT. When the user gives a printing instruction after the required image processing, for example, retouching the image on the CRT display MT, is concluded, a printer driver incorporated in the operating system is activated to transfer processed image data to the ink jet printer 1.

The printer driver converts original color image data, which are input from the scanner SC and subjected to the required image processing, to color image data printable by the ink jet printer 1 in response to the printing instruction, and outputs the converted color image data to the ink jet printer 1. The original color image data consists of three color components, that is, red (R), green (G), and blue (B). The converted color image data printable by and output to the ink jet printer 1 consists of six color components, that is, black (K), cyan (C), light cyan (LC), magenta (M), light magenta (LA), and yellow (Y). The printable color image data are further subjected to binary processing, which specifies the on-off state of ink dots. These image processing and data conversion processes are known in the art and are thus not specifically described here. These processes may be carried out in the ink jet printer 1, in place of the printer driver included in the computer PC.

In the ink jet printer 1, a carriage 101 is connected to a carriage motor 103 in a carriage mechanism 12 via a timing belt 102, and is guided by a guide member 104 to move forward and backward along a width of a sheet of printing paper (printing medium) 105. The ink jet printer 1 also has a sheet feed mechanism 11 with a sheet feed roller 106. An ink jet-type print head 10 is attached to a specific face of the carriage 101 that faces the printing paper 105, that is, a lower face in this embodiment. The print head 10 receives supplies of inks fed from ink cartridges 107K and 107F mounted on the carriage 101, and ejects ink droplets onto the printing paper 105 with a movement of the carriage 101, so as to create dots and print an image or letters on the printing paper 105.

The ink cartridge 107K has an ink chamber 117K, in which black ink (K) is kept. The ink cartridge 107F has a plurality of ink chambers 107C, 107LC, 107M, 107LM, and 107Y, which are formed independently of one another. Cyan ink (C), light cyan ink (LC), magenta ink (M), light magenta ink (LM), and yellow ink (Y) are respectively kept in the ink chambers 107C, 107LC, 107M, 107LM, and 107Y. The print head 10 receives the respective supplies of color inks fed from these ink chambers 107C, 107LC, 107M, 107LM, and 107Y. The print head 10 ejects these color inks in the form of ink droplets of the respective colors, so as to implement color printing.

A capping unit 108 is disposed in a non-printable area (non-record area) of the ink jet printer 1 to close nozzle opening of the print head 10 while the printing operation is not carried out. The capping unit 108 effectively prevents an increase in viscosity of ink and formation of an ink film due to vaporization of a solvent component from the ink while the printing operation is not performed. The capping unit 108 also collects ink droplets from the print head 10 occurring by a flushing process during the execution of the printing operation. A wiping unit 109 is disposed near the capping unit 108 to wipe the surface of the print head 10, for example, with a blade, so as to wipe out the ink residue or paper dust adhering to the surface of the print head 10.

Figure 2:
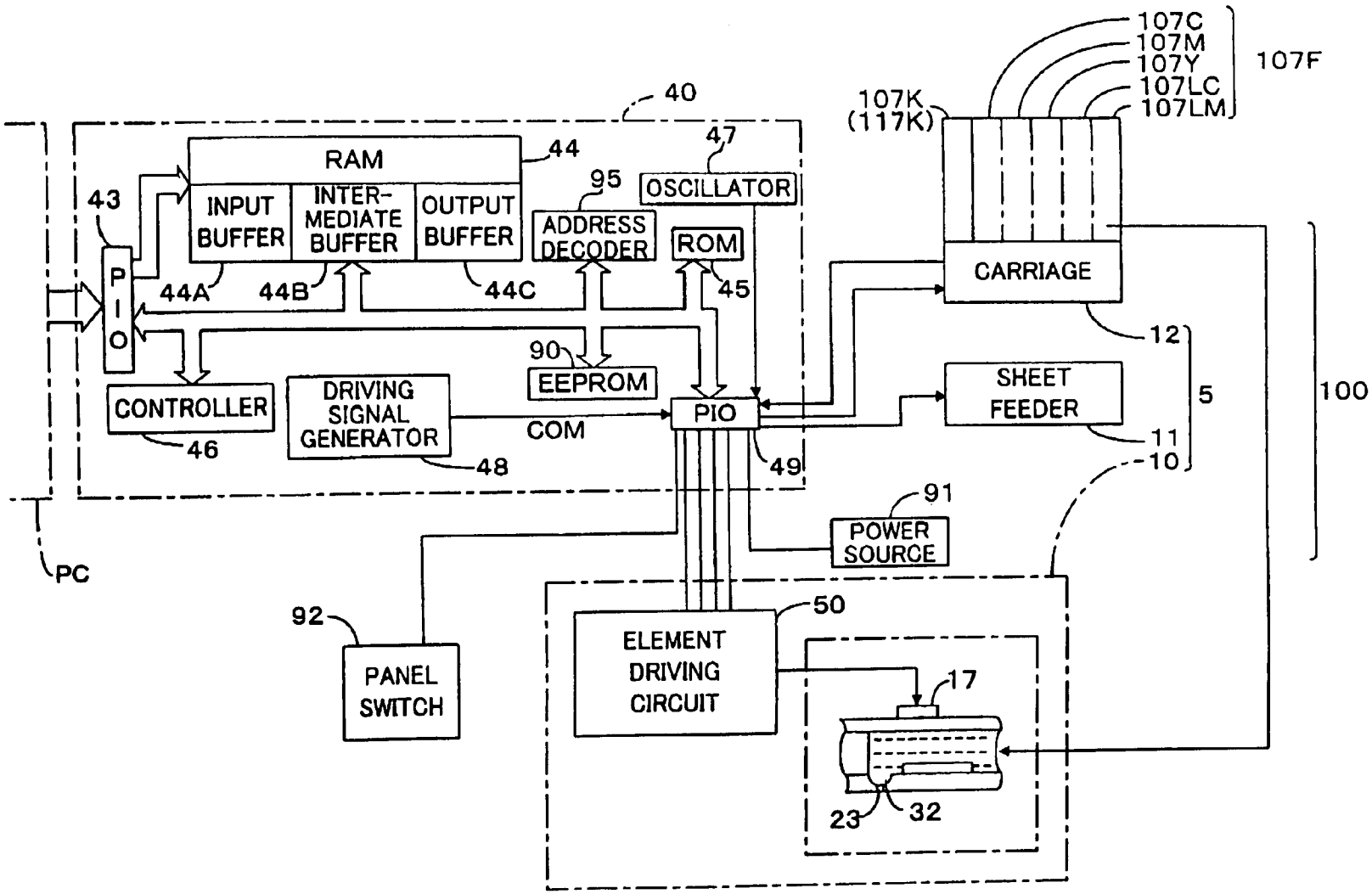
FIG. 2 is a functional block diagram of the ink jet printer shown in FIG. 1.

FIG. 2 is a functional block diagram of the ink jet printer 1 of the embodiment. The ink jet printer 1 includes a printer main body 100 (main body of the printing apparatus) including a print controller 40 and a print engine 5. The print controller 40 has an interface 43 that receives print data including multi-tone information transmitted from a computer PC, a RAM 44 in which a variety of data, for example, the print data including the multi-tone information, are stored, and a ROM 45 in which routines for various data processing are stored. The print controller 40 further has a controller 46 including a CPU, an oscillator 47, a driving signal generator 48 that generates a driving signal COM given to the print head 10, and a parallel input-output interface 49 that transmits the print data developed to dot pattern data and the driving signal COM to the print engine 5.

Control lines of a panel switch 92 and a power source 91 are also connected to the print controller 40 via the parallel input-output interface 49. When a power OFF is input from the panel switch 92, the print controller 40 outputs a power down instruction (NMI) to the power source 91, which then falls into a stand-by state. The power source 91 in the stand-by state supplies a stand-by electric power to the print controller 40 via a power line (not shown). Namely the standard power OFF process carried out via the panel switch 92 does not completely cut off the supply of electric power to the print controller 40.

The print controller 40 monitors whether a preset electric power is supplied from the power source 91. The print controller 40 also outputs the power down instruction (NMI) when a power plug is pulled out of a socket. The power source 91 has an auxiliary power unit (for example, a capacitor), in order to ensure a supply of electric power for a predetermined time period (for example, 0.3 sec) after the power plug is pulled out of the socket.

The print controller 40 further includes an EEPROM 90 that stores information regarding the black ink cartridge 107K and the color ink cartridge 107F mounted on the carriage 101 (see FIG. 1). Specific pieces of information including the pieces of information regarding quantities of inks in the black ink cartridge 107K and the color ink cartridge 107F (remaining quantities of inks or amounts of ink consumption) are stored in the EEPROM 90. The details of such information will be discussed later. The print controller 40 also has an address decoder 95 that converts an address in a memory cell 81 (described later) of a storage element 80 (described later), to which the controller 46 requires an access (read/write), into a number of clocks.

In the ink jet printer 1, the quantity of ink ejection is calculated by multiplying the weight of ink droplets ejected from a plurality of nozzle openings 23 by the frequency of ejection of the ink droplets. The current remaining quantity of ink is determined by subtracting an amount of ink consumption from the previous remaining quantity of ink before the start of the current printing operation. The amount of ink consumption is the sum of the calculated quantity of ink ejection and a quantity of ink suction. The ink suction is carried out, for example, when some abnormality occurs due to bubbles invading the print head 10. The procedure of ink suction causes the capping unit 108 to be pressed against the print head 10 and thereby close the nozzle openings 23, and sucks ink by means of a pump mechanism (not shown) linked with the capping unit 108 for the purpose of restoration. The controller 46 performs the calculation of the remaining quantity of ink from the data stored in the EEPROM 90 according to a program stored in advance in the ROM 45.

The ink jet printer 1 of the embodiment receives the binarized data as described previously. The array of the binarized data is, however, not coincident with the nozzle array on the print head 10. The control unit 46 accordingly divides the RAM 44 into the three portions, that is, an input buffer 44A, an intermediate buffer 44B, and an output buffer 44C, in order to perform the rearrangement of the dot data array. The ink jet printer 1 may alternatively carry out the required processing for the color conversion and the binarization. In this case, the ink jet printer 1 registers the print data, which include the multi-tone information and are transmitted from the computer PC, into the input buffer 44A via the interface 43. The print data kept in the input buffer 44A are subjected to command analysis and then transmitted to the intermediate buffer 44B. The controller 46 converts the input print data into intermediate codes by supplying information regarding the printing positions of the respective letters or characters, the type of modification, the size of the letters or characters, and the font address. The intermediate codes are kept in the intermediate buffer 44B. The controller 46 then analyzes the intermediate codes kept in the intermediate buffer 44B and decodes the intermediate codes into binary dot pattern data. The binary dot pattern data are expanded and stored in the output buffer 44C.

In any case, when dot pattern data corresponding to one scan of the print head 10 are obtained, the dot pattern data are serially transferred from the output buffer 44C to the print head 10 via the parallel input-output interface 49. After the dot pattern data corresponding to one scan of the print head 10 are output from the output buffer 44C, the process erases the contents of the intermediate buffer 44B to wait for conversion of a next set of intermediate codes.

The print engine 5 has the print head 10, the sheet feed mechanism 11, and the carriage mechanism 12. The sheet feed mechanism 11 successively feeds the printing medium, such as printing paper, to implement sub-scans, whereas the carriage mechanism 12 carries out main scans of the print head 10.

The print head 10 causes the respective nozzle openings 23 to eject ink droplets against the printing medium at a predetermined timing, so as to create an image corresponding to the generated dot pattern data on the printing medium. The driving signal COM generated in the driving signal generator circuit 48 is output to an element driving circuit 50 in the print head 10 via the parallel input-output interface 49. The print head 10 has a plurality of pressure chambers 32 and a plurality of piezoelectric vibrators 17 (pressure-generating elements) respectively connecting with the nozzle openings 23. The number of both the pressure chambers 32 and the piezoelectric vibrators 17 is thus coincident with the number of the nozzle openings 23. When the driving signal COM is sent from the element driving circuit 50 to a certain piezoelectric vibrator 17, the corresponding pressure chamber 32 is contracted to cause the corresponding nozzle opening 23 to eject an ink droplet.

Figure 3:
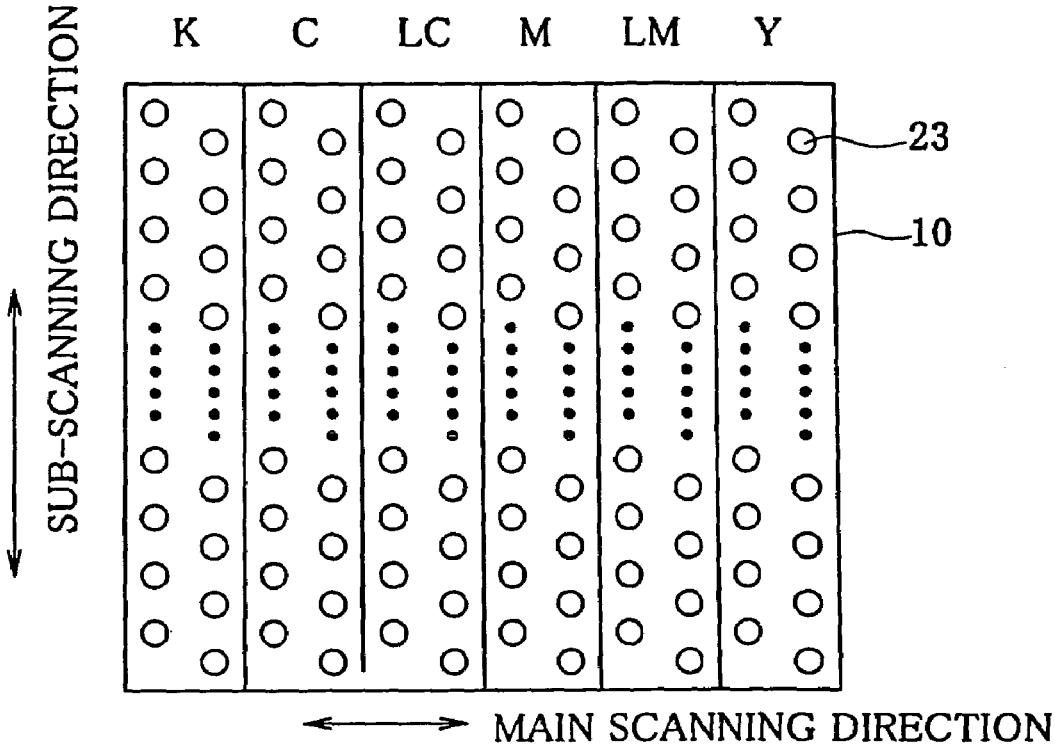
FIG. 3 shows a layout of nozzle openings formed in the print head shown in FIG. 1.

FIG. 3 shows a layout of the nozzle openings 23 formed in the print head 10. The nozzle openings 23 on the print head 10 are divided into six nozzle arrays of black (K), cyan (C), light cyan (LC), magenta (M), light magenta (LM), and yellow (Y).

(Structure of Ink Cartridge and Cartridge Attachment Unit)

The black ink cartridge 107K and the color ink cartridge 107F, which are attached to the ink jet printer 1 having the above configuration, have a common basic structure. The following description regards the structure of an ink cartridge, the black ink cartridge 107K as an example, and the structure of a cartridge attachment unit of the printer main body 100, which receives and holds the ink cartridge, with reference to FIGS. 4A, 4B, and 5.

Figure 4A:
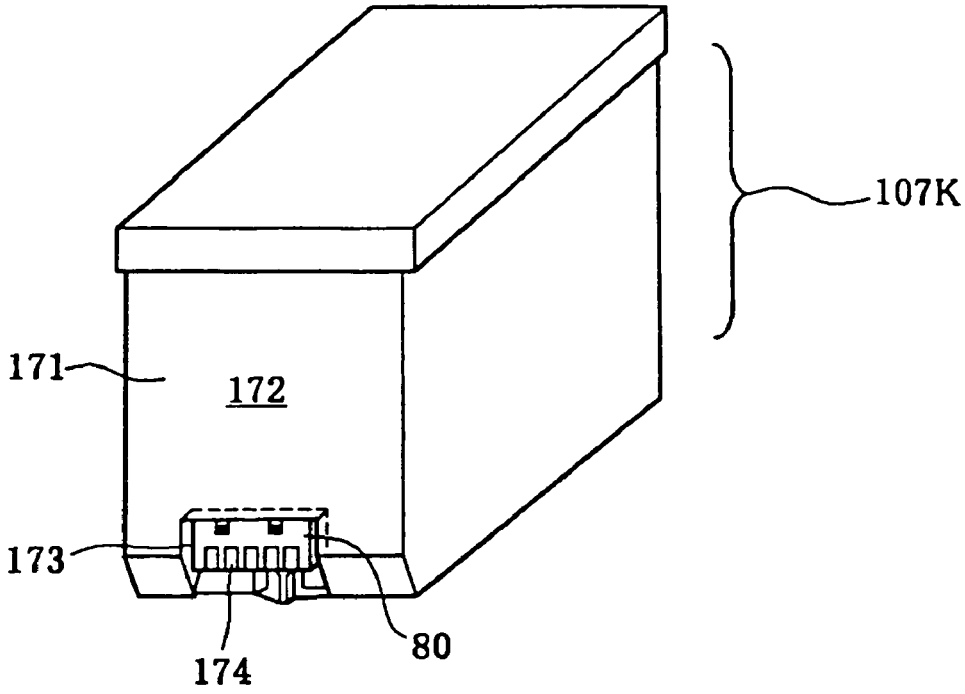
FIGS. 4A and 4B are perspective views respectively illustrating the structures of an ink cartridge and a cartridge attachment unit.
Figure 4B:
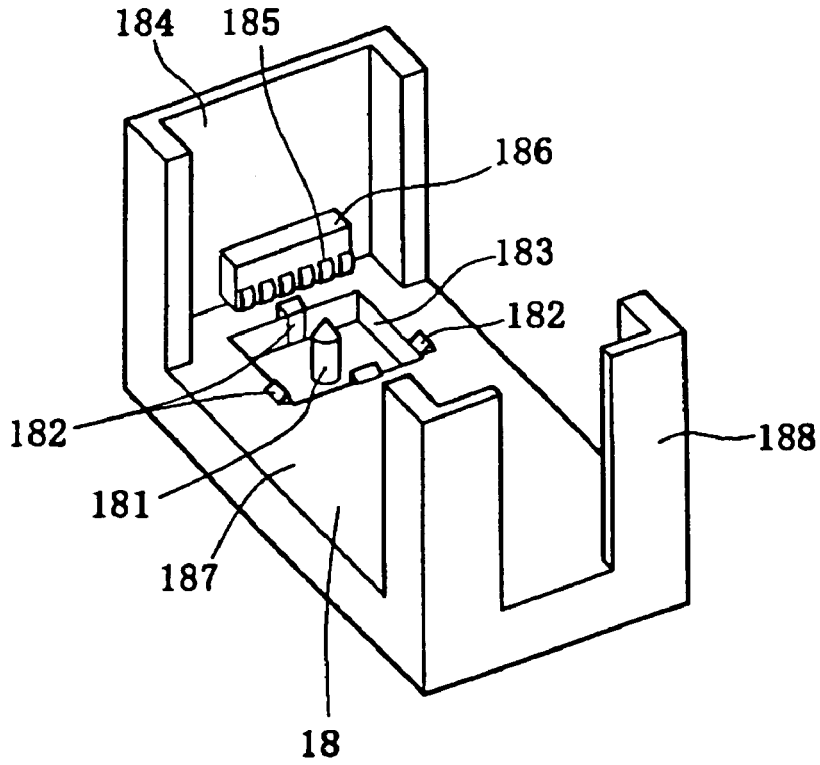
Figure 5:
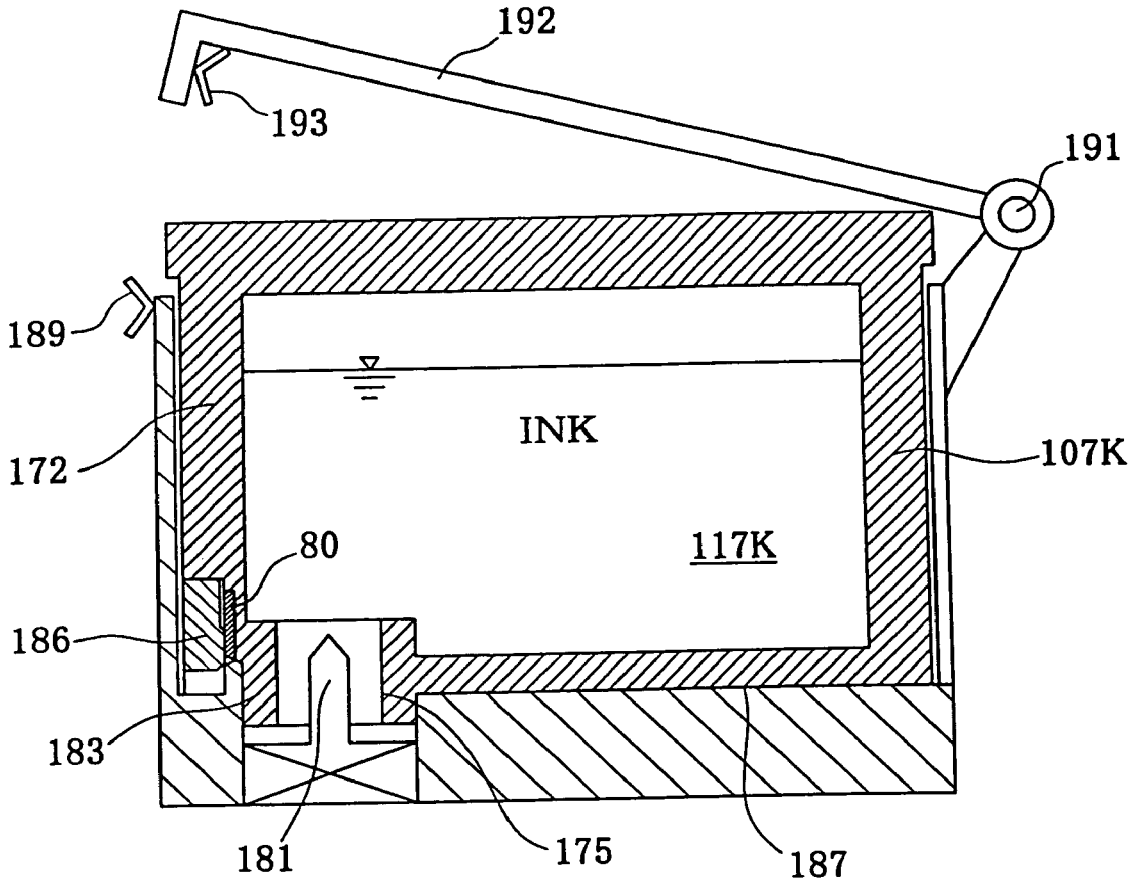
FIG. 5 is a sectional view illustrating an attachment state in which the ink cartridge shown in FIG. 4A is attached to the cartridge attachment unit shown in FIG. 4B.

FIGS. 4A and 4B are perspective views schematically illustrating the structures of the ink cartridge and the cartridge attachment unit of the printer main body 100. FIG. 5 is a sectional view illustrating an attachment state in which the ink cartridge is attached to the cartridge attachment unit.

Referring to FIG. 4A, the ink cartridge 107K has a cartridge main body 171 that is composed of a synthetic resin and defines the ink chamber 117K in which black ink is kept, and a storage element 80 incorporated in a side frame 172 of the cartridge main body 171. The storage element 80 carries out transmission of various data to and from the printer main body 100, when the ink cartridge 107K is attached to a cartridge attachment unit 18 of the printer main body 100 shown in FIG. 4B. The storage element 80 is received in a bottom-opened recess 173 formed in the side frame 172 of the ink cartridge 107K. The storage element 80 has a plurality of connection terminals 174 exposed to the outside. Alternatively the whole storage element 80 may be exposed to the outside.

Referring to FIG. 4B, the cartridge attachment unit 18 has a needle 181, which is disposed upward on a bottom 187 of a cavity, in which the ink cartridge 107K is accommodated. A recess 183 is formed about the needle 181 to receive an ink supply unit 175 (see FIG. 5) formed in the ink cartridge 107K. Three cartridge guides 182 are set on the inner wall of the recess 183. A connector 186 is placed on an inner wall 184 of the cartridge attachment unit 18. The connector 186 has a plurality of electrodes 185, which electrically connect with the plurality of connection terminals 174 of the storage element 80 when the ink cartridge 107K is attached to the cartridge attachment unit 18.

The ink cartridge 107K is attached to the cartridge attachment unit 18 according to the following procedure. The procedure first places the ink cartridge 107K on the cartridge attachment unit 18. The procedure then presses down a lever 182, which is fixed to a rear wall 188 of the cartridge attachment unit 18 via a support shaft 191 as shown in FIG. 5, to be over the ink cartridge 107K. The press-down motion of the lever 182 presses the ink cartridge 107K downward, so as to make the ink supply unit 175 fitted into the recess 183 and make a needle 181 pierce the ink supply unit 175, thereby enabling a supply of ink. As the lever 192 is further pressed down, a clutch 193 disposed on a free end of the lever 192 engages with a mating element 189 disposed on the cartridge attachment unit 18. This fixes the ink cartridge 107K to the cartridge attachment unit 18. In this state, the plurality of connection terminals 174 on the storage element 80 in the ink cartridge 107K electrically connect with the plurality of electrodes 185 on the cartridge attachment unit 18. This enables transmission of data between the printer main body 100 and the storage element 80.

The color ink cartridge 107F basically has a similar structure to that of the ink cartridge 107K, and only the difference is described here. The color ink cartridge 107F has five ink chambers in which five different color inks are kept. It is required to feed the supplies of the respective color inks to the print head 10 via separate pathways. The color ink cartridge 107F accordingly has five ink supply units 175, which respectively correspond to the five different color inks. The color ink cartridge 107F, in which five different color inks are stored, however, has only one storage element 80 incorporated therein. Pieces of information regarding the ink cartridge 107F and the five different color inks are collectively stored in this storage element 80.

(Structure of Storage Element 80)

Figure 6:
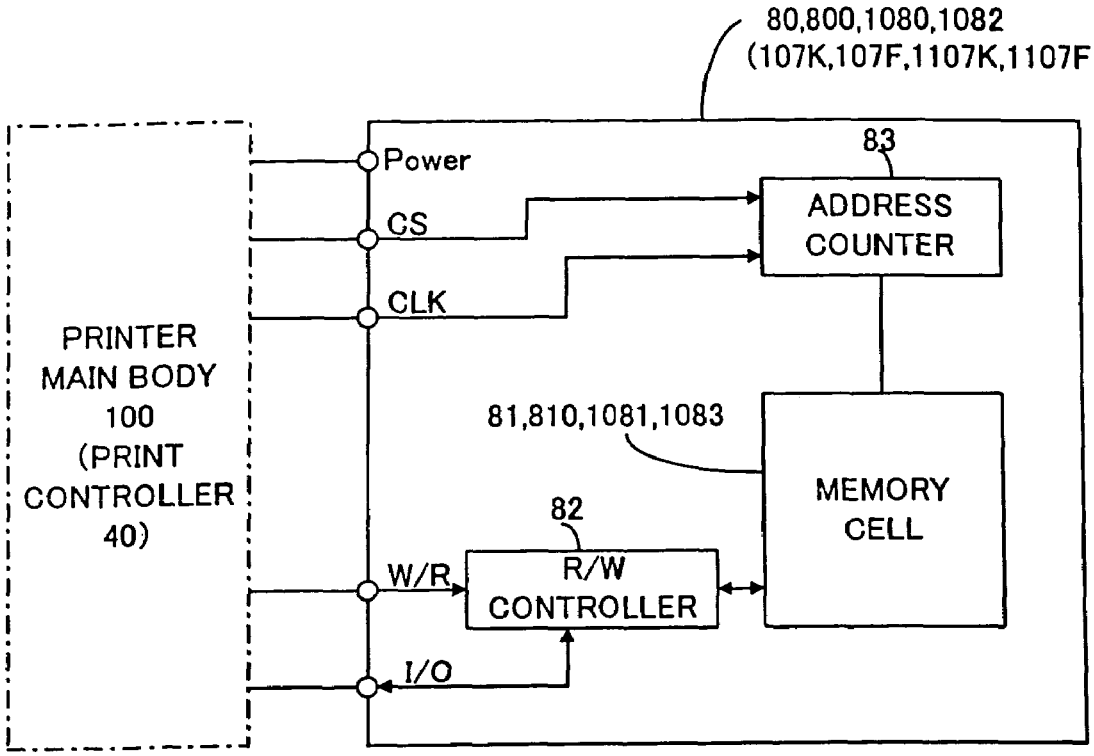
FIG. 6 is a block diagram showing the configuration of a storage element incorporated in the ink cartridges attached to the ink jet printer shown in FIG. 1.

FIG. 6 is a block diagram showing the configuration of the storage element 80 incorporated in the ink cartridges 107K and 107F attached to the ink jet printer 1 of the embodiment. Both the black ink cartridge 107K and the color ink cartridge 107F have an ink reservoir, in which one or a plurality of inks are kept, and the storage element 80 incorporated therein. An EEPROM is applied for the storage element 80 in this embodiment. As shown in the block diagram of FIG. 6, the EEPROM of the storage element 80 includes a memory cell 81 that is serially accessed, a read/write controller 82 that controls reading and writing operations of data from and into the memory cell 81, and an address counter 83 that counts up in the process of data transmission between the printer main body 100 and the memory cell 81 via the read/write controller 82 in response to a clock signal CLK.

FIG. 7 shows a data array in the storage element 80 incorporated in the black ink cartridge 107K attached to the ink jet printer 1 of the embodiment. Referring to FIG. 7, the memory cell 81 of the storage element 80 incorporated in the black ink cartridge 107K has a first storage area 750, in which read only data are stored, and a second storage area 760, in which rewritable data are stored. The printer main body 100 can only read the data stored in the first storage area 750, while enabling both reading and writing operations with regard to the data stored in the second storage area 760. The second storage area 760 is located at an address, which is accessed prior to the first storage area 750. Namely the second storage area 760 has a lower address than that of the first storage area 750. In the specification hereof, the expression 'lower address' means an address closer to the head.

The rewritable data stored in the second storage area 760 include first data on the remaining quantity of black ink and second data on the remaining quantity of black ink that are respectively allocated to first and second black ink remaining quantity memory divisions 701 and 702, which are accessed in this order.

There are the two black ink, remaining quantity memory divisions 701 and 702 for storing the data on the remaining quantity of black ink. This arrangement enables the data on the remaining quantity of black ink to be written alternately in these two memory divisions 701 and 702. If the latest data on the remaining quantity of black ink is stored in the first black ink remaining quantity memory division 701, the data on the remaining quantity of black ink stored in the second black ink remaining quantity memory division 702 is the previous data immediately before the latest data, and the next writing operation is performed in the second black ink remaining quantity memory division 702.

The read only data stored in the first storage area 750 include data on the time (year) of unsealing the ink cartridge 107K, data on the time (month) of unsealing the ink cartridge 107K, version data of the ink cartridge 107K, data on the type of ink, for example, a pigment or a dye, data on the year of manufacture of the ink cartridge 107K, data on the month of manufacture of the ink cartridge 107K, data on the date of manufacture of the ink cartridge 107K, data on the production line of the ink cartridge 107K, serial number data of the ink cartridge 107K, and data on the recycle showing whether the ink cartridge 107K is new or recycled, which are respectively allocated to memory divisions 711 through 720 that are accessed in this order.

FIG. 8 shows a data array in the storage element 80 incorporated in the color ink cartridge 107F attached to the ink jet printer 1 of the embodiment. Referring to FIG. 8, the memory cell 81 of the storage element 80 incorporated in the color ink cartridge 107F has a first storage area 650, in which read only data are stored, and a second storage area 660, in which rewritable data are stored. The printer main body 100 can only read the data stored in the first storage area 650, while enabling both reading and writing operations with regard to the data stored in the second storage area 660. The second storage area 660 is located at an address, which is accessed prior to the first storage area 650. Namely the second storage area 660 has a lower address (that is, an address closer to the head) than that of the first storage area 650.

The rewritable data stored in the second storage area 660 include first data on the remaining quantity of cyan ink, second data on the remaining quantity of cyan ink, first data on the remaining quantity of magenta ink, second data on the remaining quantity of magenta ink, first data on the remaining quantity of yellow ink, second data on the remaining quantity of yellow ink, first data on the remaining quantity of light cyan ink, second data on the remaining quantity of light cyan ink, first data on the remaining quantity of light magenta ink, and second data on the remaining quantity of light magenta ink that are respectively allocated to color ink remaining quantity memory divisions 601 through 610, which are accessed in this order.

In the same manner as the black ink cartridge 107K, there are the two memory divisions, that is, the first color ink remaining quantity memory division 601 (603, 605, 607, 609) and the second color ink remaining quantity memory division 602 (604, 606, 608, 610), for storing the data on the remaining quantity of each color ink. This arrangement enables the data on the remaining quantity of each color ink to be rewritten alternately in these two memory divisions.

Like the black ink cartridge 107K, the read only data stored in the first storage area 650 include data on the time (year) of unsealing the ink cartridge 107F, data on the time (month) of unsealing the ink cartridge 107F, version data of the ink cartridge 107F, data on the type of ink, data on the year of manufacture of the ink cartridge 107F, data on the month of manufacture of the ink cartridge 107F, data on the date of manufacture of the ink cartridge 107F, data on the production line, serial number data, and data on the recycle that are respectively allocated to memory divisions 611 through 620, which are accessed in this order. These data are common to all the color inks, so that only one set of data are provided and stored as common data to all the color inks.

When the power of the ink jet printer 1 is turned on while the ink cartridges 107K and 107F are attached to the printer main body 100, these data are read by the printer main body 100 and stored into the EEPROM 90 incorporated in the printer main body 100. FIG. 9 shows a data array in the EEPROM 90 incorporated in the printer main body 100 of the ink jet printer 1 of the embodiment. As shown in FIG. 9, memory divisions 901 through 935 in the EEPROM 90 store all the data stored in the respective storage elements 80 including the remaining quantities of the respective inks in the black ink cartridge 107K and the color ink cartridge 107F.

(Operation of Ink Jet Printer 1)

Figure 10:
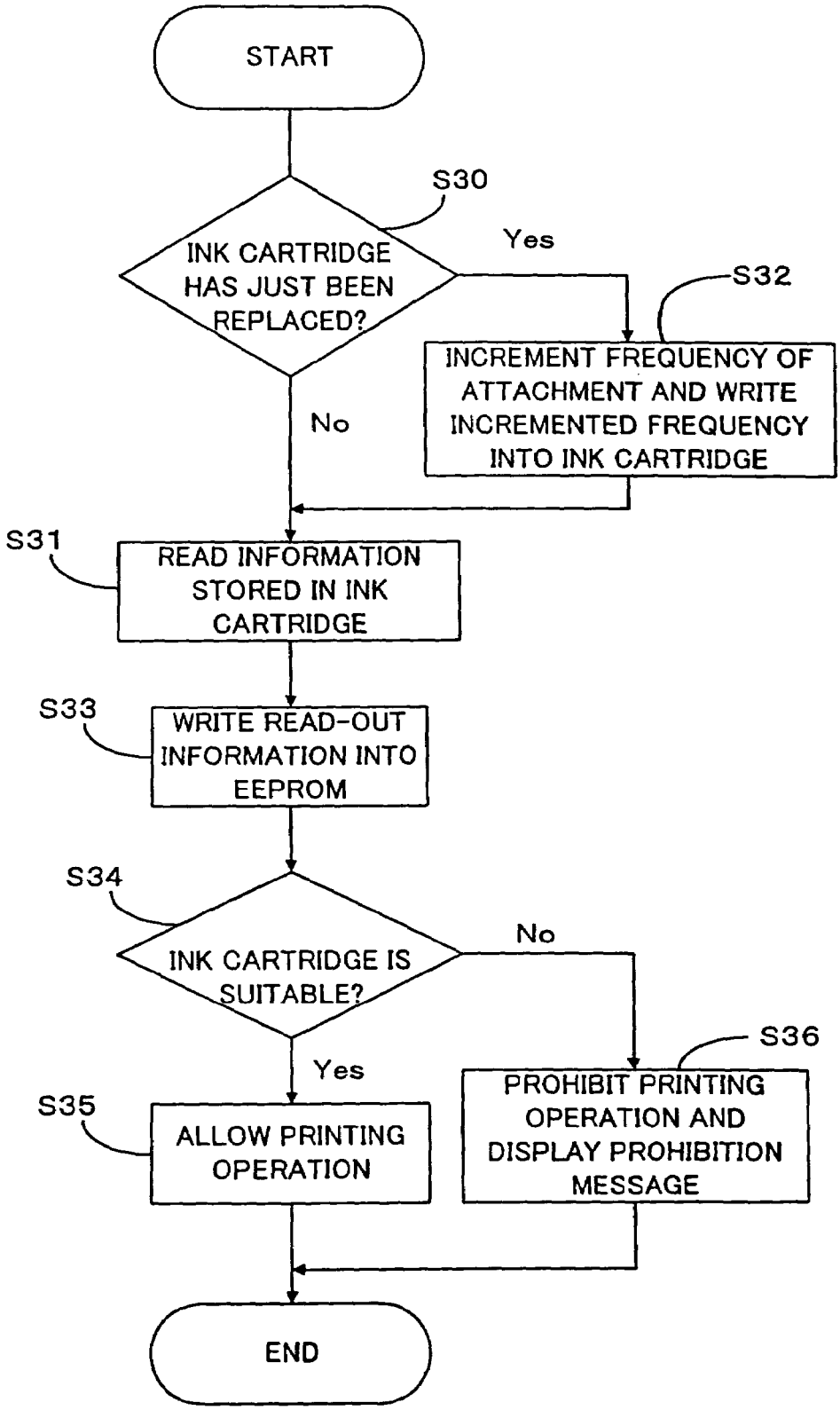
FIG. 10 is a flowchart showing a processing routine executed at a time of power supply.
Figure 11:
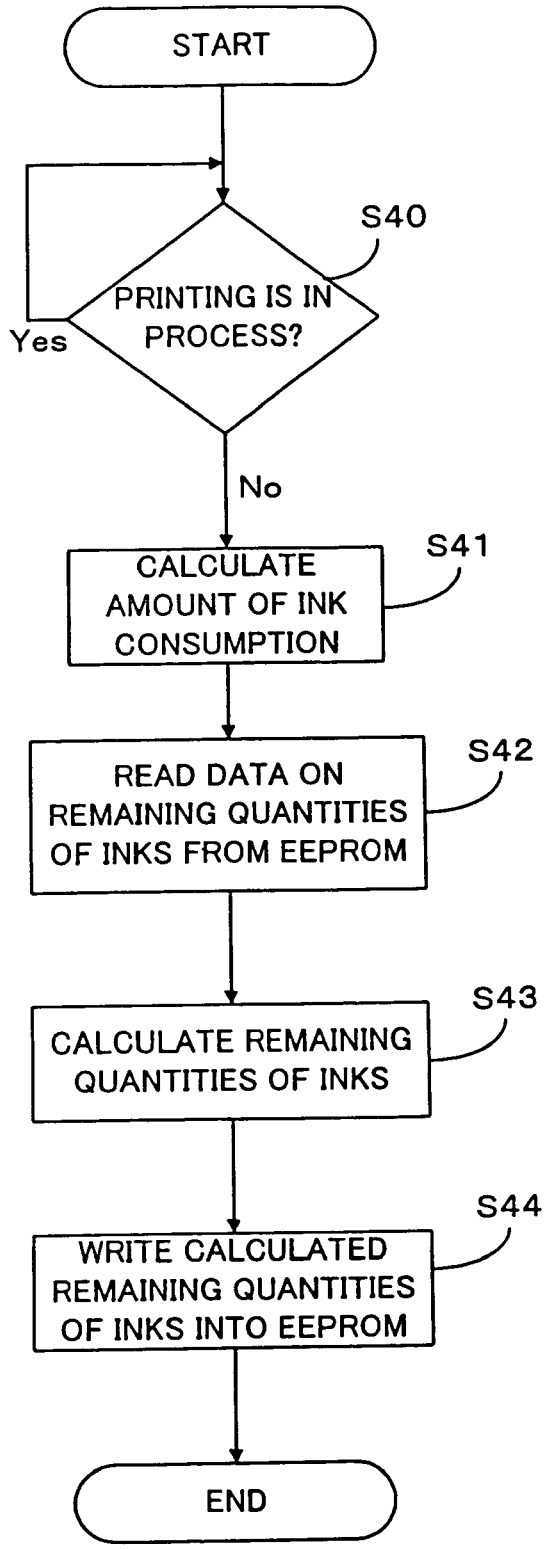
FIG. 11 is a flowchart showing a processing routine executed to calculate the remaining quantities of inks.
Figure 12:
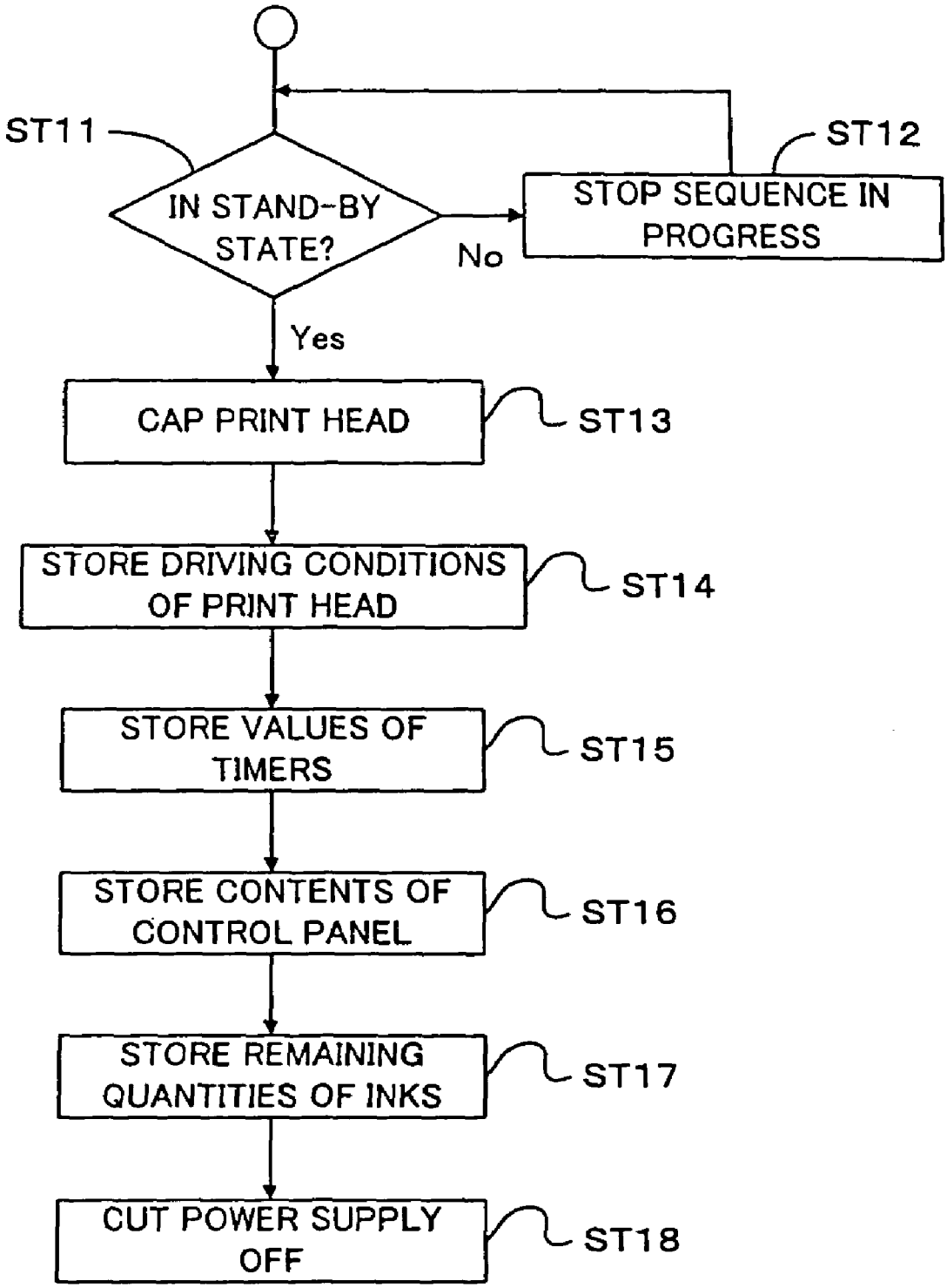
FIG. 12 is a flowchart showing a processing routine executed before a power-off time of the ink jet printer shown in FIG. 1.

With reference to FIGS. 10 through 12, the following describes a series of basic processing executed by the ink jet printer 1 of the embodiment from a power-on time to a power-off time. FIG. 10 is a flowchart showing a processing routine executed at a time of power supply. FIG. 11 is a flowchart showing a processing routine executed to calculate the remaining quantities of inks. FIG. 12 is a flowchart showing a processing routine executed before a power-off time of the ink jet printer 1 of the embodiment.

The following description regards the processing routine executed by the controller 46 after the power supply, with referring to the flowchart of FIG. 10. When a power is turned on in the ink jet printer 1, the controller 46 first determines whether or not the ink cartridge 107K or 107F has just been replaced at step S30. The decision of step S30 is carried out, for example, by referring to an ink cartridge replacement flag in the case where the EEPROM 90 stores the ink cartridge replacement flag, or in another example, based on data regarding the time (hour and minute) of manufacture or production serial number data with regard to the ink cartridge 107K or 107F. In the case of power-on without replacement of the ink cartridges 107K and 107F, the controller 46 reads the data from the respective storage elements 80 of the ink cartridges 107K and 107F at step S31.

When it is determined that the ink cartridge 107K or 107F has just been replaced at step S30, on the other hand, the controller 46 increments a frequency of attachment by one and writes the incremented frequency of attachment into the storage element 80 of the ink cartridge 107K or 107F at step S32. The controller 46 then reads the data from the respective storage elements 80 of the ink cartridges 107K and 107F at step S31. The controller 46 subsequently writes the read-out data at preset addresses in the EEPROM 90 or the RAM 44 at step S33. At subsequent step S34, the controller 46 determines whether the ink cartridges 107K and 107F attached to the ink jet printer 1 are suitable for the ink jet printer 1, based on the data stored in the EEPROM 90. If the controller 46 determines the ink cartridges 107K and 107F are suitable at step S34, a printing operation is allowed at step S35. This completes the preparation for printing, and the program exits from the processing routine of FIG. 10. If the controller 46 determines the ink cartridges 107K and 107F are not suitable at step S34, on the contrary, the printing operation is not allowed, and information representing the prohibition of printing is displayed on either the panel switch 92 or a display MT at step S36.

The ink jet printer 1 carries out a predetermined printing process in the case where the printing operation is allowed. The controller 46 calculates the remaining quantities of the respective black and color inks in the course of the predetermined printing process. The procedure of the calculation is described with reference to the flowchart of FIG. 11. The processing routine for calculating the remaining quantities of black and color inks starts on a start of the printing operation. The controller 46 first determines whether or not the printing operation is being executed at step S40. When it is determined that the printing operation is under execution at step S40, the program waits for completion of the printing operation. When it is determined that the printing operation is not being executed at step S40, on the other hand, the controller 46 calculates an amount of ink consumption with regard to each black or color ink relating to the printing operation at step S41. For example, one typical procedure of the calculation multiplies the frequency of ejection of ink droplets by the weight of an ink droplet to determine the quantity of ink ejection with regard to each black or color ink, and adds the quantity of ink suction consumed by the previous motion of ink suction to the calculated quantity of ink ejection to determine the amount of ink consumption. The controller 46 reads data on the remaining quantities of black and color inks from the EEPROM 90 at step S42. The controller 46 then subtracts the calculated amount of ink consumption from the read-out remaining quantity of ink to determine a latest remaining quantity of ink with regard to each black or color ink at step S43. The controller 46 subsequently writes the calculated latest remaining quantities of the respective inks as the new data on the remaining quantities of black and color inks into the EEPROM 90 at step S44. After the execution of step S44, the program exits from the processing routine of FIG. 11.

The calculated latest remaining quantities of the respective black and color inks are written into the respective storage elements 80 of the ink cartridges 107K and 107F after an off-operation of the power switch on the panel switch 92 in the ink jet printer 1.

Referring to the flowchart of FIG. 12, in response to an off-operation of the power switch on the panel switch 92 in the ink jet printer 1, the program first determines whether or not the ink jet printer 1 is in a stand-by state at step ST11. In the case where the ink jet printer 1 is not in the stand-by state at step ST11, the program stops the sequence in progress at step ST12 and returns to step ST11. In the case where the ink jet printer 1 is in the stand-by state at step ST11, on the other hand, the program caps the printer had 10 at step ST13 and stores information on driving conditions of the print head 10, for example, voltages of driving waveforms or color IDs used for color correction, at step ST14. The program subsequently stores the values of timers at step ST15 and the contents of a control panel, for example, an adjustment value used in the case of bi-directional printing, at step ST16. The program then stores the remaining quantities of the respective black and color inks, which are written in the EEPROM 90, into the second storage areas 660 and 760 of the respective storage elements 80 of the black and color -ink cartridges 107K and 107F at step ST17. In this embodiment, the remaining quantity of ink is written alternately into the two memory divisions allocated for each ink in the second storage area 660 or 760. In accordance with one possible application, the execution of the storage into each memory division may be identified by means of a flag, which is located at the head of each memory division. The program then cuts the power supply off at step ST18.

Figure 13A:
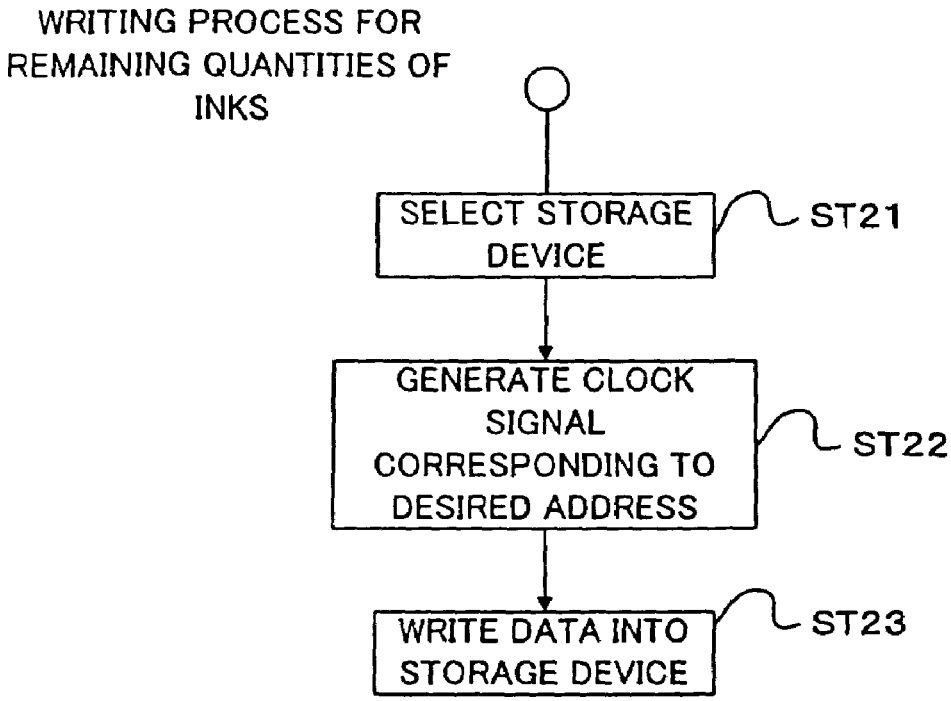
FIG. 13A is a flowchart showing a processing routine executed to write the remaining quantities of inks from the printer main body into the storage elements incorporated in the ink cartridges in the ink jet printer shown in FIG. 1.
Figure 13B:
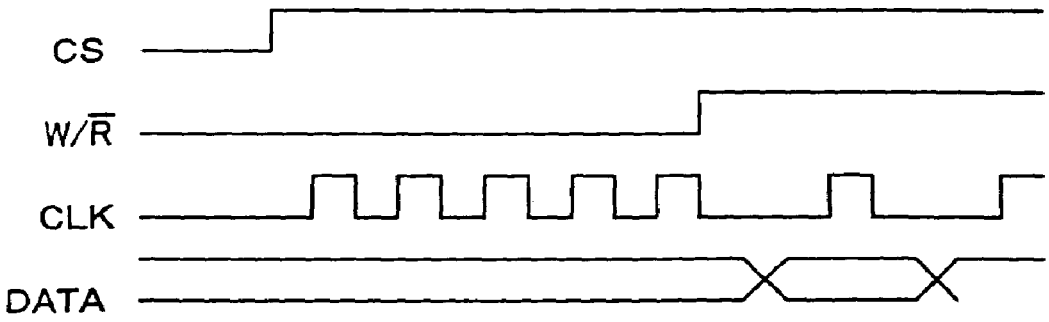
FIG. 13B is a timing chart showing the timing of execution of the processing shown in the flowchart of FIG. 13A.

In the series of the processing for the power-off operation, the procedure of writing the remaining quantities of the respective inks into the storage elements 80 of the black and color ink cartridges 107K and 107F at step ST17 in the flowchart of FIG. 12 is described with reference to FIGS. 6, 13A, and 13B. FIG. 13A is a flowchart showing a processing routine executed to write the remaining quantities of inks from the printer main body 100 into the storage elements 80 incorporated in the ink cartridges 107K and 107F in the ink jet printer 1 of the embodiment. FIG. 13B is a timing chart showing the timing of execution of the processing shown in the flowchart of FIG. 13A.

Referring to the block diagram of FIG. 6, the flowchart of FIG. 13A, and the timing chart of FIG. 13B, the printer main body 100 first outputs an enable signal CS for setting the storage element 80 in an enabling state, so as to select the storage element 80 at step ST21. The printer main body 100 then makes the address counter 83 in the selected storage element 80 count up in response to the clock signal CLK, in order to allocate data on the remaining quantity of ink DATA to a preset address at step ST22. After the counting up to the preset address for writing the data, the terminal of the read/write controller 82 is set in a writable state. In response to a read/write signal -R/W (the bar denotes the active low state) output synchronously with the clock signal CLK, the printer main body 100 outputs the data on the remaining quantity of ink DATA to a data terminal and writes the data on the remaining quantity of ink DATA into the storage element 80 of the ink cartridge 107K or 107F at step ST23. Although the writing operation is performed synchronously with a fifth pulse of the clock signal CLK in the example of FIG. 13B, this only describes the general writing procedure. In this embodiment, the process of writing the remaining quantities of inks is carried out synchronously with a first pulse of the clock signal CLK.

(Effects of First Embodiment)

As described above, in the first embodiment, the inexpensive EEPROM, which carries out only the sequential access, is applied for the storage elements 80 of the black and color ink cartridges 107K and 107F, where the data on the remaining quantities of inks are stored. Such application desirably reduces the cost of the expendable ink cartridges 107K and 107F.

In the structure of the first embodiment, the second storage areas 660 and 760 for storing the rewritable data have the addresses to be accessed prior to the first storage areas 650 and 750 for storing the read only data in the respective storage elements 80. This arrangement enables the required capacity to be favorably minimized when another auxiliary power unit having a different structure from that in the power source 91 described with reference to FIG. 2 is applied. This auxiliary power unit is designed not to interrupt the writing operation even if the power plug is pulled out of the socket but to ensure continuation of the power supply until the completion of the writing operation. The required capacity of the auxiliary power unit is, for example, a value that enables continuation of the power supply for a time period of 10 msec. Even in the event that there is abnormality in data due to some cause other than the interruption of power supply, for example, due to noises, this arrangement enables the remaining quantity of ink to be monitored accurately. The configuration of the first embodiment, which applies the inexpensive storage elements 80 enabling only the sequential access to decrease the cost of the ink cartridges 107K and 107F, thus advantageously reduces the possible failure in the process of rewriting the data.

In the conventional structure, if the power plug is accidentally pulled out of the socket in the course of rewriting the data on the remaining quantity of ink, this destroys the data and interferes with the subsequent monitor of the remaining quantity of ink. In the structure of this embodiment, however, the data on the remaining quantities of the respective inks are present in the head portions of the respective storage areas 650, 660, 750, and 760 included in the storage elements 80. This configuration enables the writing operation of the data to be completed in a short time period, for example, before the power plug is pulled out of the socket, and thereby advantageously reduces the possible failure in the process of rewriting the data.

In the first embodiment, the data on the remaining quantity of ink is stored and monitored with regard to each black or color ink in the ink cartridges 107K and 107F. In the case where a specified color is not expressed in a resulting color print, this arrangement enables the cause of the failure to be located readily, a mistake of the specification or the exhaustion of the specified color ink.

In the arrangement of the first embodiment, the latest data on the remaining quantity of each ink is written alternately into the two memory divisions allocated to each ink in the second storage area 660 or 760. Some trouble may interfere with the normal writing operation of the latest data into one memory division, for example, by accidentally pulling the power plug out of the socket in the course of the wiring operation in the current cycle. The previous data written in the previous cycle immediately before the current cycle, however, remain in the other memory division. Even in the case of the abnormal writing operation into one memory division, this arrangement enables the remaining quantity of ink to be monitored continuously based on the previous data written in the other memory division.

Second Embodiment

The following describes a second embodiment according to the present invention, which is applicable to an ink jet printer having an identical structure to that of the ink jet printer 1 of the first embodiment. The like constituents are expressed by the like numerals and are not specifically described here. The difference from the first embodiment is that identical data regarding the remaining quantity of each ink is written into two different memory divisions allocated to each ink in a duplicated manner and that a write complete flag is attached to the end of each memory division.

(Structure of Storage Element 80)

Like the arrangement of the first embodiment shown in FIG. 7, in the arrangement of the second embodiment, the rewritable data stored in the second storage area 760 include first data on the remaining quantity of black ink and second data on the remaining quantity of black ink that are respectively allocated to first and second black ink remaining quantity memory divisions 701 and 702, which are accessed in this order. In the second embodiment, however, the identical data on the remaining quantity of black ink is written into these two memory divisions 701 and 702 in a duplicated manner. This arrangement enables a comparison between the data on the remaining quantity of black ink stored in the first and second black ink remaining quantity memory divisions 701 and 702. Based on the comparison, it is determined whether or not the writing operation of the data on the remaining quantity of black ink has been completed normally. It is thereby determined which of these data stored in the two different memory divisions 701 and 702 should be used as the current data on the remaining quantity of black ink.

The details of these two memory divisions 701 and 702 are described with reference to FIG. 14. FIG. 14 schematically illustrates a data structure of the first black ink remaining quantity memory division 701 and the second black ink remaining quantity memory division 702. As mentioned above, in this embodiment, the data on the remaining quantity of black ink are written alternately, first into the first black ink remaining quantity memory division 701 and then into the second black ink remaining quantity memory division 702. A first write complete flag A is provided in an end portion 770 of the first memory division 701, and a second write complete flag B is provided in an end portion 771 of the second memory division 702. These write complete flags A and B show whether or not the writing operation of the data on the remaining quantity of black ink has been completed normally in the respective memory divisions 701 and 702. The initial values of the write complete flags A and B are different from each other. In one example, the first write complete flag A has the initial value of 0, whereas the second write complete flag B has the initial value of 1. Both the write complete flags A and B having an identical value thus means that the writing operation has been completed in the first black ink remaining quantity memory division 701. These write complete flags A and B may alternatively be placed in head portions of the respective memory divisions 701 and 702.

Like the arrangement of the first embodiment shown in FIG. 8, in the arrangement of the second embodiment, the rewritable data stored in the second storage area 660 include first data on the remaining quantity of cyan ink, second data on the remaining quantity of cyan ink, first data on the remaining quantity of magenta ink, second data on the remaining quantity of magenta ink, first data on the remaining quantity of yellow ink, second data on the remaining quantity of yellow ink, first data on the remaining quantity of light cyan ink, second data on the remaining quantity of light cyan ink, first data on the remaining quantity of light magenta ink, and second data on the remaining quantity of light magenta ink that are respectively allocated to color ink remaining quantity memory divisions 601 through 610, which are accessed in this order. In the second embodiment, however, the identical data on the remaining quantity of each color ink is written into the two memory divisions allocated to each ink in a duplicated manner. This arrangement enables a comparison between the data on the remaining quantity of each color ink stored in the first color ink remaining quantity memory division 601 (603, 605, 607, 609) and the second color ink remaining quantity memory division 602 (604, 606, 608, 610). Based on the comparison, it is determined whether or not the writing operation of the data on the remaining quantity of each color ink has been completed normally. It is thereby determined which of these data stored in the two different memory divisions should be used as the current data on the remaining quantity of each color ink.

The details of these two memory divisions, that is, the first color ink remaining quantity memory division 601 (603, 605, 607, 609) and the second color ink remaining quantity memory division 602 (604, 606, 608, 610), are described with reference to FIG. 15 regarding the cyan ink as an example. FIG. 15 schematically illustrates a data structure of the first cyan ink remaining quantity memory division 601 and the second cyan ink remaining quantity memory division 602. As mentioned above, in this embodiment, the data on the remaining quantity of cyan ink are written alternately, first into the first cyan ink remaining quantity memory division 601 and then into the second cyan ink remaining quantity memory division 602. A first write complete flag A is provided in an end portion 670 of the first memory division 601, and a second write complete flag B is provided in an end portion 671 of the second memory division 602. These write complete flags A and B show whether or not the writing operation of the data on the remaining quantity of cyan ink has been completed normally in the respective memory divisions 601 and 602. The initial values of the write complete flags A and B are different from each other. In one example, the first write complete flag A has the initial value of 0, whereas the second write complete flag B has the initial value of 1. Both the write complete flags A and B having an identical value thus means that the writing operation has been completed in the first cyan ink remaining quantity memory division 601. These write complete flags A and B may alternatively be placed in head portions of the respective memory divisions 601 and 602.

The ink jet printer of the second embodiment executes the processing routines shown in FIGS. 10 through 13A in the same manner as described in the first embodiment. In the second embodiment, however, the data on the remaining quantity of each black or color ink is written into two different memory divisions allocated to each ink in a duplicated manner. A processing routine for determining the data regarding the remaining quantity of each black or color ink, which will be described later, is carried out to determine the data to be read out at step S31 in the flowchart of FIG. 10.

In the second embodiment, when the remaining quantities of the respective inks are stored into the second storage areas 660 and 760 of the storage elements 80, the identical piece of information on the remaining quantity of each ink is written in a duplicated manner into the two memory divisions allocated to each ink. This process is described in detail with reference to the storage element 80 of the black ink cartridge 107K shown in FIG. 14. The data regarding the remaining quantity of black ink is first written into the first black ink remaining quantity memory division 701 in the storage element 80 of the black ink cartridge 107K. On completion of the writing operation in the first black ink remaining quantity memory division 701, the first write complete flag A is inverted. The data regarding the remaining quantity of black ink is then written into the second black ink remaining quantity memory division 702. On completion of the writing operation in the second black ink remaining quantity memory division 702, the second write complete flag B is inverted. This process of writing the information on remaining quantity of each ink enables the determination of whether or not the writing operation has been completed normally in each memory division as discussed below.

(Process of Reading Data from Storage Element 80)

Figure 16:
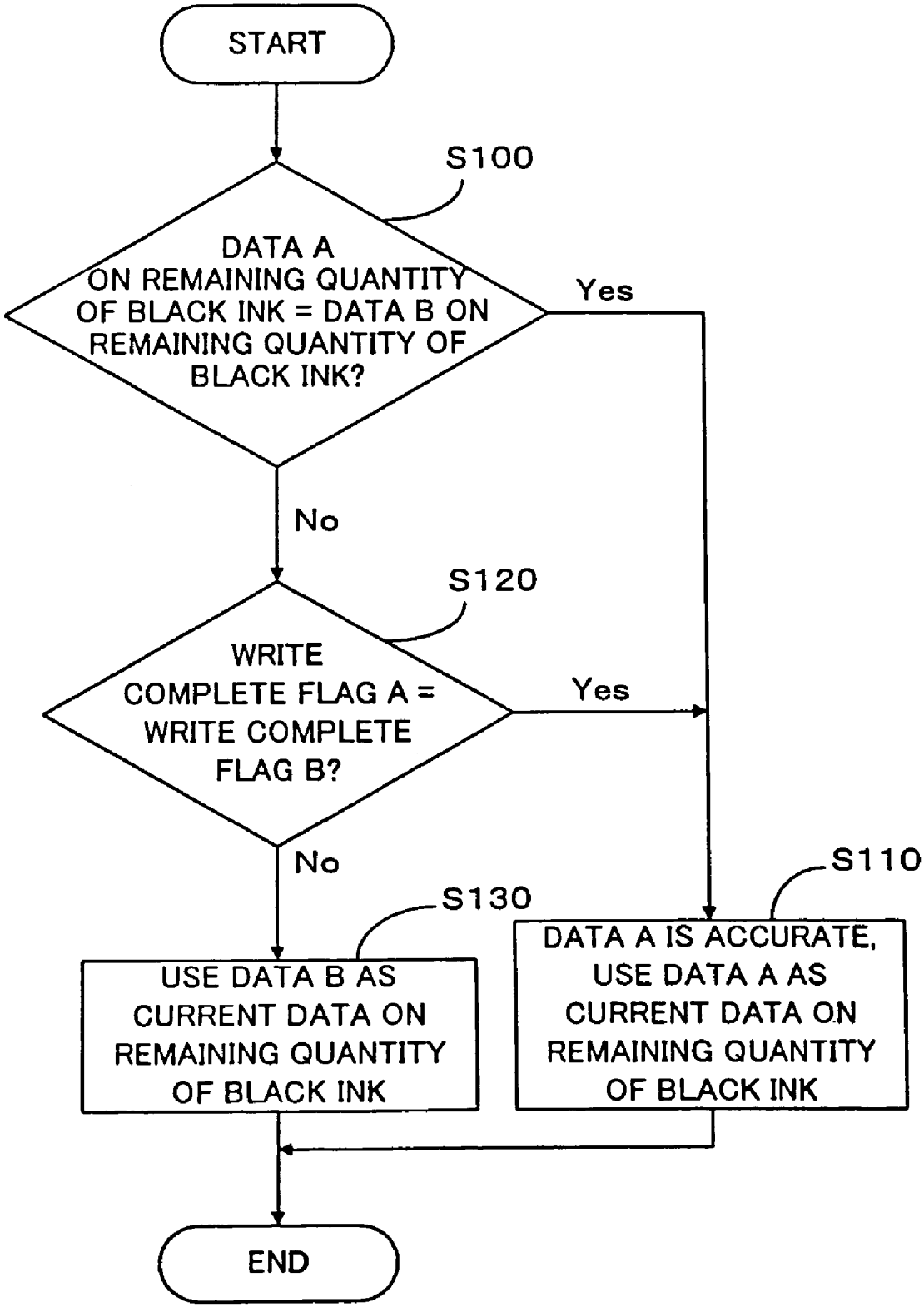
FIG. 16 is a flowchart showing a processing routine executed to determine data regarding the remaining quantity of black ink in the second embodiment.

The following describes the process of determining which of the data A on the remaining quantity of black ink stored in the first black ink remaining quantity memory division 701 and the data B on the remaining quantity of black ink stored in the second black ink remaining quantity memory division 702 is to be used as the current data on the remaining quantity of black ink, with reference to FIGS. 14A through 14C and FIG. 16. FIG. 16 is a flowchart showing a processing routine executed to determine the data regarding the remaining quantity of black ink.

Figure 14A:
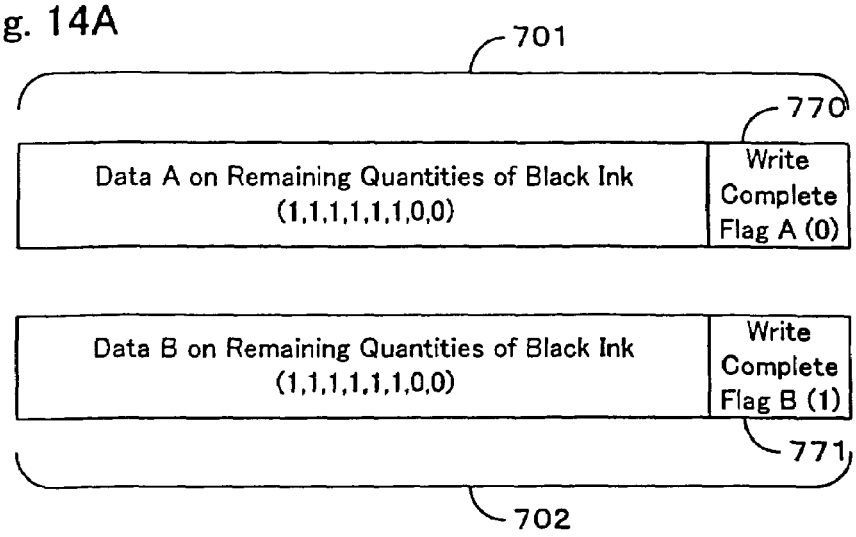
FIGS. 14A through 14C schematically illustrate a data structure of a first black ink remaining quantity memory division and a second black ink remaining quantity memory division in a second embodiment according to the present invention.

When the program enters the routine of FIG. 16, the data A on the remaining quantity of black ink stored in the first black ink remaining quantity memory division 701 is compared with the data B on the remaining quantity of black ink stored in the second black ink remaining quantity memory division 702 at step S100. In the event that the data A on the remaining quantity of black ink coincides with the data B on the remaining quantity of black ink as shown in FIG. 14A, that is, in the case of an affirmative answer at step S100, the program determines that the writing operation has been completed normally in both the first black ink remaining quantity memory division 701 and the second black ink remaining quantity memory division 702. In this case, the data A on the remaining quantity of black ink stored in the first black ink remaining quantity memory division 701 is used as the current data on the remaining quantity of black ink at step S110. At this moment, the first write complete flag A and the second write complete flag B have different values. After execution of step S110, the program exits from this routine.

Figure 14B:
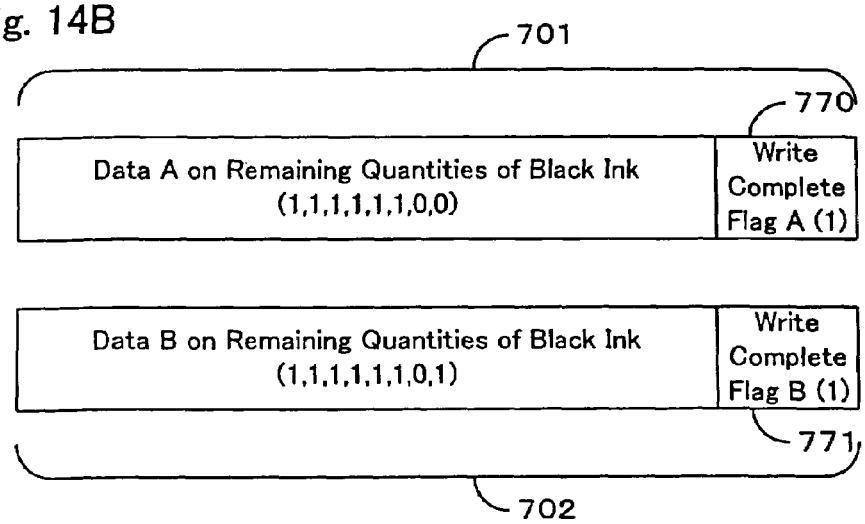
Figure 14C:
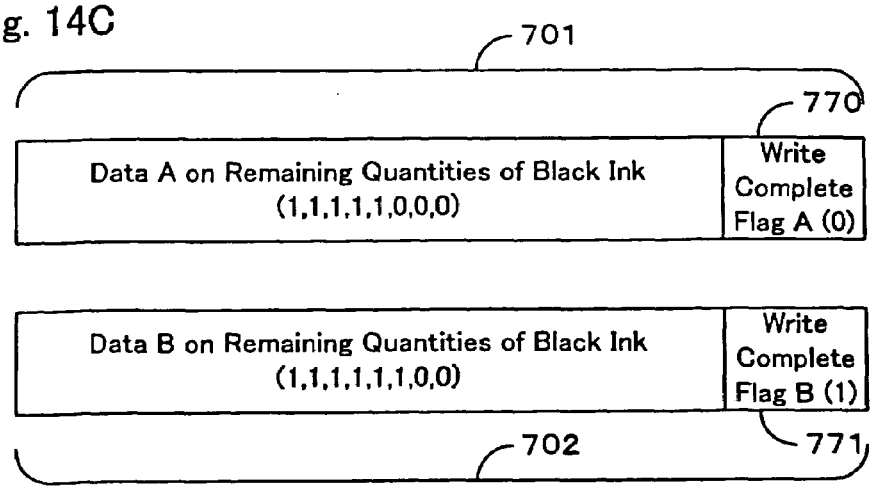

In the event that the data A on the remaining quantity of black ink does not coincide with the data B on the remaining quantity of black ink as shown in FIGS. 14B and 14C, that is, in the case of a negative answer at step S100, on the other hand, the first write complete flag A is compared with the second write complete flag B at step S120. When the first write complete flag A and the second write complete flag B have an identical value as shown in FIG. 14B, that is, in the case of an affirmative answer at step S120, the program determines that the writing operation has been completed normally in the first black ink remaining quantity memory division 701. The data A on the remaining quantity of black ink stored in the first black ink remaining quantity memory division 701 is thus used as the current data on the remaining quantity of black ink at step S110. When the first write complete flag A does not coincide with the second write complete flag B as shown in FIG. 14C, that is, in the case of a negative answer at step S120, on the other hand, the program determines that the writing operation has not been completed normally in the first black ink remaining quantity memory division 701. The data B on the remaining quantity of black ink stored in the second black ink remaining quantity memory division 702 is thus used as the current data on the remaining quantity of black ink at step S130. After execution of either step S110 or step S130, the program exits from this routine.

In this embodiment, the first write complete flag A and the second write complete flag B have different initial values, which are reverse to each other. Alternatively the two write complete flags A and B may have an identical initial value. In this alternative arrangement, the first write complete flag A and the second write complete flag B have an identical value in the case of the affirmative answer at step S100, and the processing after the decision at step S120 will be inverted.

Figure 17:
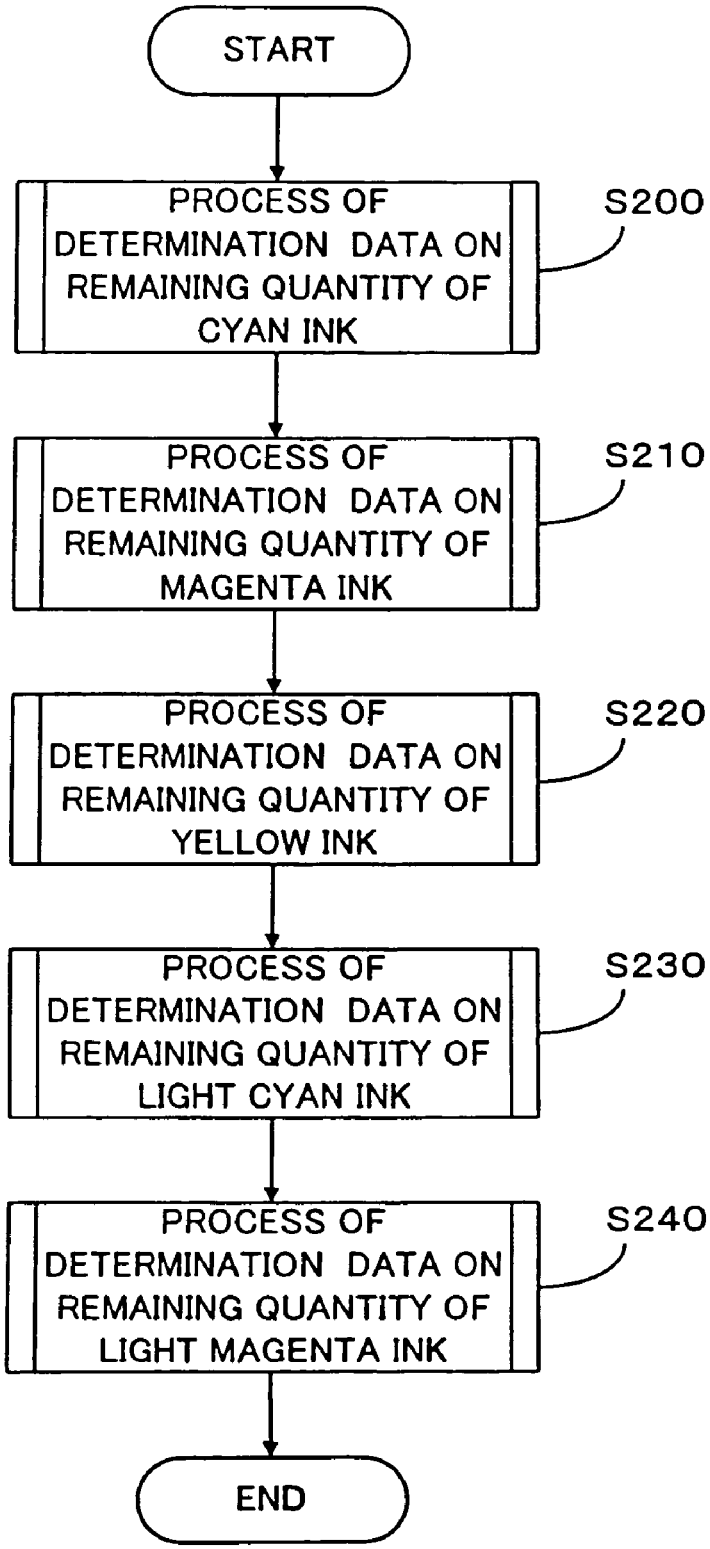
FIG. 17 is a flowchart showing a processing routine executed to determine data regarding the remaining quantities of color inks in the second embodiment.
Figure 18:
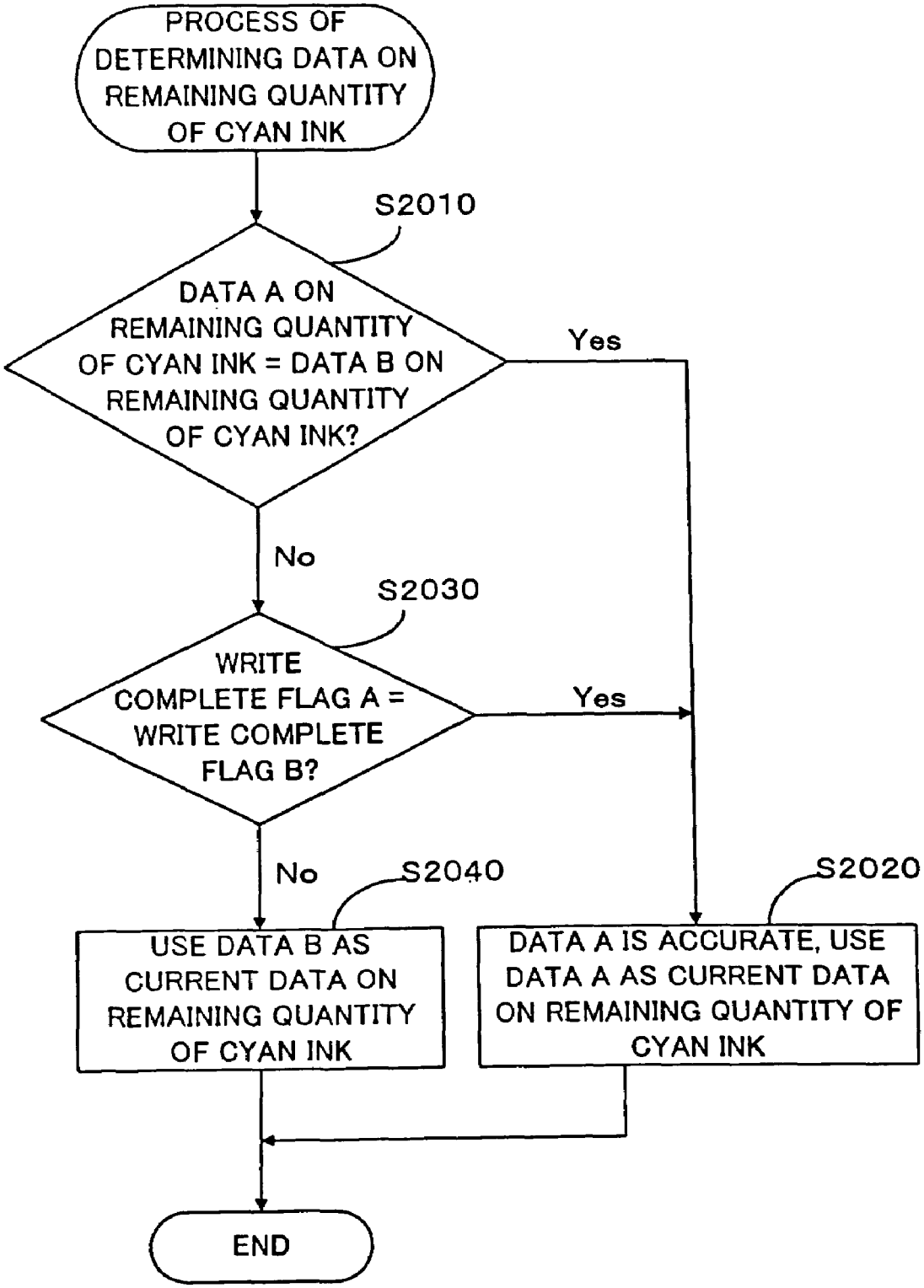
FIG. 18 is a flowchart showing the details of the process of determining the data regarding the remaining quantity of cyan ink in the flowchart of FIG. 17.

The following describes the process of determining which of the data A on the remaining quantity of each color ink stored in the first color ink remaining quantity memory division 601 (603, 605, 607, 609) and the data B on the remaining quantity of each color ink stored in the second color ink remaining quantity memory division 602 (604, 606, 608, 610) is to be used as the current data on the remaining quantity of each color ink, with reference to FIGS. 15A through 15C and FIGS. 17 and 18. FIG. 17 is a flowchart showing a processing routine executed to determine the data regarding the remaining quantities of color inks. FIG. 18 is a flowchart showing the details of the process of determining the data regarding the remaining quantity of cyan ink in the flowchart of FIG. 17.

Figure 15A:
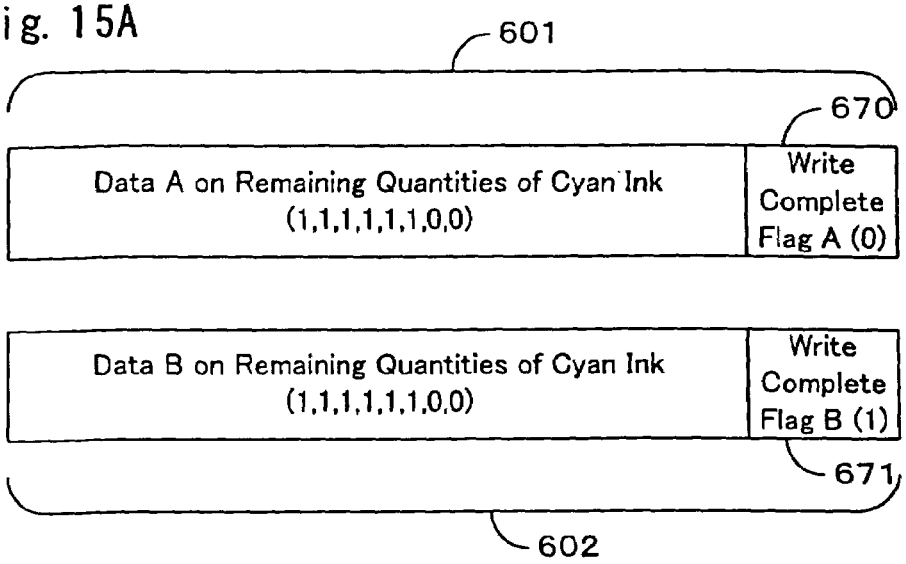
FIGS. 15A through 15C schematically illustrate a data structure of a first color ink remaining quantity memory division and a second color ink remaining quantity memory division in the second embodiment.

When the program enters the routine of FIG. 17, the controller 46 first executes a process of determining data on the remaining quantity of cyan ink at step S200. This process of step S200 is carried out according to the flowchart of FIG. 18. When the program enters the routine of determining the data on the remaining quantity of cyan ink shown in the flowchart of FIG. 18, the data A on the remaining quantity of cyan ink stored in the first cyan ink remaining quantity memory division 601 is compared with the data B on the remaining quantity of cyan ink stored in the second cyan ink remaining quantity memory division 602 at step S2010. In the event that the data A on the remaining quantity of cyan ink coincides with the data B on the remaining quantity of cyan ink as shown in FIG. 15A, that is, in the case of an affirmative answer at step S2010, the program determines that the writing operation has been completed normally in both the first cyan ink remaining quantity memory division 601 and the second cyan ink remaining quantity memory division 602. In this case, the data A on the remaining quantity of cyan ink stored in the first cyan ink remaining quantity memory division 601 is used as the current data on the remaining quantity of cyan ink at step S2020. At this moment, the first write complete flag A and the second write complete flag B have different values. After execution of step S2020, the program exits from this routine.

Figure 15B:
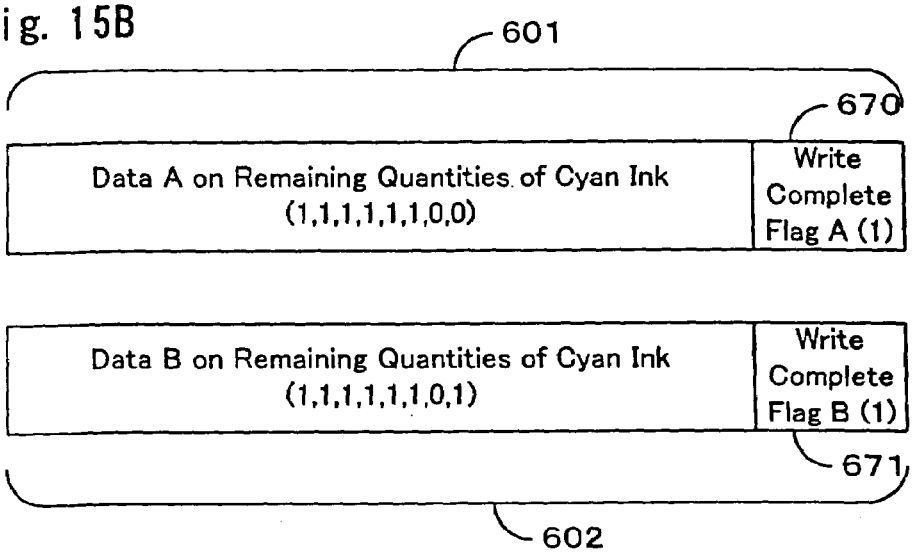
Figure 15C:
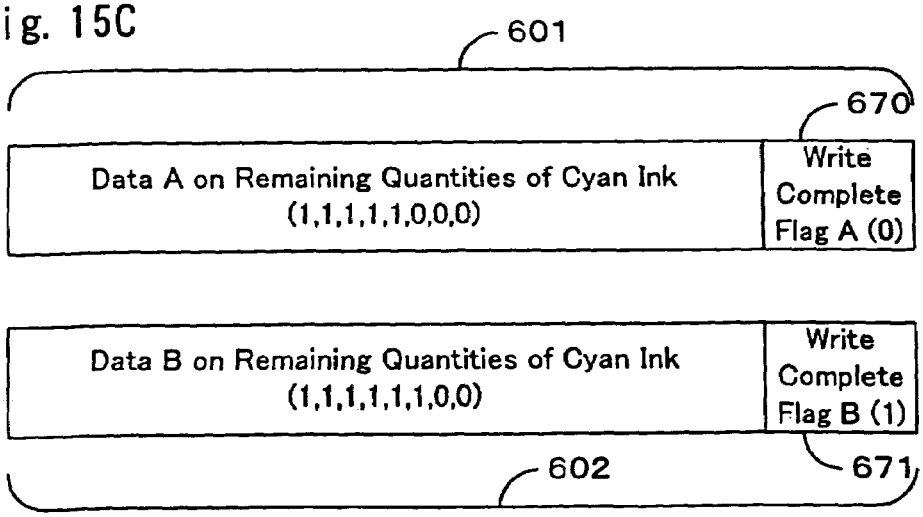

In the event that the data A on the remaining quantity of cyan ink stored in the first cyan ink remaining quantity memory division 601 does not coincide with the data B on the remaining quantity of cyan ink stored in the second cyan ink remaining quantity memory division 602 as shown in FIGS. 15B and 15C, that is, in the case of a negative answer at step S2010, on the other hand, the first write complete flag A is compared with the second write complete flag B at step S2030. When the first write complete flag A and the second write complete flag B have an identical value as shown in FIG. 15B, that is, in the case of an affirmative answer at step S2030, the program determines that the writing operation has been completed normally in the first cyan ink remaining quantity memory division 601. The data A on the remaining quantity of cyan ink stored in the first cyan ink remaining quantity memory division 601 is thus used as the current data on the remaining quantity of cyan ink at step S2020. When the first write complete flag A does not coincide with the second write complete flag B as shown in FIG. 15C, that is, in the case of a negative answer at step S2030, on the other hand, the program determines that the writing operation has not been completed normally in the first cyan ink remaining quantity memory division 601. The data B on the remaining quantity of cyan ink stored in the second cyan ink remaining quantity memory division 602 is thus used as the current data on the remaining quantity of cyan ink at step S2040. After execution of either step S2020 or step S2040, the program exits from this routine.

In this embodiment, the first write complete flag A and the second write complete flag B have different initial values, which are reverse to each other. Alternatively the two write complete flags A and B may have an identical initial value. In this alternative arrangement, the first write complete flag A and the second write complete flag B have an identical value in the case of the affirmative answer at step S2010, and the processing after the decision at step S2030 will be inverted.

Referring back to the flowchart of FIG. 17, the controller 46 successively executes a process of determining data on the remaining quantity of magenta ink at step S210, a process of determining data on the remaining quantity of yellow ink at step S220, a process of determining data on the remaining quantity of light cyan ink at step S230, and a process of determining data on the remaining quantity of light magenta ink at step S240. The details of the these processes of determining the data on the remaining quantities of magenta, yellow, light cyan, and light magenta inks are identical with those of the process of determining the data on the remaining quantity of cyan ink shown in the flowchart of FIG. 18 and are thereby not specifically described here. After execution of these processes, the program exits from the routine of FIG. 17.

(Effects of Second Embodiment)

The arrangement of the second embodiment exerts the same effects as those discussed in the first embodiment.

The arrangement of the second embodiment writes the identical data regarding the remaining quantity of each ink in a duplicated manner into the two ink remaining quantity memory divisions 701 (601, 603, 605, 607, 609) and 702 (602, 604, 606, 608, 610) allocated to each ink. The first and the second write complete flags A and B are provided in the end portions 770 and 771 (670 and 671) of the respective ink remaining quantity memory divisions. This arrangement facilitates the quick determination of whether or not the data on the remaining quantity of ink stored in each ink remaining quantity memory division is normal. Even if the writing operation has not been completed normally in one ink remaining quantity memory division, the arrangement of the second embodiment enables the normal data stored in the other ink remaining quantity memory division to be used as the current data on the remaining quantity of each ink. This configuration is especially effective when the duration of power supply becomes shorter than the required time period for the writing operation by pulling the power plug of the auxiliary power unit discussed in FIG. 2 is pulled out of the socket or when the power supply is suddenly cut off, for example, by power failure or by accidentally pulling the power plug out of the socket, in the course of writing the latest data on the remaining quantity of ink to make the writing operation incomplete. The normal data used as the current data on the remaining quantity of ink is, at the oldest, the previous data written immediately before the latest data. This ensures the sufficient accuracy in monitoring the remaining quantity of ink, compared with the conventional structure that uses the abnormal data on the remaining quantity of ink.

Third Embodiment

The following describes a third embodiment according to the present invention, which is applicable to an ink jet printer having an identical structure to that of the ink jet printer 1 of the first embodiment. The like constituents are expressed by the like numerals and are not specifically described here. FIG. 19 shows a data array of a storage element 800 incorporated in the color ink cartridge 107F of the third embodiment.

Figure 20A:
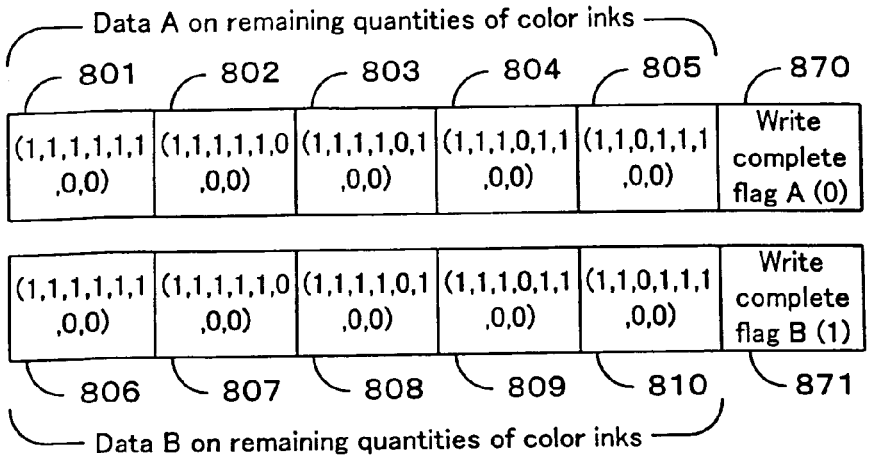
FIGS. 20A through 20C schematically illustrate a data structure of first color ink remaining quantity memory divisions and second color ink remaining quantity memory divisions in the third embodiment.
Figure 20B:
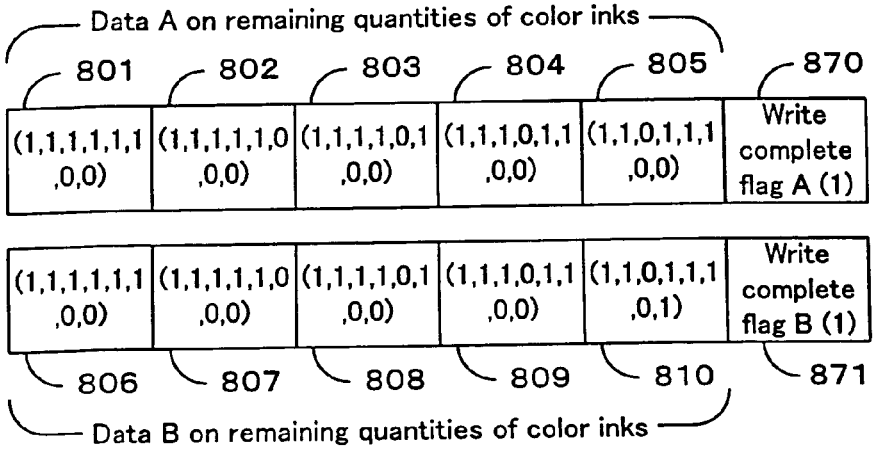
Figure 20C:
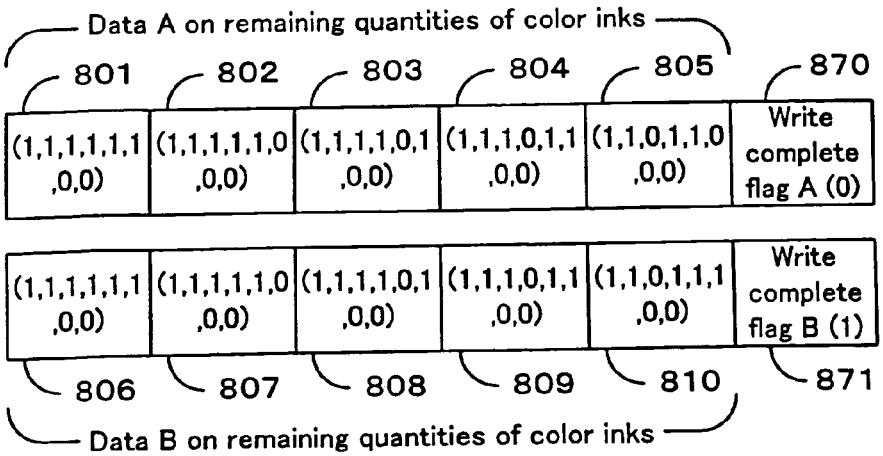
Figure 21:
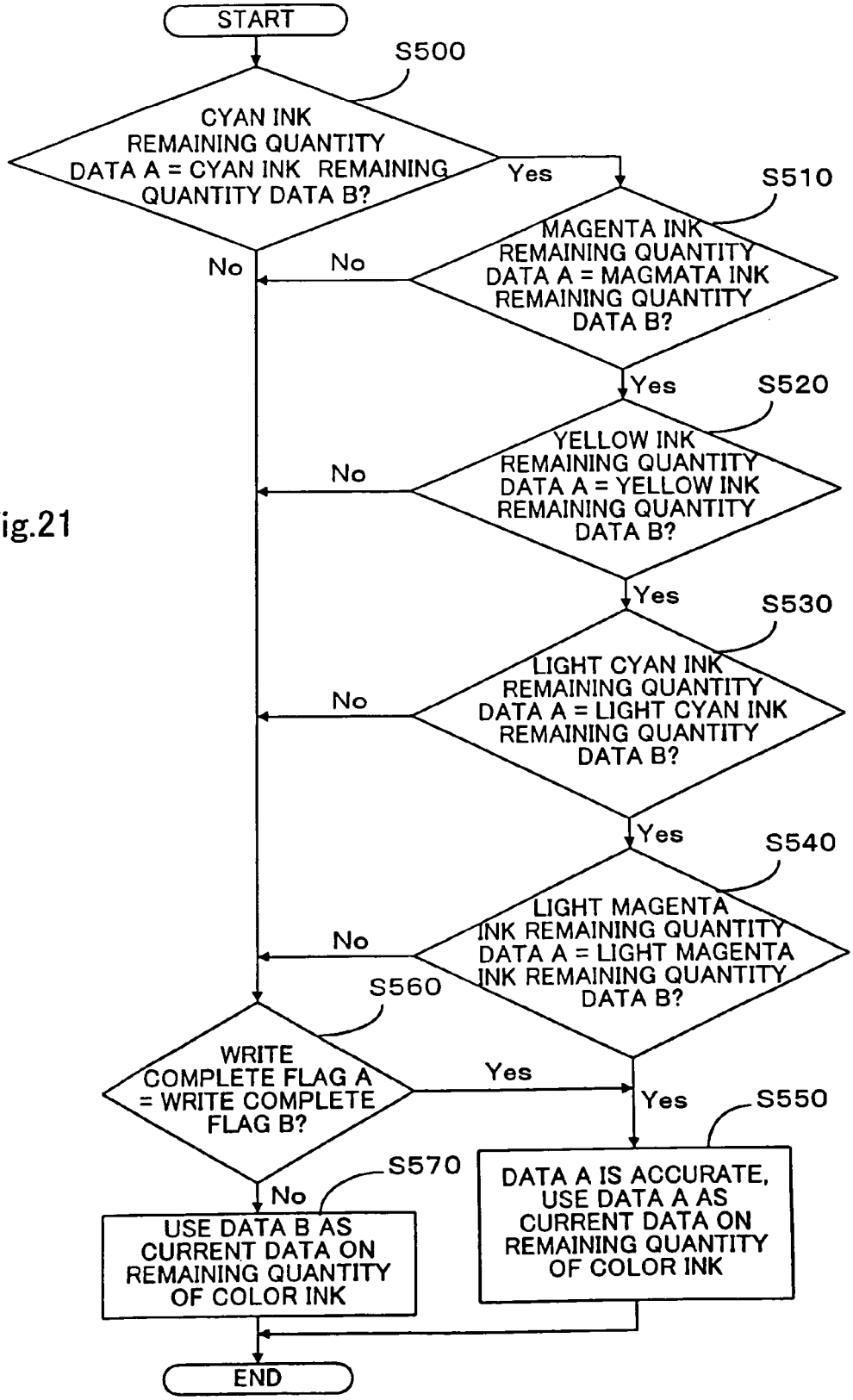
FIG. 21 is a flowchart showing a processing routine to determine data regarding the remaining quantities of color inks in the third embodiment.

FIGS. 20A through 20C schematically illustrate a data structure of first color ink remaining quantity memory divisions and second color ink remaining quantity memory divisions included in the storage element 800 of the third embodiment. FIG. 21 is a flowchart showing a processing routine to determine data regarding the remaining quantities of color inks in the third embodiment.

Part of the internal data structure of the storage element 800 in the color ink cartridge 107F of the third embodiment is different from the internal data structure of the storage element 80 in the color ink cartridge 107F of the first embodiment.

In the second storage area 660 of the color ink cartridge 107F of the first embodiment discussed above, the data on the remaining quantity of each color ink is alternately written into two consecutive memory divisions, that is, the first color ink remaining quantity memory division and the second color ink remaining quantity memory division. In the structure of the third embodiment, on the other hand, a set of first color ink remaining quantity memory divisions, in which data on the remaining quantities of the respective color inks are written first, are followed by a set of second color ink remaining quantity memory divisions, in which the same data are written next.

(Data Structure of Storage Element 800)

The following describes a memory cell 10 of the storage element 800 incorporated in the color ink cartridge 107F with referring to FIG. 19. The memory cell 810 has a first storage area 850, in which read only data are stored, and a second storage area 860, in which rewritable data are stored. The printer main body 100 can only read the data stored in the first storage area 850, while enabling both reading the data stored in writing operations with regard to the data stored in the second storage area 860. The second storage area 860 is located at an address which is accessed prior to the first storage area 850. Namely the second storage area 860 has a lower address (that is, an address closer to the head) than that of the first storage area 850.

The rewritable data stored in the second storage area 860 include first data on the remaining quantity of cyan ink, first data on the remaining quantity of magenta ink, first data on the remaining quantity of yellow ink, first data on the remaining quantity of light cyan ink, first data on the remaining quantity of light magenta ink, second data on the remaining quantity of cyan ink, second data on the remaining quantity of magenta ink, second data on the remaining quantity of yellow ink, second data on the remaining quantity of light cyan ink, and second data on the remaining quantity of light magenta ink that are respectively allocated to color ink remaining quantity memory divisions 801 through 810, which are accessed in this order.

There are two types of memory divisions, that is, the first color ink remaining quantity memory divisions 801 through 805 and the second color ink remaining quantity memory divisions 806 through 810 for storing the data on the remaining quantities of the respective color inks. This arrangement enables the data on the remaining quantities of color inks to be rewritten alternately in these two types of memory divisions. The alternate writing operation enables a comparison between the data on the remaining quantities of the respective color inks stored in the first color ink remaining quantity memory divisions 801 through 805 and the second color ink remaining quantity memory divisions 806 through 810. Based on the comparison, it is determined whether or not the writing operation of the data on the remaining quantities of the respective color inks has been completed normally. It is thereby determined which of these data stored in the two different memory divisions should be used as the current data on the remaining quantities of the respective color inks.

The details of these two types of memory divisions, that is, the first color ink remaining quantity memory divisions 801 through 805 and the second color ink remaining quantity memory divisions 806 through 810, are described with reference to FIG. 20. In the third embodiment, the data on the remaining quantities of the respective color inks are written first into the first color ink remaining quantity memory divisions 801 through 805 and then into the second color ink remaining quantity memory divisions 806 through 810. A first write complete flag A is provided in an end portion 870 of the first memory divisions 801 through 805, and a second write complete flag B is provided in an end portion 871 of the second memory divisions 806 through 810. These write complete flags A and B show whether or not the writing operation of the data on the remaining quantities of color inks has been completed normally in the first memory divisions 801 through 805 and in the second memory divisions 806 through 810. The initial values of the write complete flags A and B are different from each other. In one example, the first write complete flag A has the initial value of 0, whereas the second write complete flag B has the initial value of 1. Both the write complete flags A and B having an identical value thus means that the writing operation has been completed in the first color ink remaining quantity memory divisions 801 through 805.

The following describes the process of determining which of the data A on the remaining quantities of the respective colors ink stored in the first color ink remaining quantity memory divisions 801 through 805 and the data B on the remaining quantities of the respective color inks stored in the second color ink remaining quantity memory divisions 806 through 810 are to be used as the current data on the remaining quantities of the respective color inks, with reference to FIGS. 20A through 20C and the flowchart of FIG. 21.

When the program enters the routine of FIG. 21, the data A on the remaining quantity of cyan ink stored in the first cyan ink remaining quantity memory division 801 is compared with the data B on the remaining quantity of cyan ink stored in the second cyan ink remaining quantity memory division 806 at step S500. In the case where the data A on the remaining quantity of cyan ink is coincident with the data B on the remaining quantity of cyan ink as shown in FIG. 20A, that is, in the case of an affirmative answer at step S500, the program proceeds to step S510 to compare the data A on the remaining quantity of magenta ink stored in the first magenta ink remaining quantity memory division 802 with the data B on the remaining quantity of magenta ink stored in the second magenta ink remaining quantity memory division 807. In the case where the data A on the remaining quantity of magenta ink is coincident with the data B on the remaining quantity of magenta ink, that is, in the case of an affirmative answer at step S510, the program proceeds to step S520 to compare the data A on the remaining quantity of yellow ink stored in the first yellow ink remaining quantity memory division 803 with the data B on the remaining quantity of yellow ink stored in the second yellow ink remaining quantity memory division 808.

In the case where the data A on the remaining quantity of yellow ink is coincident with the data B on the remaining quantity of yellow ink, that is, in the case of an affirmative answer at step S520, the program proceeds to step S530 to compare the data A on the remaining quantity of light cyan ink stored in the first light cyan ink remaining quantity memory division 804 with the data B on the remaining quantity of light cyan ink stored in the second light cyan ink remaining quantity memory division 809. In the case where the data A on the remaining quantity of light cyan ink is coincident with the data B on the remaining quantity of light cyan ink, that is, in the case of an affirmative answer at step S530, the program proceeds to step S540 to compare the data A on the remaining quantity of light magenta ink stored in the first light magenta ink remaining quantity memory division 805 with the data B on the remaining quantity of light magenta ink stored in the second light magenta ink remaining quantity memory division 810. In the case where the data A on the remaining quantity of light magenta ink is coincident with the data B on the remaining quantity of light magenta ink, that is, in the case of an affirmative answer at step S540, the program proceeds to step S550 to determine that the data A on the remaining quantities of the respective color inks are normal and used as the current data on the remaining quantities of the respective color inks. At this moment, the first write complete flag A and the second write complete flag B have different values. After execution of step S550, the program exits from the routine of FIG. 21.

In the event that the data A on the remaining quantity of any color ink is not coincident with the data B on the remaining quantity of the color ink as shown in FIGS. 20B and 20C, that is, in the case of a negative answer at any one of steps S500, S510, S520, S530, and 5540, on the other hand, the program proceeds to step S560 to compare the first write complete flag A with the second write complete flag B. When the first write complete flag A and the second write complete flag B have an identical value as shown in FIG. 20B, that is, in the case of an affirmative answer at step S560, the program determines that the writing operation has been completed normally in the first color ink remaining quantity memory divisions 801 through 805. The data A on the remaining quantities of color inks stored in the first color ink remaining quantity memory divisions 801 through 805 are thus used as the current data on the remaining quantities of the respective color inks at step S550. When the first write complete flag A does not coincide with the second write complete flag B as shown in FIG. 20C, that is, in the case of a negative answer at step S560, on the other hand, the program determines that the writing operation has not been completed normally in the first color ink remaining quantity memory divisions 801 through 805. The data B on the remaining quantities of color inks stoked in the second color ink remaining quantity memory divisions 806 through 810 are thus used as the current data on the remaining quantities of the respective color inks at step S570. After execution of either step S550 or step S570, the program exits from the routine of FIG. 21.

In this embodiment, the first write complete flag A and the second write complete flag B have different initial values, which are reverse to each other. Alternatively the two write complete flags A and B may have an identical initial value. In this alternative arrangement, the first write complete flag A and the second write complete flag B have an identical value in the case of the affirmative answer at steps S500, S510, S520, S530, and S540, and the processing after the decision at step S560 will be inverted.

(Effects of Third Embodiment)

As discussed above, in the color ink cartridge 107F of the third embodiment, the identical data on the remaining quantities of the respective color inks are written into the two types of the color ink remaining quantity memory divisions 801 through 805 and 806 through 810. The first and the second write complete flags A and B are provided in the end portions 870 and 871 of the respective types of ink remaining quantity memory divisions. This arrangement facilitates the quick determination of whether or not the data on the remaining quantities of inks stored in each type of the ink remaining quantity memory divisions are normal. Even if the writing operation has not been completed normally in one type of the ink remaining quantity memory divisions, the arrangement of the third embodiment enables the normal data stored in the other type of the ink remaining quantity memory divisions to be used as the current data on the remaining quantities of the respective color inks. This configuration is especially effective when the power supply is cut off, for example, by accidentally pulling the power plug out of the socket, in the course of writing the latest data on the remaining quantities of inks to make the writing operation incomplete. The normal data used as the current data on the remaining quantities of color inks are, at the oldest, the previous data written immediately before the latest data. This ensures the sufficient accuracy in monitoring the remaining quantities of the respective color inks, compared with the conventional structure that uses the abnormal data on the remaining quantities of inks.

The configuration of the third embodiment provides only two write complete flags A and B respectively attached to the first data on the remaining quantities of color inks and the second data on the remaining quantities of color inks. This improves the efficiency of data storage in the storage element 800.

Fourth Embodiment

The following describes a fourth embodiment according to the present invention, which is applicable to an ink jet printer having a similar structure to that of the ink jet printer 1 of the first embodiment. The difference from the first embodiment is that the ink jet printer of the fourth embodiment has a control IC 200, which is provided on the print head 10 and controls the writing operations into storage elements 1080 and 1082 of black and color ink cartridges 1107K and 1107F. The like constituents are expressed by the like numerals and are not specifically described here. As a matter of convenience, the description first regards the storage elements 1080 and 1082 and then the control IC 200.

(Data Structure of Storage Elements 1080 and 1082)

The following describes the storage elements 1080 and 1082 in the ink cartridges 1107K and 1107F of the fourth embodiment. The black and color ink cartridges 1107K and 1107F of the fourth embodiment have identical structures to those of the black and color ink cartridges 107K and 107F of the first embodiment, except internal data structures of memory cells 1081 and 1083 in the storage elements 1080 and 1082. The like constituents are expressed by the like numerals and are not specifically described here.

The data structure of the memory cell 1081 in the storage element 1080 of the black ink cartridge 1107K is described with reference to FIG. 22. FIG. 22 shows addresses of the control IC 200 in the printer main body 100 and the internal data structure (memory map) of the memory cell 1081 with regard to items of information on the black ink cartridge 1107K. The memory cell 1081 has readable and writable addresses 00 through 18 and read only addresses 28 through 66. A piece of information on the remaining quantity of black ink having the data capacity of 8 bits is registered at the address 00 in the memory cell 1081. A piece of information on the frequency of cleaning the print head 10 and a piece of information on the frequency of attachment of the black ink cartridge 1107K, both having the data capacity of 8 bits, are registered at the addresses 08 and 10, respectively. A piece of information on a total time period of attachment of the ink cartridge 1107K having the data capacity of 16 bits is registered at the address 18. The data regarding the remaining quantity of black ink is allocated to the head address 00 among the readable and writable addresses 00 through 18. This arrangement enables the data regarding the remaining quantity of black ink to be written preferentially.

The data on the remaining quantity of black ink has an initial value of 100 (expressed by percentage) and gradually decreases to 0 with a progress of execution of the printing process. The remaining quantity of black ink may be replaced by the amount of ink consumption. In the latter case, the amount of ink consumption has an initial value of 0 (expressed by percentage) and gradually increases to 100 with a progress of execution of the printing process.

The printer main body 100 has data regarding the maximum ink capacities in the black and color ink cartridges 1107K and 1107F. The calculation of the percentage is based on the maximum ink capacity data and actual amounts of ink consumption. Alternatively the maximum ink capacities may be stored in the storage elements 1080 and 1082 of the respective ink cartridges 1107K and 1107F.

In the case where the amounts of ink consumption are used in place of the remaining quantities of inks, data on the amount of ink consumption may take an initial value in a range of 0 to 90%. Data with no initial values written therein are generally indefinite. Writing the initial value in the range of 0 to 90% into the data ensures the accurate monitor of ink consumption. This arrangement also enables the secure determination of whether or not the quantity of ink kept in the ink cartridge is measured on the assumption that adequate correction is carried out during the use of the ink cartridge. Setting the maximum value of the data on the amount of ink consumption equal to 90% effectively prevents ink from running out in the course of the printing procedure.

In the case of a half-sized ink cartridge, which has half the ink capacity of a standard-sized ink cartridge, data on the remaining quantity of ink or data on the amount of ink consumption may take an initial value of 50%. An alternative technique sets 100% to the initial value of the data on the remaining quantity of ink or 0% to the initial value of the data on the amount of ink consumption, and doubles the decreasing rate or the increasing rate. The latter technique enables the remaining quantities of inks to be monitored on the identical scale when both the standard-sized ink cartridge and the half-sized ink cartridge are attachable to the printer.

Information relating to the manufacture of the black ink cartridge 1107K includes a piece of information on the year of manufacture, which has the data capacity of 7 bits and is registered at the address 28, a piece of information on the month of manufacture, which has the data capacity of 4 bits and is registered at the address 2F, and a piece of information on the date of manufacture, which has the data capacity of 5 bits and is registered at the address 33. The information relating to the manufacture of the ink cartridge 1107K also includes a piece of information on the time (hour) of manufacture, which has the data capacity of 5 bits and is registered at the address 38, a piece of information on the time (minute) of manufacture, which has the data capacity of 6 bits and is registered at the address 3D, and a piece of information on the production serial number, which has the data capacity of 8 bits and is registered at the address 43. A piece of information on the frequency of recycle having the data capacity of 3 bits, a piece of information on the term of validity of ink having the data capacity of 6 bits, and a piece of information on the term of validity after unsealing the ink cartridge 1107K, having the data capacity of 5 bits, are respectively registered at the addresses 4B, 60, and 66.

The data structure of the memory cell 1083 in the storage element 1082 of the color ink cartridge 1107F is described with reference to FIG. 23. FIG. 23 shows addresses of the control IC 200 in the printer main body 100 and the internal data structure (memory map) of the memory cell 1083 with regard to items of information on the color ink cartridge 1107F. The memory cell 1083 has readable and writable addresses 00 through 38 and read only addresses 48 through 86. Pieces of information on the remaining quantities of cyan ink, magenta ink, yellow ink, light cyan ink, and light magenta ink, each having the data capacity of 8 bits, are registered at the addresses 00, 08, 10, 18, and 20 in the memory cell 1083.

A piece of information on the frequency of cleaning the print head 10 and a piece of information on the frequency of attachment of the black ink cartridge 1107F, both having the data capacity of 8 bits, are registered at the addresses 28 and 30, respectively. A piece of information on a total time period of attachment of the ink cartridge 1107F having the data capacity of 16 bits is registered at the address 38. The data regarding the remaining quantities of the respective color inks are allocated to the head addresses 00 through 20 among the recordable and writable addresses 00 through 38. This arrangement enables the data regarding the remaining quantities of the respective color inks to be written preferentially. The pieces of information regarding the remaining quantities of cyan, magenta, and yellow inks are allocated to the first 3 bytes (24 bits), and the pieces of information regarding the remaining quantities of light cyan and light magenta inks are allocated to the following 2 bytes (16 bits). This data structure is thus applicable to a color ink cartridge having only three colors, cyan, magenta, and yellow.

The data on the remaining quantity of each color ink has an initial value of 100 (expressed by percentage) and gradually decreases to 0 with a progress of execution of the printing process. The remaining quantity of each color ink may be replaced by the amount of ink consumption. In the latter case, the amount of ink consumption has an initial value of 0 (expressed by percentage) and gradually increases to 100 with a progress of execution of the printing process. Since the data on the remaining quantity of each color ink may be handled with the same manner as for the data on the remaining quantity of black ink, the above detailed description on the black ink is applicable to the color ink.

Information relating to the manufacture of the color ink cartridge 1107F includes a piece of information on the year of manufacture, which has the data capacity of 7 bits and is registered at the address 48, a piece of information on the month of manufacture, which has the data capacity of 4 bits and is registered at the address 4F, and a piece of information on the date of manufacture, which has the data capacity of 5 bits and is registered at the address 53. The information relating to the manufacture of the ink cartridge 1107F also includes a piece of information on the time (hour) of manufacture, which has the data capacity of 5 bits and is registered at the address 58, a piece of information on the time (minute) of manufacture, which has the data capacity of 6 bits and is registered at the address 5D, and a piece of information on the production serial number, which has the data capacity of 8 bits and is registered at the address 63. A piece of information on the frequency of recycle having the data capacity of 3 bits, a piece of information on the term of validity of inks having the data capacity of 6 bits, and a piece of information on the term of validity after unsealing the ink cartridge 1107K, having the data capacity of 5 bits, are respectively registered at the addresses 6B, 80, and 86.

Referring to FIGS. 22 and 23, among the lower 8-bit addresses of the control IC 200 in the printer main body 100, addresses 00 through 10 are allocated to the information relating to the storage element 1080 of the black ink cartridge 1107K, and addresses 20 through 34 are allocated to the information relating to the storage element 1082 of the color ink cartridge 1107F. The data length of 1 or 2 bytes is allocated to each address.

(Operation of Control IC 200)

Figure 24:
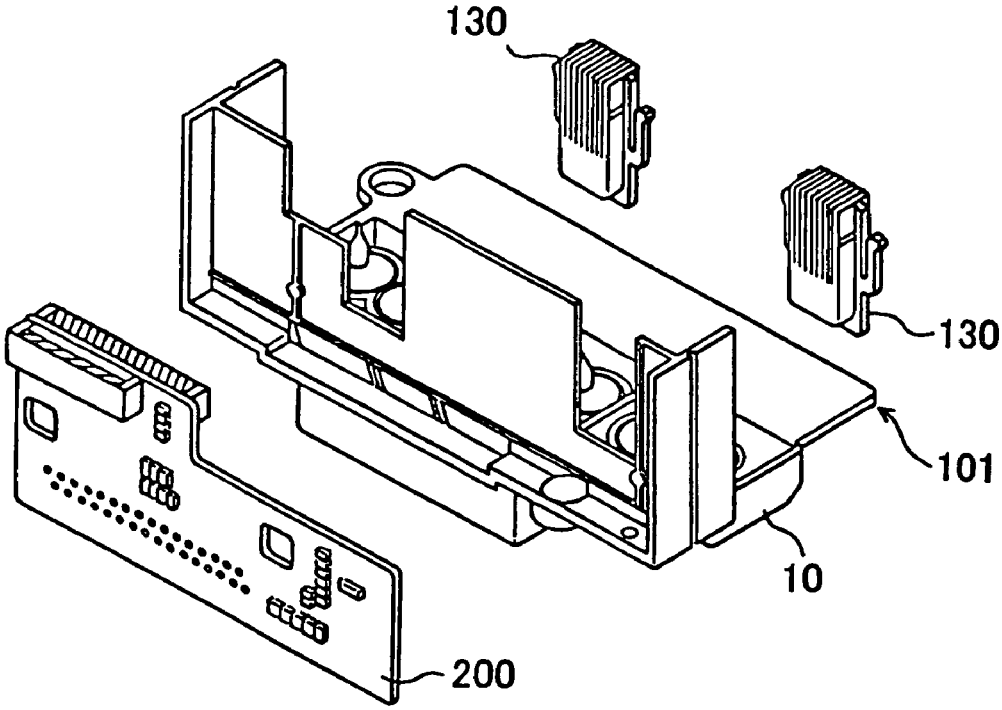
FIG. 24 is a decomposed perspective view illustrating the structure of a carriage in an ink jet printer, to which the fourth embodiment is applicable.
Figure 25:
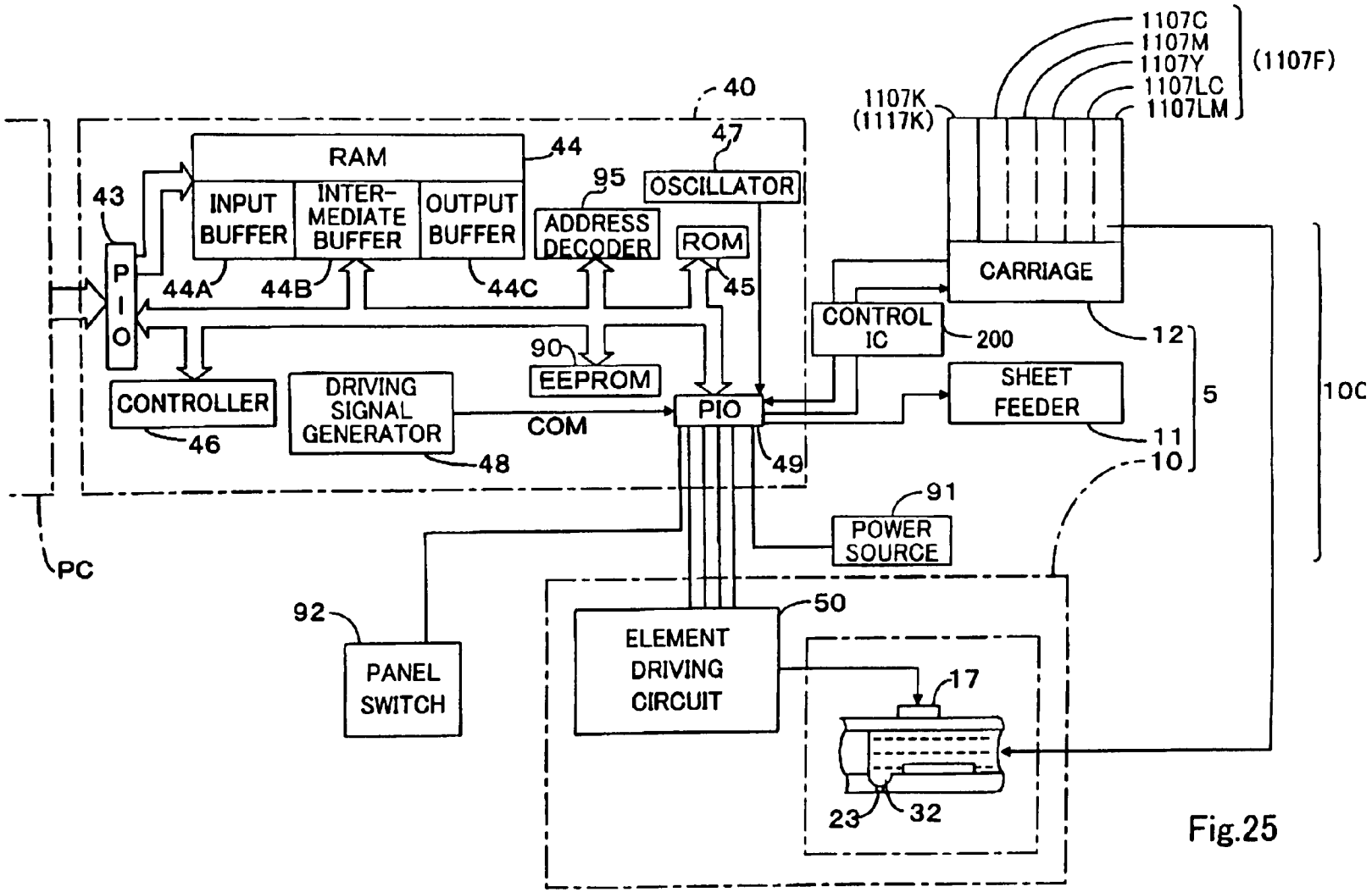
FIG. 25 is a functional block diagram including the control IC in the fourth embodiment.
Figure 26:
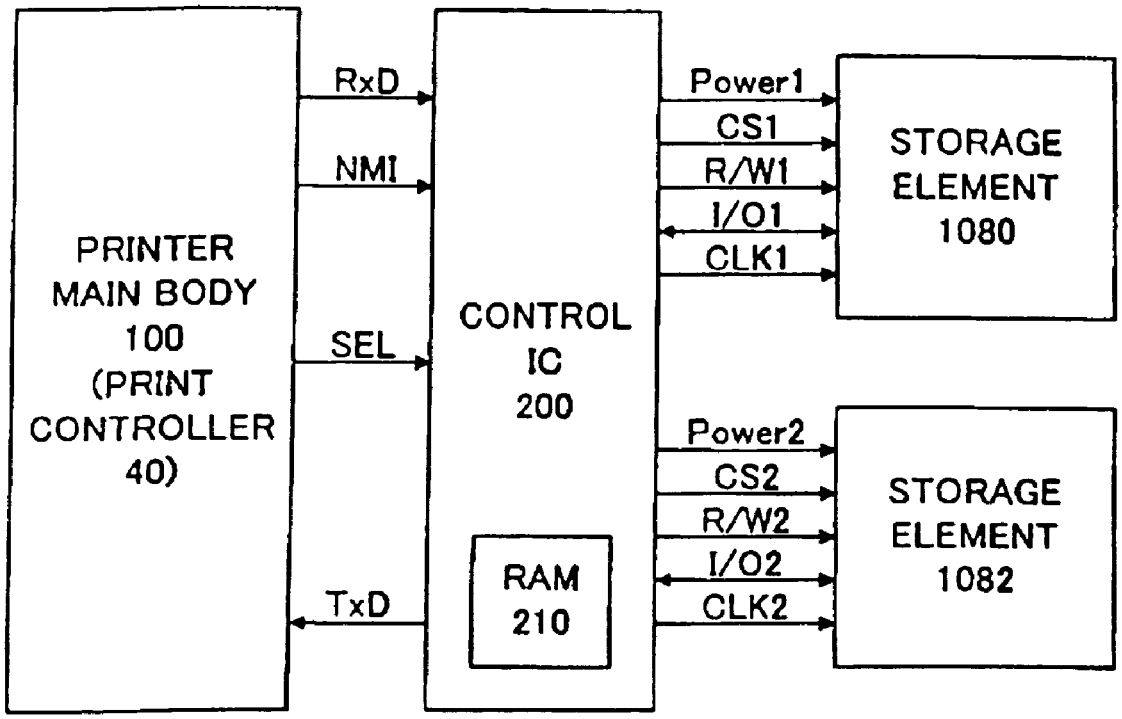
FIG. 26 schematically illustrates a connection between the printer main body, the control IC, and storage elements in the fourth embodiment.

The operation of the control IC 200 is described with reference to FIGS. 24 through 26. As mentioned above, in the structure of the fourth embodiment, the control IC 200 controls the writing operations into the respective storage elements 1080 and 1082. FIG. 24 is a decomposed perspective view illustrating the structure of the carriage 101 in the ink jet printer, to which the fourth embodiment is applicable. FIG. 25 is a functional block diagram including the control IC 200. FIG. 26 schematically illustrates a connection between the printer main body 100, the control IC 200, and storage elements 1080 and 1082.

As shown in FIG. 24, the control IC 200 is provided on and integrated with the print head 10. The control IC 200 comes into contact with the respective storage elements 1080 and 1082 via contact mechanisms 130 disposed on the carriage 101, and controls the writing operations of specific information according to the requirements. Referring to FIGS. 25 and 26, the control IC 200 has a RAM 210, in which data are temporarily kept, and is connected to the print controller 40 via the parallel input-output interface 49 and further to the storage elements 1080 and 1082. The control IC 200 namely interposed between the print controller 40 and the storage elements 1080 and 1082. For convenience of illustration, the print head 10, the carriage mechanism 12, and the control IC 200 are shown separately in FIG. 2.

The print controller 40 outputs an input signal RxD and a command selection signal SEL and carries out the writing operation of specific information into the control IC 200 at preset time intervals. The specific information is temporarily kept in the RAM 210. The preset time interval here represents every time the printing operation for one page is completed, every tithe the printing operation for several raster lines is completed, or every time the manual cleaning process is carried out. The specific information includes, for example, pieces of information regarding the remaining quantities of inks, the frequency of cleaning, the frequency of attachment of the ink cartridge, and the total time of attachment. The control IC 200 receives the input signal RxD and the command selection signal SEL and outputs the information required by the print controller 40 among the information previously read from the respective storage elements 1080 and 1082 and stored in the control IC 200, as an output signal TxD to the print controller 40.

The data on the remaining quantities of inks, which are calculated as described in the first embodiment, are stored in the EEPROM 90 of the printer main body 100. The data on the frequency of cleaning is stored at the time of cleaning into the EEPROM 90. The data on the frequency of attachment are read by the control IC 200 from the storage elements 1080 and 1082 of the respective ink cartridges 1107K and 1107F at the time of attachment of each ink cartridge 1107K or 1107F. The frequency of attachment is incremented by one and stored into the EEPROM 90. The data on the total time of attachment is output to the control IC 200 at the time of detachment of the ink cartridge 1107K or 1107F and written into the storage element 1080 or 1082 of the ink cartridge 1107K or 1107F.

The control IC 200 carries out a decoding process in the course of execution of the writing operation into the storage elements 1080 and 1082 in response to an instruction transmitted from the printer main body 100 (the print controller 40). In accordance with a concrete procedure, the control IC 200 first converts a head address *Adf and an end address *Ade among the addresses (bit data) of the memory cells 1081 and 1083, at which the controller 46 requires writing, into the numbers of clocks. The control IC 200 also converts the data to be written, for example, the data on the remaining quantities of inks (parallel data) into the data on the remaining quantities of inks (serial data). The control IC 200 first outputs (*Adf-1) clock pulses to the storage elements 1080 and 1082, and subsequently outputs (*Ade-*Adf) clock pulses to the storage elements 1080 and 1082 while transferring the converted serial data synchronously. The converted serial data are temporarily registered in the control IC 200 until the writing operation is performed into the respective storage elements 1080 and 1082. In the event that the subsequent writing operation into the control IC 200 by the print controller 40 is carried out before the writing operation into the respective storage elements 1080 and 1082 by the control IC 200, the data stored in the control IC 200 are updated.

The writing operation of the specified information into the storage elements 1080 and 1082 by the control IC 200 is carried out at the time of an off-operation of the power source or at the time of replacement of the ink cartridge. The control IC 200 converts the byte data into the bit data and carries out the writing operation in parallel to the two storage elements 1080 and 1082. The clock pulses output from the control IC 200 correspond to the addresses expressed by the bits.

(Writing Operation into Storage Elements 1080 and 1082)

Figure 27:
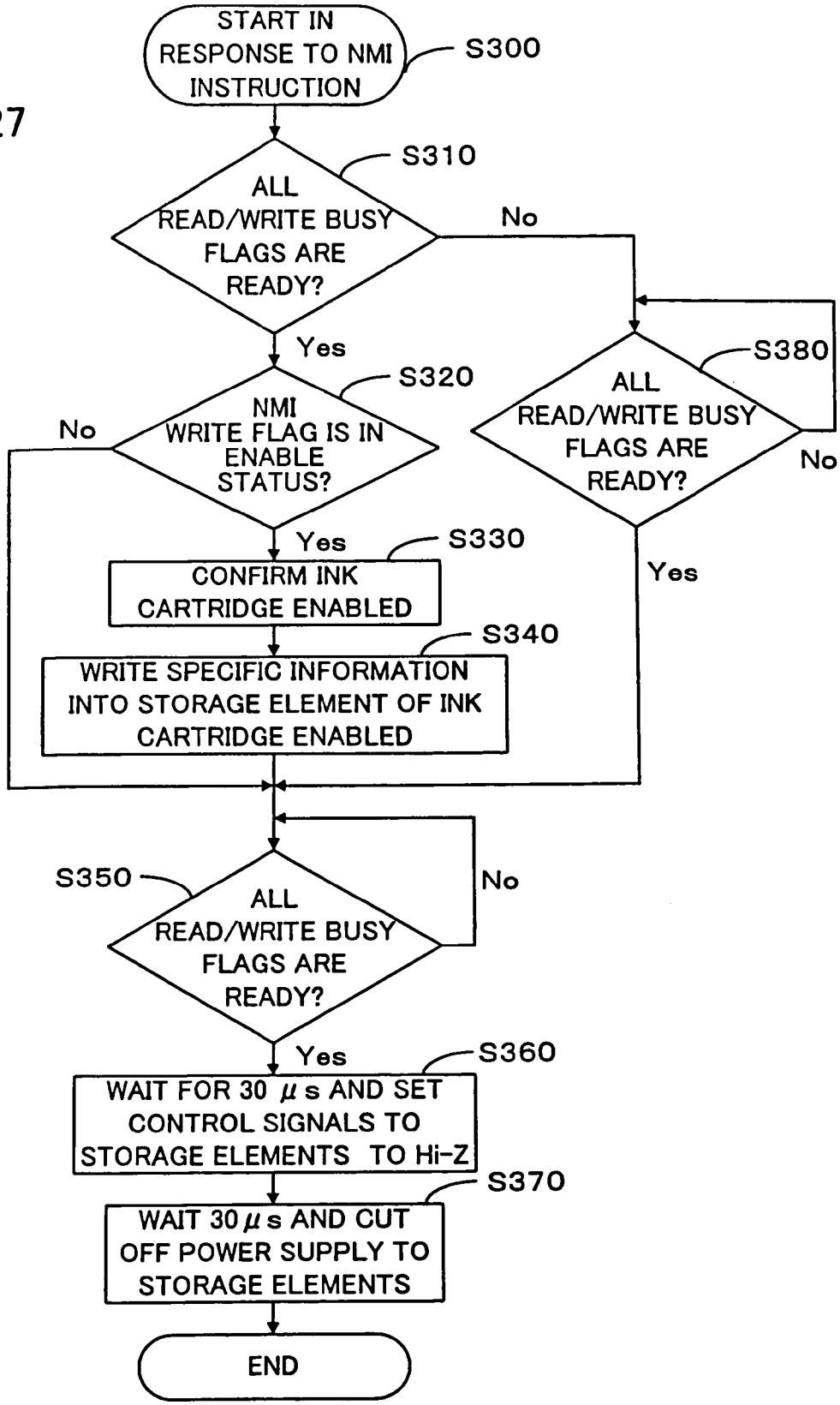
FIG. 27 is a flowchart showing a processing routine of writing operation into the storage elements executed by the control IC in the fourth embodiment.

The writing operation into the storage elements 1080 and 1082 is described with referring to FIG. 27. FIG. 27 is a flowchart showing a processing routine of writing operation into the storage elements 1080 and 1082 executed by the control IC 200 in the fourth embodiment.

When the power supply to the print controller 40 is cut off, for example, by the off-operation of the power source or by pulling the power plug out of the socket, the controller 46 issues a power down instruction NMI as discussed previously. The control IC 200 receives the power down instruction NMI and starts the writing operation into the storage elements 1080 and 1082 at step S300. The control IC 200 refers to a control register area thereof and determines whether or not all read/write busy flags of the storage elements 1080 and 1082 are ready, that is, whether or not reading and writing operations into the storage elements 1080 and 1082 are not in progress at step S310. In the case where all the read/write busy flags are ready, that is, in the case of an affirmative answer at step S310, the control IC 200 determines whether or not an NMI write flag of the storage element 1080 or 1082 is in an enabling state, that is, whether or not the writing operation has been enabled with regard to each of the storage elements 1080 and 1082 at the time of the issuance of the power down instruction NMI at step S320.

In the event that the NMI write flag is in the enabling state, that is, in the case of an affirmative answer at step S320, the control IC 200 confirms the ink cartridge for which the writing operation has been enabled at step S330, and performs the writing operation of the specific information at specified addresses in the enabled ink cartridge for which the writing operation has been enabled at step S340. The specific information includes data on the remaining quantities of inks, data on the frequency of cleaning, data on the frequency of attachment, and data on the total time of attachment, which are written in this sequence. After the writing operation is completed, the control IC 200 waits for all the read/write busy flags to become ready at step S350. When all the read/write busy flags become ready, that is, in the case of an affirmative answer at step S350, the control IC 200 outputs Hi-Z control signals CS1, CS2, CLK1, CLK2, R/W1, R/W2, I/01, and I/02 to the storage elements 1080 and 1082 at step S360. The control IC 200 then cuts off the power supply to the storage elements 1080 and 1082 at step S370.

In the case where all the read/write busy flags are not ready, that is, in the case of a negative answer at step S310, on the other hand, the control IC 200 waits until all the read-write busy flags become ready at step S380. When all the read/write busy flags become ready, that is, in the case of an affirmative answer at step S380, the program executes the processing of steps S350 through S370.

In the event that neither of the storage elements 1080 and 1082 has the NMI write flag in the enabling state, that is, in the case of a negative answer at step S320, the program skips the processing of steps S330 and S340 and executes the processing of steps S350 through S370.

Figure 28:
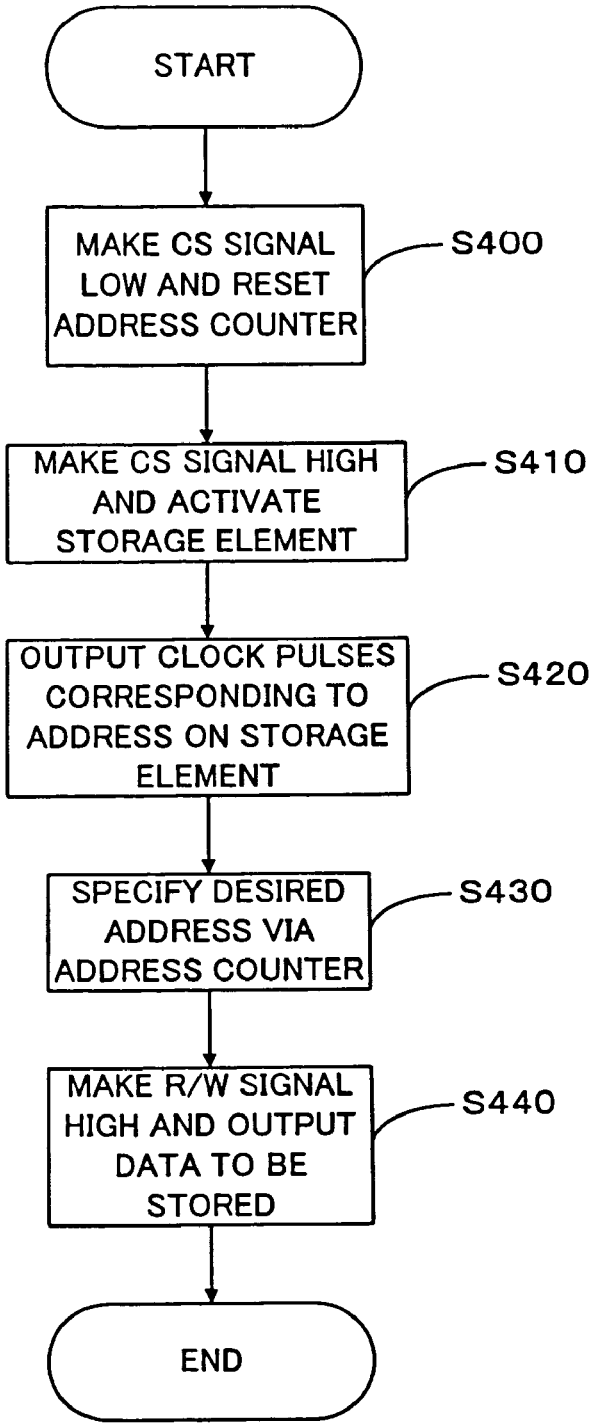
FIG. 28 is a flowchart showing the details of the writing operation in the flowchart of FIG. 27.
Figure 29:
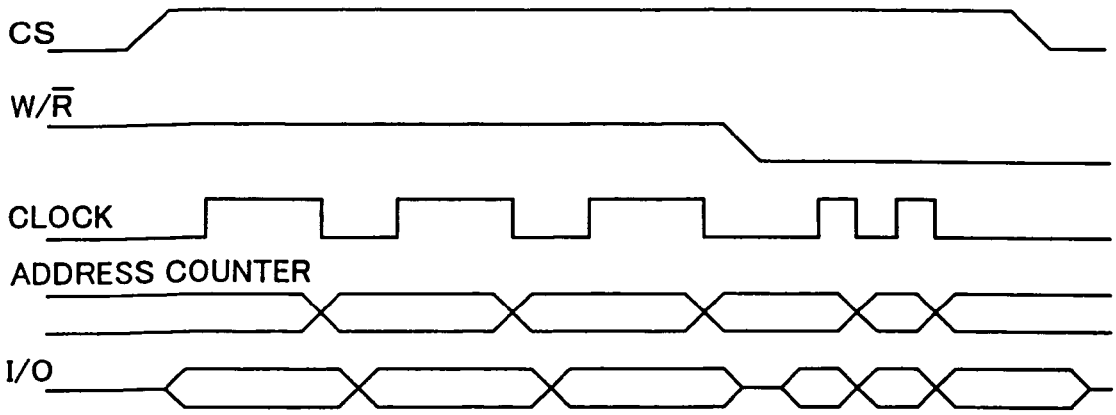
FIG. 29 is a timing chart showing the timing of execution of the writing operation shown in the flowchart of FIG. 27.
Figure 30:
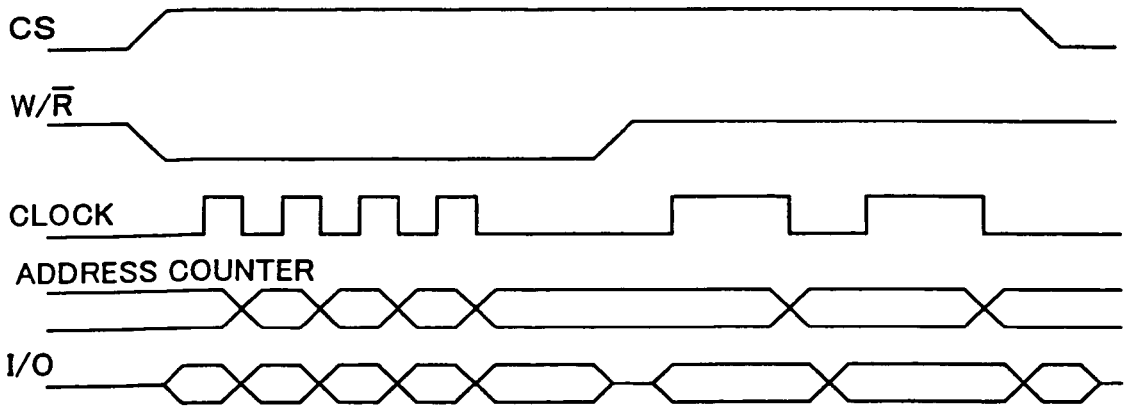
FIG. 30 is a timing chart showing the timing of execution of the writing operation shown in the flowchart of FIG. 27.

The writing operation is further described in detail with reference to FIGS. 28 through 30. FIG. 28 is a flowchart showing a processing routine executed by the control IC 200 in the course of the writing operation. FIGS. 29 and 30 are timing charts showing the timings of execution of the writing operation shown in the flowchart of FIG. 28. More specifically, the timing chart of FIG. 29 shows the timing of execution of the writing operation from a head address, and the timing chart of FIG. 30 shows the timing of execution of the writing operation from a desired address via a dummy reading operation.

When the program enters the routine of FIG. 28, the control IC 200 makes the CS signal in a low level and resets the address counter 83 included in the storage element 1080 or 1082 at step S400 as shown in the timing chart of FIG. 29. The control IC 200 then makes the CS signal in a high level and activates the storage element 1080 or 1082 at step S410. The control IC 200 subsequently outputs a specific number of clock pulses to the storage element 1080 or 1082 at step S420. The specific number of clock pulses corresponds to a desired address, which is transmitted from the print controller 40 and to which the print controller 40 requires writing the specific data. The address counter 83 in the storage element 1080 or 1082 increments the address by bit at a timing of a fall of the clock signal. The control IC 200 can accordingly specify the desired address via the address counter 83 at step S430. The control IC 200 makes the R/W signal in a high level so as to specify the writing operation into the storage element 1080 or 1082, and outputs the data, which are to be written, to a data bus at step S440. This enables the specific data to be written at the specified addresses in the memory cell 1081 or 1083 of the storage element 1080 or 1082. After execution of step S440, the program exits from the routine of FIG. 28. As described above, in the structure of the fourth embodiment, the address is specified and incremented by bit.

In the case where the writing operation is performed with regard to a next address that is continuous with the previously specified address, the CS signal and the R/W signal are kept, in the high state. The control IC 200 then outputs a specific number of clock pulses corresponding to the next address to the address counter 83 in the storage element 1080 or 1082. After the specification of the next address, the specific data output from the control IC 200 are written into the storage element 1080 or 1082. In the case where the writing operation is performed with regard to a next address that is discontinuous with the previously specified address, on the other hand, the control IC 200 outputs the low R/W signal to the storage element 1080 or 1082 and performs the ineffective writing operation up to the next address as shown in the timing chart of FIG. 30. At the next address, the control IC 200 outputs the high R/W signal to the storage element 1080 or 1082 and the specific data to the data bus, so as to implement the writing operation.

In the arrangement of the fourth embodiment, the data on the remaining quantities of the respective inks are written into the storage elements 1080 and 1082 in the following manner. As described previously, the address 00 is allocated to store the data on the remaining quantity of black ink in the memory cell 1081 of the storage element 1080, and the addresses 00, 08, 10, 18, and 20 are allocated to store the data on the remaining quantities of the respective color inks in the memory cell 1083 of the storage element 1082. The arrangement of this embodiment resets the address counters 83 in the storage elements 1080 and 1082 to zero when the control IC 200 performs the writing operation into the storage elements 1080 and 1082. This enables the data on the remaining quantities of the respective inks to be written prior to the other data into the storage elements 1080 and 1082 in the course of the writing operation by the control IC 200.

(Effects of Fourth embodiment)

The arrangement of the fourth embodiment enables the data on the remaining quantities of the respective inks to be written preferentially into the storage elements 1080 and 1082 on the off-operation of the power source. Even if the power plug is pulled out of the socket immediately after the power-off operation, this arrangement sufficiently ensures the storage of the data on the remaining quantities of inks.

The processing routine executed by the control IC 200 to write data into the storage elements 1080 and 1082 is carried out when the power plug is accidentally pulled out of the socket without the power-off operation or when the power supply is accidentally cut off. The power down instruction NMI is issued under such conditions as mentioned previously, and the electric power is supplied to the print controller for 0.3 seconds by means of the auxiliary power source incorporated in the printer main body 100. Since the arrangement of this embodiment preferentially writes the data on the remaining quantities of the respective inks into the storage elements 1080 and 1082, the writing operation can be completed within the time period of the auxiliary power supply.

(Modification of Fourth embodiment)

Figure 31:
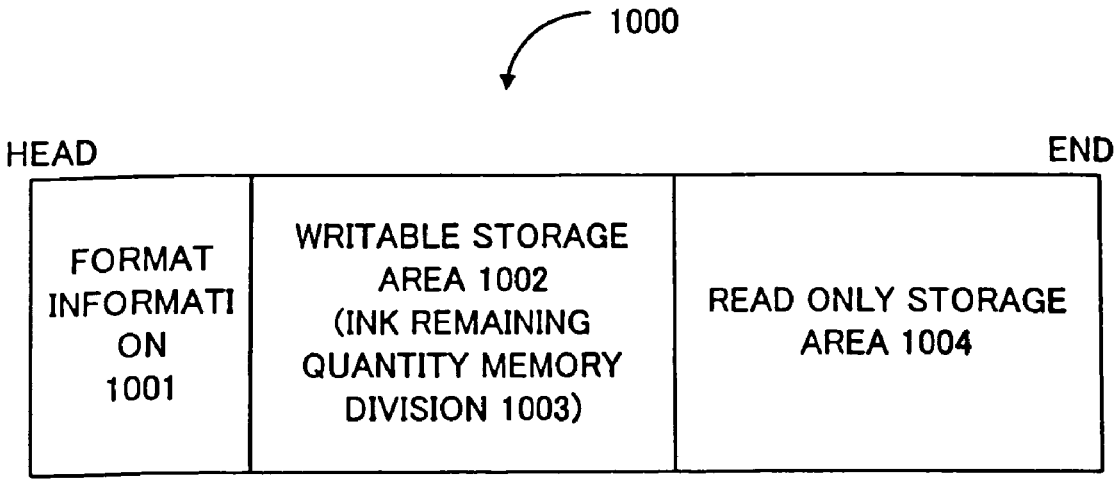
FIG. 31 schematically illustrates a data array in a memory cell in one modification of the fourth embodiment.

In the fourth embodiment, the data on the remaining quantities of the respective inks are located at the specific addresses in the memory cell, which are accessed preferentially by the printer main body 100. One possible modification of the fourth embodiment has format information at a specific address accessed first by the printer main body 100 as shown in FIG. 31. FIG. 31 schematically illustrates a data array 1000 in a memory cell in one modification of the fourth embodiment. The data array 1000 includes format information 1001, which is used to specify information stored in the memory cell. One applicable procedure specifies an ink remaining quantity memory division 1003 included in a writable storage area 1002 as the target writing area based on the format information 1001, and subsequently carries out the required writing operation. This arrangement advantageously prevents information stored in a read only storage area 1004 from being erased accidentally.

In a modified structure that uses a common storage element to both the black ink cartridge and the color ink cartridge, required information can be accessed readily based on the format information 1001. This arrangement favorably saves the time period required for the access, that is, for the reading and writing operations. In this arrangement, the capacity of the ink remaining quantity memory division 1003 is determined corresponding to the capacity of each ink chamber in the ink cartridge by the format information 1001. In the case where the ink cartridge has less pieces of information to be stored, the accessible area may be restricted by the format information 1001. This ensures the shorter access time even in the case of general-purpose storage elements.

(Possible Modifications)

In the first and the second embodiments discussed above, the data stored in the second storage areas 660 and 760 are only the data on the remaining quantities of the respective inks. One possible modification may store other data, for example, the data on the frequency of attachment and detachment of the ink cartridges 107K and 107F and the data on the time elapsing after unsealing the ink cartridges 107K and 107F, into the second storage areas 660 and 760 as rewritable data, which are transmitted from and to the printer main body 100. The presence of bubbles in ink stored in the ink cartridge depends upon the frequency of attachment and detachment of the ink cartridge. The optimal conditions of ink supply (for example, the frequency of flushing) in the flow paths from the ink cartridges 107K and 107F to the print head 10 may thus be determined according to the frequencies of attachment and detachment of the ink cartridges 107K and 107F, which are stored in the second storage areas 660 and 760.

In the color ink cartridges 107F of the first through the third embodiments, the second storage areas 660 and 860 provide two memory divisions for each color ink to sequentially store the latest data on the remaining quantity of the color ink. Three or more memory divisions may, however, be provided for each color ink.

In the second and the third embodiments discussed above, the write complete flag is inverted to determine whether or not the writing operation of the data on the remaining quantity of each ink has been completed for each ink remaining quantity memory division. The write complete flag may have two or greater bits. A counter may alternatively be applied for the determination of whether or not the writing operation has been completed for each ink remaining quantity memory division.

In the embodiments discussed above, the address counter 83 used is a count-up type. A countdown type may alternatively be used for the address counter 83. For example, in the first and the second embodiments of this modified structure, the data array should be changed in such a manner that the second storage areas 660 and 760 are accessed prior to the first storage areas 650 and 750. Namely the second storage areas 660 and 760 are located at the higher addresses than those of the first storage areas 650 and 750. In the third and the fourth embodiments of this modified structure, the data on the remaining quantities of the respective inks stored at the head addresses should be located at the end addresses.

In all the embodiments discussed above, the data on the remaining quantities of the respective inks are stored at the head of the memory addresses. The data on the remaining quantity of each ink may, however, be stored at any memory address, which is preferentially accessed by the printer main body 100 (print controller 40). For example, when intermediate addresses are accessed first by the print controller 40 for the writing operation, the data on the remaining quantities of inks may be stored at the intermediate addresses. Namely the storage positions of the data on the remaining quantities of the respective inks are not limited to the physically head addresses in the memory cells 81, 810, 1081, and 1082, but may be any memory addresses preferentially accessed for reading and writing operations.

In all the above embodiments, the EEPROM is applied for the storage elements 80, 800, 1080, and 1082. A dielectric memory of the sequential access type FEROM may be used instead of the EEPROM. The EEPROM includes flash memories.

In all the above embodiments, the remaining quantities of inks are used as the information relating to the quantities of inks. The amounts of ink consumption may, however, be used instead of the remaining quantities of inks.

Figure 32:
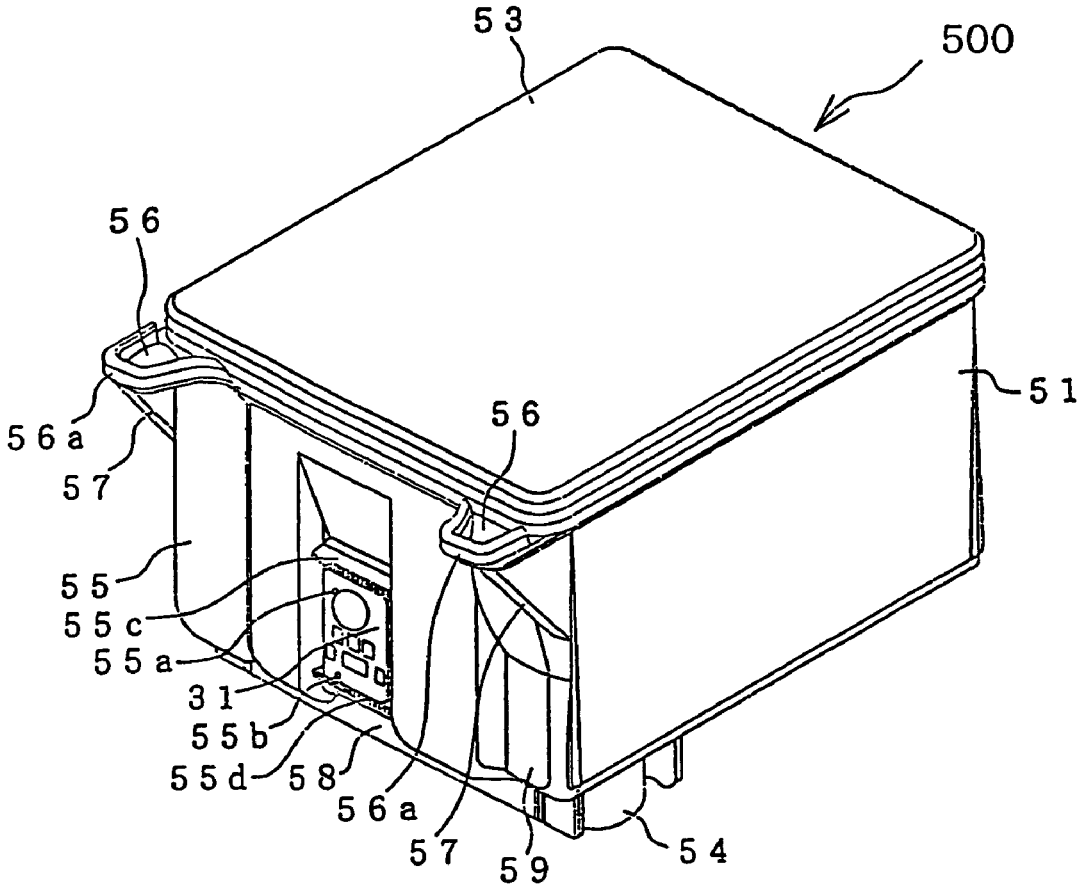
FIG. 32 is a perspective view illustrating the appearance of another ink cartridge as one modification of the present invention.

The ink cartridges 107K, 107F, 1107K, and 1107F used in the above embodiments may be replaced with another ink cartridge 500 shown in FIG. 32. FIG. 32 is a perspective view illustrating the appearance of the ink cartridge 500 as one modification of the present invention.

The ink cartridge 500 includes a vessel 51 substantially formed in the shape of a rectangular parallelepiped, a porous body (not shown) that is impregnated with ink and accommodated in the vessel 51, and a cover member 53 that covers the top opening of the vessel 51. The vessel 51 is parted into five ink reservoirs (like the ink reservoirs 107C, 107LC, 107M, 107LM, and 107Y in the ink cartridges 107F and 1107F discussed in the above embodiments), which separately keep five different color inks. Ink supply inlets 54 for the respective color inks are formed at specific positions on the bottom face of the vessel 51. The ink supply inlets 54 at the specific positions face ink supply needles (not shown here) when the ink cartridge 500 is attached to a cartridge attachment unit of a printer main body (not shown here). A pair of extensions 56 are integrally formed with the upper end of an upright wall 55, which is located on the side of the ink supply inlets 54. The extensions 56 receive projections of a lever (not shown here) fixed to the printer main body. The extensions 56 are located on both side ends of the upright wall 55 and respectively have ribs 56*a*. A triangular rib 57 is also formed between the lower face of each extension 56 and the upright wall 55. The vessel 51 also has a check recess 59, which prevents the ink cartridge 500 from being attached to the unsuitable cartridge attachment unit mistakenly.

The upright wall 55 also has a recess 58 that is located on the substantial center of the width of the ink cartridge 500. A circuit board 31 is mounted on the recess 58. The circuit board 31 has a plurality of contacts, which are located to face contacts on the printer main body, and a storage element (not shown) mounted on the rear face thereof. The upright wall 55 is further provided with projections 551 and 55*b* and extensions 55*c* and 55*d* for positioning the circuit board 31.

In the above embodiments, five color inks, that is, magenta, cyan, yellow, light cyan, and light magenta, are applied for the plurality of different color inks. The present invention is also applicable to another combination of these color inks such as three color inks combination of magenta, cyan and yellow or these color inks and some additional color inks.

The principle of the present invention is applicable to the off-carriage type printer, in which the ink cartridges are not mounted on the carriage, as well as to the on-carriage type printer, in which the ink cartridges are mounted on the carriage as described in the first through the third embodiments.

The present invention is not restricted to the above embodiments or their modifications, but there may be many other modifications, changes, and alterations without departing from the scope or spirit of the main characteristics of the present invention.

The scope and spirit of the present invention are limited only by the terms of the appended claims.

What is claimed is:

1. An ink cartridge configured to be detachably attached to a printer, said ink cartridge comprising:

an ink reservoir in which an ink used for printing is kept;

a storage unit having a plurality of ink quantity information memory divisions and a plurality of write complete information storage areas, and the storage unit storing specific information in a readable, writable, and non-volatile manner, a plurality of ink reservoirs, in which a plurality of inks are kept respectively; and a plurality of ink quantity information memory divisions and a plurality of write complete information storage areas provided for each of said plurality of ink reservoirs, wherein the specific information comprises information relating to a quantity of ink kept in said ink reservoir, wherein the plurality of ink quantity information memory divisions store the ink quantity-relating information, and wherein the plurality of write complete information storage areas respectively correspond to the plurality of ink quantity information memory divisions and in each of which write complete information is registered when a writing operation into the corresponding ink quantity information memory division is completed, and wherein said storage unit has two ink quantity information memory divisions, and each write complete information storage area is located following an end-of-writing position in each, of the ink quantity information memory divisions.

2. An ink cartridge in accordance with claim 1, wherein a predetermined flag is written into each of the write complete information storage areas when the writing operation has been completed in the corresponding ink quantity information memory division, and the predetermined flag has different initial values with regard to the respective write complete information storage areas.

3. An ink cartridge in accordance with claim 1, wherein a predetermined flag is written into each of the write complete information storage areas when the writing operation has been completed in the corresponding ink quantity information memory division, and the predetermined flag has an identical initial value with regard to the respective write complete information storage areas.

4. An ink cartridge in accordance with claim 3, wherein the ink quantity information memory divisions are included in a specific area of said storage unit that is written first by said printer.

5. An ink cartridge in accordance with claim 4, wherein said storage unit is sequentially accessed in synchronism with a clock signal.

6. An ink cartridge in accordance with claim 5, wherein the ink quantity-relating information regards a remaining quantity of ink in said ink cartridge.

7. An ink cartridge in accordance with claim 5, wherein the ink quantity-relating information regards a cumulative amount of ink consumption with regard to said ink cartridge.

8. A printer, to which an ink cartridge in accordance with any one of claims 1-7 is detachably attached, said printer comprising:

a storage device that stores specific information that is to be written into said ink cartridge, wherein the specific information comprises information relating to a quantity of ink kept in said ink cartridge;

an ink quantity information writing unit that writes the ink quantity-relating information into a plurality of ink quantity information memory divisions, which are included in said storage device; and a write complete information writing unit writing write complete information into a write complete information storage area when the writing operation of the ink quantity-relating information into each of the ink quantity information memory divisions has been completed, wherein the write complete information storage area is provided corresponding to each of the ink quantity information memory divisions in said storage device.

9. A printer in accordance with claim 8, farther comprising:

a determination unit that determines whether or not the writing operation of the ink quantity-relating information into each of the ink quantity information memory divisions has been carried out properly, based on values of the ink quantity-relating information written in the ink quantity information memory divisions and values of the write complete information written in the write complete information storage areas.

10. A method of writing specific information into an ink cartridge, said ink cartridge being configured to be detachably attached to a printer and having a storage element, said method comprising the steps of:

(a) providing the specific information that is to be written into said storage element by said printer, the specific information comprising information relating to a quantity of ink kept in said ink cartridge;

(b) writing first ink quantity-relating information into a first ink quantity information memory division, which is included in said storage element;

(c) writing first write complete information into a first write complete information storage area when the writing operation of the first ink quantity-relating information into the first ink quantity information memory division has been completed, wherein the first write complete information storage area is provided corresponding to the first ink quantity information memory division in said storage element;

(d) writing second ink quantity-relating information into a second ink quantity information memory division after the writing operation of the first write complete information into the first write complete information storage area has been completed, wherein the second ink quantity information memory division is included in said storage element; and (e) writing second write complete information into a second write complete information storage area when the writing operation of the second ink quantity-relating information into the second ink quantity information memory division has been completed, wherein the second write complete information storage area is provided corresponding to the second ink quantity information memory division in said storage element.

11. A method in accordance with claim 10, said method further comprising the step of:

(f) determining whether the writing operations of the first ink quantity-relating information and the second ink quantity-relating information respectively into the first and second ink quantity information memory divisions in said steps (b) and (d) have been carried out properly, based on values of the first ink quantity-relating information and the second ink quantity-relating information written in the first and second ink quantity information memory divisions and values of the first write complete information and second write complete information written in the first and second write complete information storage areas.

12. A method in accordance with claim 11, wherein said step (f) determines that the writing operations of the first ink quantity-relating information and the second ink quantity-relating information respectively into the first and second ink quantity information memory divisions have been carried out properly, in the case where the first ink quantity-relating information stored in the first ink quantity information memory division coincides with the second ink quantity-relating information stored in the second ink quantity information memory division.

13. A method in accordance with claim 12, wherein the first write complete information and the second write complete information have a certain combination of preset initial values, said method further comprising the step of:

(g) identifying a combination of a current value of the first write complete information with a current value of the second write complete information, in the case where the first ink quantity-relating information stored in the first ink quantity information memory division does not coincide with the second ink quantity-relating information stored in the second ink quantity information memory division, wherein said step (f) determines that the writing operation of the first ink quantity-relating information into the first ink quantity information memory division has been carried out properly, in the case where the combination of the current values of the first write complete information and the second write complete information is different from the certain combination of the preset initial values.

14. A method in accordance with claim 13, further comprising the step of:

(h) writing the first ink quantity-relating information into the second ink quantity information memory division.

15. A method in accordance with claim 14, wherein the first write complete information and the second write complete information are flags.

16. A method in accordance with claim 12, wherein the first write complete information and the second write complete information have a certain combination of preset initial values, said method further comprising the step of:

(g) identifying a combination of a current value of the first write complete information with a current value of the second write complete information, in the case where the first ink quantity-relating information stored in the first ink quantity information memory division does not coincide with the second ink quantity-relating information stored in the second ink quantity information memory division, wherein said step (f) determines that the writing operation of the first ink quantity-relating information into the first ink quantity information memory division has not been carried out properly, in the case where the combination of the current values of the first write complete information and the second write complete information is identical with the certain combination of the preset initial values.

17. A printer, having an ink cartridge detachably attached thereto, the ink cartridge comprising:

an ink reservoir in which an ink used for printing is kept;

a storage unit having a plurality of ink quantity information memory divisions and a plurality of write complete information storage areas, and the storage unit storing specific information in a readable, writable, and non-volatile manner, a plurality of ink reservoirs, in which a plurality of inks are kept respectively; and a plurality of ink quantity information memory divisions and a plurality of write complete information storage areas provided for each of said plurality of ink reservoirs, wherein the specific information comprises information relating to a quantity of ink kept in said ink reservoir, wherein the plurality of ink quantity information memory divisions store the ink quantity-relating information, and wherein the plurality of write complete information storage areas respectively correspond to the plurality of ink quantity information memory divisions and in each of which write complete information is registered when a writing operation into the corresponding ink quantity information memory division is completed, said printer comprising:

a storage device that stores specific information that is to be written into said ink cartridge, wherein the specific information comprises information relating to a quantity of ink kept in said ink cartridge;

a first ink quantity information writing unit that writes first ink quantity-relating information into a first ink quantity information memory division, which is included in said storage device;

a first write complete information writing unit that writes first write complete information into a. first write complete information storage area when the writing operation of the first ink quantity-relating information into the first ink quantity information memory division has been completed, wherein the first write complete information storage area is provided corresponding to the first ink quantity information memory division in said storage device;

a second ink quantity information writing unit that writes second ink quantity-relating information into a second ink quantity information memory division following the writing operation of the first write complete information into the first write complete information storage area has been completed, wherein second ink quantity information memory division is included in said storage device; and a second write complete information writing unit that writes second write complete information into a second write complete information storage area when the writing operation of the second ink quantity-relating information into the second ink quantity information memory division has been completed, wherein the second write complete information storage area is provided corresponding to the second ink quantity information memory division in said storage device.

18. A printer in accordance with claim 17, further comprising:

a determination unit that determines whether or not the writing operations of the first ink quantity-relating information and the second ink quantity-relating information respectively into the first and second ink quantity information memory divisions have been carried out properly, based on values of the first ink quantity-relating information and the second ink quantity-relating information written in the first and second ink quantity information memory divisions and values of the first write complete information and second write complete information written in the first and second write complete information storage areas.

19. A printer in accordance with claim 18, wherein said determination unit determines that the writing operations of the first ink quantity-relating information and the second ink quantity-relating information respectively into the first and second ink quantity information memory divisions have been carried out properly, in the case where the first ink quantity-relating information stored in the first ink quantity information memory division coincides with the second ink quantity-relating information stored in the second ink quantity information memory division.

20. A printer in accordance with claim 19, wherein the first write complete information and the second write complete information have a certain combination of preset initial values, said printer further comprising;

an identification unit that identifies a combination of a current value of the first write complete information with a current value of the second write complete information, in the case where the first ink quantity-relating information stored in the first ink quantity information memory division does not coincide with the second ink quantity-relating information stored in the second ink quantity information memory division, said determination unit determining that the writing operation of the first ink quantity-relating information into the first ink quantity information memory division has been carried out properly, in the case where the combination of the current values of the first write complete information and the second write complete information is different from the certain combination of the preset initial values.

21. A printer in accordance with claim 19, wherein the first write complete information and the second write complete information have a certain combination of preset initial values, said printer further comprising:

an identification unit that identifies a combination of a current value of the first write complete information with a current value of the second write complete information, in the case where the first ink quantity-relating information stored in the first ink quantity information memory division does not coincide with the second ink quantity-relating information stored in the second ink quantity information memory division, said determination unit determining that the writing operation of the first ink quantity-relating information into the first ink quantity information memory division has not been carried out properly, in the case where the combination of the current values of the first write complete information and the second write complete information is identical with the certain combination of the preset initial values.

22. A printer in accordance with claim 21, wherein said first ink quantity information writing unit and said second ink quantity information writing unit preferentially carry out the writing operations into the first ink quantity information memory division and the second ink quantity information memory division in said storage device, respectively.

23. A printer in accordance with claim 22, wherein the first write complete information and the second write complete information are flags.

24. A storage device mounted on an ink cartridge having a plurality of ink reservoirs in which a plurality of inks are kept respectively, which is configured to be detachably attached to a printer, said storage device comprising:

a storage element having a plurality of ink quantity information memory divisions and a plurality of write complete information storage areas, and storing specific information in a readable, writable, and non-volatile manner, wherein the plurality of ink quantity information memory divisions and the plurality of write complete information storage areas provided for each of said plurality of ink reservoirs, wherein the specific information comprises information relating to a quantity of ink kept in said ink cartridge, wherein the plurality of ink quantity information memory divisions stores the ink quantity-relating information, and wherein the plurality of write complete information storage areas respectively correspond to the plurality of ink quantity information memory divisions and in each of which write complete information is registered when a writing operation into the corresponding ink quantity information memory division is completed, wherein said storage element has two ink quantity information memory divisions, and each write complete information storage area is located after an end-of-writing position in each of the ink quantity information memory divisions.

25. A storage device in accordance with claim 24, wherein a predetermined flag is written into each of the write complete information storage areas when the writing operation has been completed in the corresponding ink quantity information memory division, and the predetermined flag has different initial values with regard to the respective write complete information storage areas.

26. A storage device in accordance with claim 24, wherein a predetermined flag is written into each of the write complete information storage areas when the writing operation has been completed in the corresponding ink quantity information memory division, and the predetermined flag has an identical initial value with regard to the respective write complete information storage areas.

27. A storage device in accordance with claim 26, wherein the ink quantity information memory divisions are included in a specific area of said storage element that is written first by said printer.

28. A storage device in accordance with claim 27, said storage device further comprising:

an address counter that outputs a count in response to a clock signal output from said printer, wherein said storage element is sequentially accessed, based on the count output from said address counter.

29. A storage device in accordance with claim 28, wherein the ink quantity-relating information regards a remaining quantity of ink in said ink cartridge.

30. A storage device in accordance with claim 28, wherein the ink quantity-relating information regards a cumulative amount of ink consumption with regard to said ink cartridge.

* * * * *